US011414291B2

(12) United States Patent
Talken et al.

(10) Patent No.: US 11,414,291 B2
(45) Date of Patent: Aug. 16, 2022

(54) ELECTRIC CAM DIVERTER

(71) Applicant: GEO. M. MARTIN COMPANY, Emeryville, CA (US)

(72) Inventors: Daniel J. Talken, Lafayette, CA (US); Charles D. Rizzuti, Martinez, CA (US)

(73) Assignee: Geo. M. Martin Company, Emeryville, CA (US)

( * ) Notice: Subject to any disclaimer, the term of this patent is extended or adjusted under 35 U.S.C. 154(b) by 317 days.

(21) Appl. No.: 16/668,411

(22) Filed: Oct. 30, 2019

(65) Prior Publication Data

US 2020/0140221 A1 May 7, 2020

Related U.S. Application Data

(60) Provisional application No. 62/754,732, filed on Nov. 2, 2018.

(51) Int. Cl.
*B65H 29/58* (2006.01)

(52) U.S. Cl.
CPC ..... *B65H 29/58* (2013.01); *B65H 29/585* (2013.01); *B65H 2301/4447* (2013.01); *B65H 2403/512* (2013.01); *B65H 2701/176* (2013.01)

(58) Field of Classification Search
CPC ..... B65H 5/36; B65H 29/58; B65H 29/585; B65H 2403/512; B65H 2701/176
See application file for complete search history.

(56) References Cited

U.S. PATENT DOCUMENTS

| | | | |
|---|---|---|---|
| 2,540,972 | A | 2/1951 | Wagner |
| 3,208,603 | A | 9/1965 | Kinker |
| 3,264,917 | A | 8/1966 | Califano |
| 3,417,989 | A | 12/1968 | Haselow |
| 3,586,311 | A | 6/1971 | Schulze |
| 3,717,249 | A | 2/1973 | Faley |
| 3,994,221 | A | 11/1976 | Littleton |

(Continued)

FOREIGN PATENT DOCUMENTS

| | | |
|---|---|---|
| EP | 0054963 | 6/1982 |
| EP | 0244650 | 11/1987 |

(Continued)

OTHER PUBLICATIONS

PCT International Search Report dated Feb. 21, 2020, PCT Patent Application No. PCT/US2019/059105.

(Continued)

*Primary Examiner* — Patrick Cicchino
(74) *Attorney, Agent, or Firm* — Vierra Magen Marcus LLP

(57) ABSTRACT

A diverting system is proposed for diverting boxes from normal production flow. One embodiment comprises a diverter with a diverter surface, a diverter cam in contact with the diverter, a diverter cam shaft connected to the top diverter cam such that rotation of the diverter cam shaft causes rotation of the diverter cam, and an electric motor connected to the diverter cam shaft and configured to rotate the diverter cam shaft. The diverter cam is configured to control position of the diverter as the diverter cam rotates such that rotation of the diverter cam causes the diverter surface to move from a position above normal production flow to a diverting position within the normal production flow.

20 Claims, 58 Drawing Sheets

(56) References Cited

U.S. PATENT DOCUMENTS

| | | | | |
|---|---|---|---|---|
| 4,919,027 | A | 4/1990 | Ltittleton | |
| 5,293,797 | A | 3/1994 | Spalding | |
| 5,295,586 | A | 3/1994 | Chesnutt | |
| 5,366,217 | A | 11/1994 | Tokuno | |
| 5,472,185 | A | 12/1995 | Kollann | |
| 5,649,892 | A | 7/1997 | Auerbach | |
| 5,697,880 | A | 12/1997 | Auerbach | |
| 5,732,609 | A | 3/1998 | Marschke | |
| 6,176,485 | B1 | 1/2001 | Wingate | |
| 6,244,593 | B1 | 6/2001 | Schaefer | |
| 6,302,392 | B1 | 10/2001 | Schaefer | |
| 6,467,606 | B1 | 10/2002 | Elent | |
| 6,544,158 | B2 * | 4/2003 | Hill | B26D 7/32 493/123 |
| 7,216,865 | B2 * | 5/2007 | Tamura | B65H 29/58 271/207 |
| 8,056,899 | B2 * | 11/2011 | Byun | G03G 15/6573 271/303 |
| 9,580,266 | B1 * | 2/2017 | Bell'Albero | B65H 29/58 |
| 9,724,246 | B2 * | 8/2017 | Wada | B65H 29/12 |
| 10,604,370 | B2 * | 3/2020 | Yamamoto | B65H 29/58 |
| 10,882,710 | B2 * | 1/2021 | Taki | B65H 31/3018 |
| 2005/0082747 | A1 * | 4/2005 | Tamura | B65H 29/58 271/184 |
| 2005/0208885 | A1 * | 9/2005 | Huang | B65H 29/58 451/326 |
| 2017/0043971 | A1 | 2/2017 | Allen | |
| 2017/0279993 | A1 | 9/2017 | Kakuta | |
| 2018/0105383 | A1 | 4/2018 | Allen | |

FOREIGN PATENT DOCUMENTS

| | | |
|---|---|---|
| EP | 2055659 | 5/2009 |
| GB | 1208969 | 10/1970 |

OTHER PUBLICATIONS

PCT Written Opinion of the International Searching Authority dated Feb. 21, 2020, PCT Patent Application No. PCT/US2019/059105.
European Response to Office Action dated Dec. 15, 2021, European Patent Application No. 19809249.6.

* cited by examiner 156
176
156
45

58
59
150
104
45
182
162
180
160
178
158
176
156
174
154
172
152
T
67
158
154
156
176

ELECTRIC CAM DIVERTER

This application claims priority to U.S. Provisional Application 62/754,732, filed on Nov. 2, 2018, incorporated herein by reference in its entirety.

BACKGROUND

Manufacturers of corrugated paper products, known as Box Makers, produce both foldable boxes which have been folded and glued at the factory and die cut flat sheets which may be used either in their flat state or folded into desired shapes. These will be referred to as folded boxes and flat boxes respectively. The term "boxes" alone can refer to both folded and flat boxes. However, for the purposes of this document, boxes will refer to such before folding and gluing, that is, in the flat state. Any reference to box length is understood to mean a distance in the material flow direction and any reference to box width is understood to mean a distance in a direction substantially perpendicular to the material flow direction.

Both the folded boxes and the flat boxes are produced by Converting machinery which processes the Corrugated Sheet Stock produced by the machinery known as a Corrugator. The Corrugated Sheet Stock is corrugated material cut to a specific rectangular size. However, the Corrugated Sheet Stock has not been cut or notched to the detail typically required to produce the final foldable boxes or the flat boxes.

Often customized printing is required on boxes which may be done by 1) using a preprinted material integrated into the Corrugated Sheet Stock on the Corrugator, 2) using flexographic printing during the converting process or 3) applying ink or labels post converting through various techniques.

In the conversion of the Corrugated Sheet Stock into Boxes the material is fed through machinery. The Lead Edge for both Corrugated Sheet Stock and Boxes refers to the first edge encountered as the stock or box travels downstream through the machine whereas the Trailing Edge refers to the last edge encountered as the stock or box travels downstream through the machine. The Corrugated Sheet Stock may be cut completely through in the cross-machine direction in one or more locations to create two or more boxes as counted in the through-machine direction. These are referred to as Ups. The Corrugated Sheet Stock may alternatively or additionally be cut completely apart in the through-machine direction in one or more locations to create two or more boxes in the cross-machine direction. These are referred to as Outs.

There are multiple methods by which the cutting of the Corrugated Sheet Stock may be accomplished during the Converting process. One example method for cutting Corrugated Sheet Stock is known as Rotary Die Cutting. A typical configuration of a Rotary Die Cutter, known as Rule and Rubber, uses of a pair of cylinders where the lower cylinder, known as the Anvil, is covered in a firm rubber material and the top cylinder, known as the Die Crum, is mounted with a Die Board. The Die Board is normally a curved plywood base in which are embedded a customized set of steel Rules, which protrude from the plywood base and when rotated with the Anvil will cut and score the Corrugated Sheet Stock into the desired cut/scored box. An alternate configuration of the Rotary Die Cutter swaps the locations such that the Anvil is the top cylinder and the Die Board is mounted to the lower cylinder. The transportation speed of the box, as determined by the effective linear speed at the nip of the Die Board and Anvil, is known as the Die Cutter Line Speed.

A Stacking Apparatus is positioned downstream of the Rotary Die Cutter to accept the cut/scored boxes and to ultimately form neat stacks of the cut/scored (and optionally printed on) boxes. If short stacks of individual Outs are produced, they are known as Bundles. If short stacks are output and the Outs are still connected with perforated cuts they are known as Logs. If taller stacks are output they are known as Full Stacks. These stacks, regardless of type, are referred to herein as Loads.

The Box Makers has both fixed and variable costs associated with running of their business. The number of boxes produced in a given time period determines the Average Production Rate. A higher Average Production Rate is desirable. There are multiple factors that can affect the Average Production Rate. The integral of the rotational speed of the Rotary Die Cutter and the amount of time Corrugated Sheet Stock is actually being fed through the machine, Feed Time, determines the Average Production Rate.

The quality of the box is important to the Box Maker. There are multiple types of quality to be maintained. The first quality control issue is the geometry of the box. This is determined by multiple factors, including the die board which is cutting the box. Another significant factor is the upstream feeding system which cannot allow the Corrugated Sheet Stock to slip too far out of registration to the die boards. The second quality control issue is the printing onto the box which happens upstream of the Die Cutter process. The third quality control issue is assuring that no metal from the Rotary Die Cutter system nor from inclusion in the raw stock of the box is allowed to get into the final Loads. The forth quality control issue is the limiting and ideally elimination of the scrap produced during die cutting from the getting into the final Loads.

While it is ideal for the Rotary Die Cutter and the Stacking Apparatus to continuously run, it is also ideal to be able to allow efficient quality control procedures either by the operator or by automatic processes designed into the system.

The Rotary Die Cutter has a Die Drum cylinder to which the Die Board is attached. It also has an opposing Anvil which is typically a rubber surface to allow for the cutting action of the Die Board as the Corrugated Sheet Stock passes between the Die Board and the Anvil. The Rotary Die Cutter has a parameter known as the Rotary Die Cutter Circumference, which is the theoretical maximum length of the box that could be produced in a single revolution of the Rotary Die Cutter which is determined by the size of the Die Drum and the Die Board. A very common value for the Rotary Die Cutter Circumference is 66 inches.

Being able to divert boxes from the normal flow and ejecting for either inspection or automatic rejection from a continuously running operation is more desirable than the stopping of production. The diverting process requires, reliability, the ability to accommodate a full range of box sizes and capable to operate at modern day production rates. State of the art Rotary Die Cutters with a Rotary Die Cutter Circumference of 66 inches are able to run up to 250 revolutions per minute. This translates into a Die Cutting Line Speed of 1,475 feet per minute.

The Rotary Die Cutting process has a synchronous nature. That is, the Die Drum cylinder to which the Die Board is attached rotates at a given variable speed but the Box Lead Edge of the Corrugated Sheet Stock is cut every time the Die Drum makes a revolution. In practice, the largest Box that can be created from the Corrugated Sheet Stock is about 1 inch to 4 inches less than the Rotary Die Cutter Circumference. For example, a typical Rotary Die Cutter Circumference of 66 inches can process Corrugated Sheet Stock with a maximum length of approximately 62 inches. Often the combination of Boxes in Ups direction are even shorter and thus a Die Cutting Sheet Gap between the trail edges of the last Boxes from a previous Corrugated Sheet Stock and the lead edges of the Boxes from the current Corrugated Sheet Stock will be even greater than the minimum 1 inches to 4 inches. This gap is normally where the diverting action takes place. The Rotary Die Cutter is a large, massive machine and the ability to track or predict the location of the gap in the flow directions is quite reliable when properly coupled with modern day stacking machinery with high quality sheet control.

The Sheet Gap Time is the time from the previous last Box Trail Edge to the first Box Lead Edge. For a Rotary Die Cutter Circumference of 66 inches running at 250 revolutions per minute and with a 4 inch Die Cutting Sheet Gap the Sheet Gap Time is 14.5 milliseconds. As the combination of Box Length and Ups gets shorter the Die Cutting Sheet Gap gets larger and thus the Sheet Gap Time for a given Die Cutting Box Linear Speed increases. For example, a 2 Up Box at 24 inches long would have a Die Cutting Sheet Gap of 18 inches and thus an increased Sheet Gap Time of 65.5 milliseconds at 250 revolutions per minute.

There are two special modes of feeding the Corrugated Sheet Stock into the Rotary Die Cutter. The first is known as Skip Feed, which feeds one Corrugated Sheet Stock for every two revolutions of the Die Drum. The second is known as Double Kick which feeds two Corrugated Sheet Stock for every single revolutions of the Die Drum. They both still have the synchronous nature of creating a Sheet Gap.

The Stacking Apparatus will often accelerate the Boxes as they exit the Rotary Die Cutter thus increasing the Die Cutting Sheet Gap to the Diverting Sheet Gap. However, both increase proportionally, thus the Sheet Gap Time is the same regardless of the increase in speed within the Layboy.

The Diverting Performance has two components, time and repeatability, which both have time for their units. The Diverting Time, engage and retract, is defined as the time to move the Diverting Surface from its Retracted Position to its Engaged Position and from its Engaged Position to its Retracted Position respectively. The movement of the Diverting Surface is known as the Diverting Action. The Diverting Repeatability, engage and retract, is defined as the repeatability of the latency between when the Control System sends the command to the actuator power source and amplifiers and the time it takes for the actuator and the mechanism connecting the actuator to move the Diverting Surface from its Retracted Position to its Engaged Position and from its Engaged Position to its Retracted Position respectively.

If a system has a Divert Time larger than Sheet Gap Time, successful diverting is not possible. The Diverting Repeatability adds to the Divert Time as this is the variations that would shift the Diverting Action relative to the Diverting Sheet Gap during diverting. For example, if the Sheet Gap Time is 14.5 milliseconds and the Divert Engage Time is 10.5 milliseconds, the system cannot reliably divert if the Diverting Repeatability is 30 milliseconds since there is only a 2 millisecond margin for error on each side of the Diverting Action.

There are two categories of diverting system in the prior art, dynamic and static.

A Dynamic Diverter system has Diverting Surfaces which are in some sort of continuous motion and either continuously or selectively will engage these surfaces in the diverting action by allow the Diverting Surfaces to enter the Normal Production Flow. This category has the advantage of continuous motion which eliminates the challenges of needing to accelerate and decelerate substantial mass and can be relatively easily synchronized for good Diverting Repeatability. This category has the downside of typically being mechanically large and hard to fit in certain designs plus downside of the Diverting Surfaces not easily available for support during non-diverting operations. Examples of this category of diverting system can be observed in U.S. Pat. No. 4,919,027.

A Static Diverter system has Diverting Surfaces which are in a static state and then selectively actuated to engage these surfaces in the diverting action by allow the Diverting Surfaces to enter the Normal Production Flow. This category has the advantage of being able to engage at any frequency and the Diverting Surfaces can optionally be useful during non-diverting operations. This category has the downside of needing to accelerate and decelerate substantially static mass. This category also relies on the repeatability of the Control System, actuator power source and amplifiers, actuator and the mechanism connecting the actuator to the Diverting Surface. Examples of this category of diverting system can be observed in U.S. Pat. No. 3,717,249 and US 2018/015383.

DETAILED DESCRIPTION

The proposed technology applies to the category of Static Diverting system for the requirements of diverting Boxes.

Static Diverting systems for diverting product from a production line often involves actuators, a variety of mechanisms and a diverting surface which actually causes the diverting. These actuators typically have a direct connection between the actuator and the mechanisms or some sort of linkage system. Divert Time requirements for Rotary Die Cutter Sheet Gap Time is limited either by not being able to achieve the performance or by high cost of the actuator power source and amplifiers, actuator and the mechanism connecting the actuator to the Diverting Surface. Divert Repeatability requirements for Rotary Die Cutter Sheet Gap Time is limited by the physics of the technology and methods that are inherently not repeatable.

An Electric Cam Diverter Apparatus is disclosed that can divert of set of Boxes from a Corrugated Sheet Stack with the Rotary Die Cutter operating at the maximum speed. This is accomplished by being able to achieve adequately fast Divert Time using an electric power source, amplifiers and actuators along with a Cam mechanism operatively controlling a diverting surface for diverting the Boxes from the normal production line. The Electric Cam Diverter Apparatus has the ability, using the disclosed control methodology, to also achieve adequately fast Divert Repeatability such that in addition to the Divert Time is still able to divert within the Sheet Gap Time of modern Rotary Die Cutters at a reasonable cost.

Thus, a diverting system is proposed for diverting boxes from normal production flow. One embodiment comprises a diverter with a diverter surface, a diverter cam in contact with the diverter, a diverter cam shaft connected to the top diverter cam such that rotation of the diverter cam shaft causes rotation of the diverter cam, and an electric motor connected to the diverter cam shaft and configured to rotate the diverter cam shaft. The diverter cam is configured to control position of the diverter as the diverter cam rotates such that rotation of the diverter cam causes the diverter surface to move from a position above normal production flow to a diverting position within the normal production flow.

Figure 1:
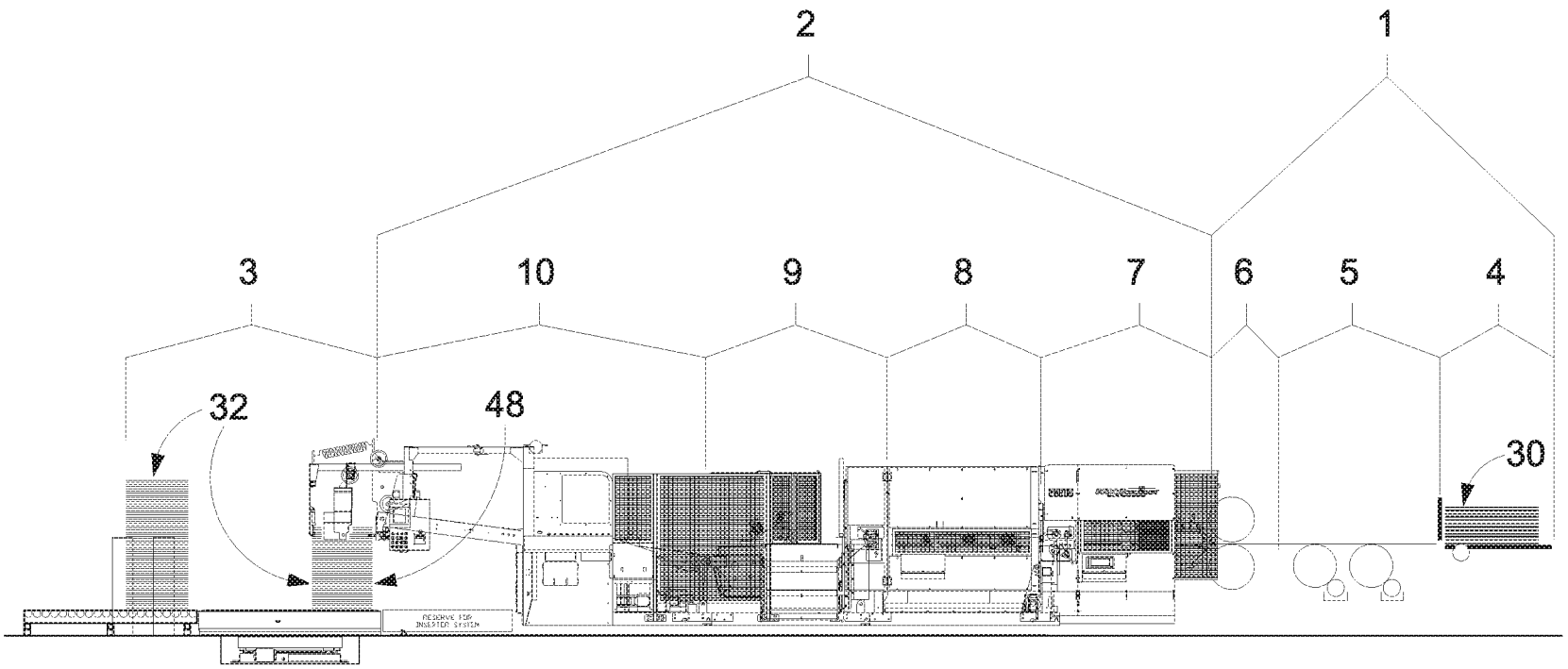
FIG. 1 depicts a side view of a Rotary Die Cutter 1, Stacking Apparatus 2 and Load Takeaway System 3 including an embodiment of a Sheet Quality Control Diverting Section 8.

FIG. 1 depicts a side view of a Rotary Die Cutter 1, Stacking Apparatus 2 and Load Takeaway System 3. The Rotary Die Cutter 1 has three primary sections, the Feed Table Section 4, the Printing Section 5 and the Die Cutting Section 6. The Stacking Apparatus 2 has four primary sections, the Layboy Section 7, the Sheet Quality Control Diverter Section 8, the Shingling Section 9 and the Stacking Section 10.

Figure 2A:
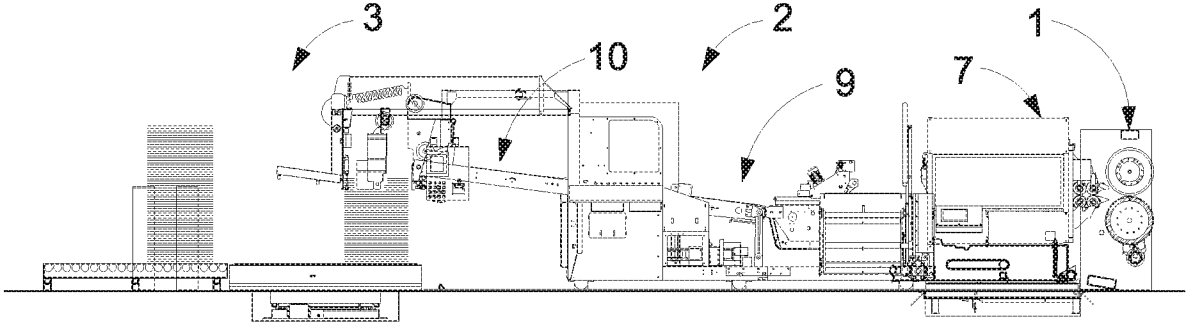
FIG. 2A depicts the side view of prior state of the art system without a diverting system.
Figure 2B:
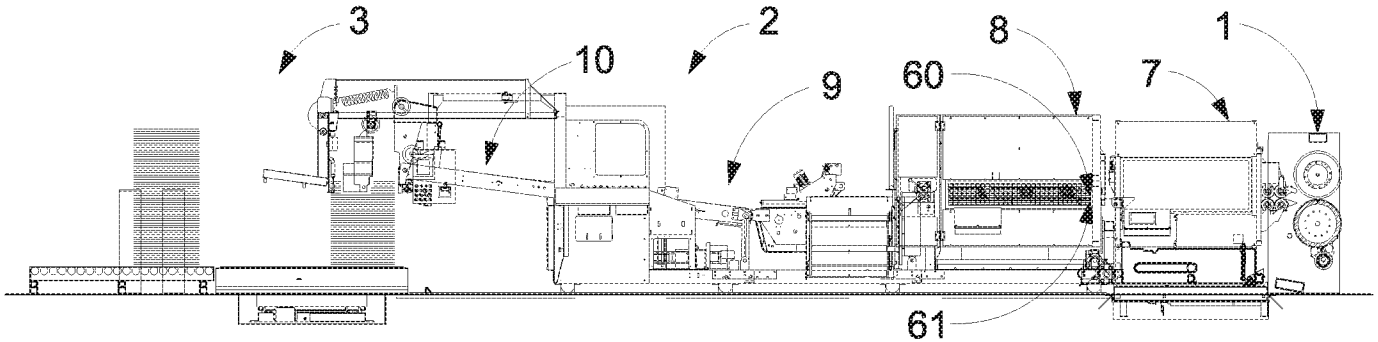
FIG. 2B is a side view of one alternative of a Sheet Quality Control Diverting Section 8 immediately after a Layboy Section 7.

FIG. 2A depicts the side view of prior state of the art system without a diverting system. FIG. 2B is a side view of one alternative of a Sheet Quality Control Diverting Section 8 immediately after a Layboy Section 7. The Top and Bottom Cam Diverters 60/61 are located at the entrance end of the Sheet Quality Control Diverting Section 8.

Figure 3:
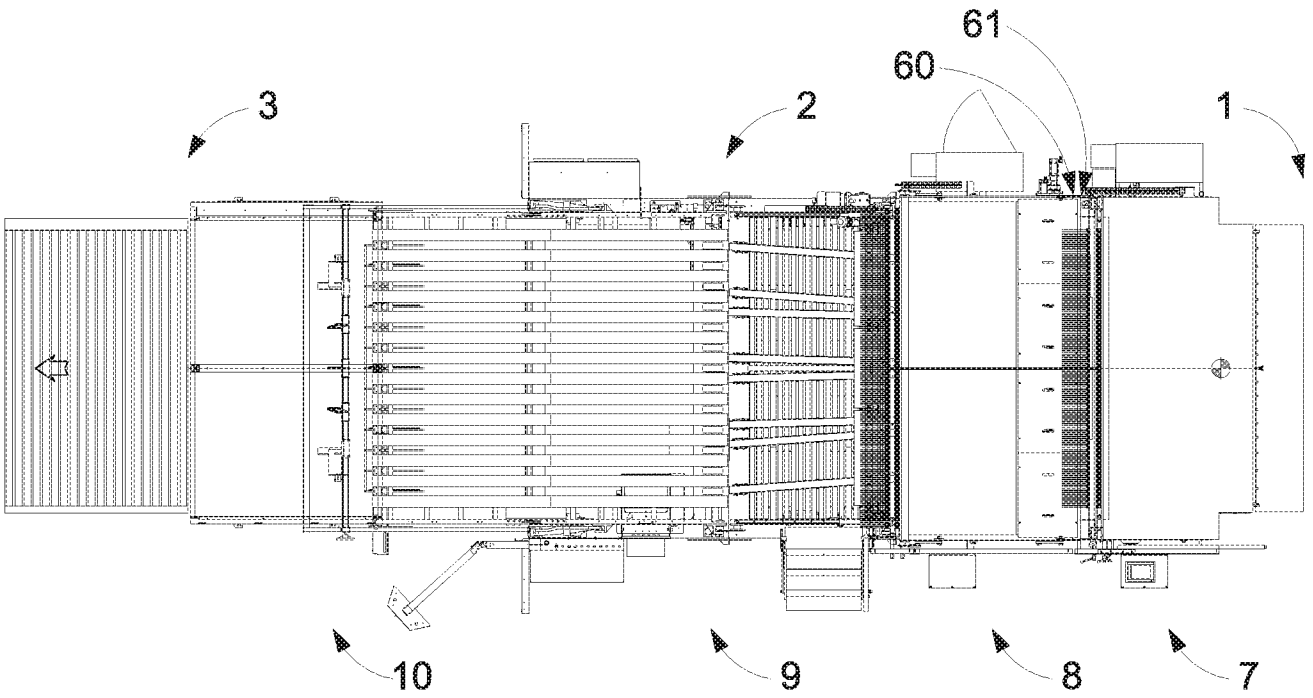
FIG. 3 depicts a top view of the system shown in FIG. 2B.

FIG. 3 depicts a top view of the system shown in FIG. 2B.

Figure 4:
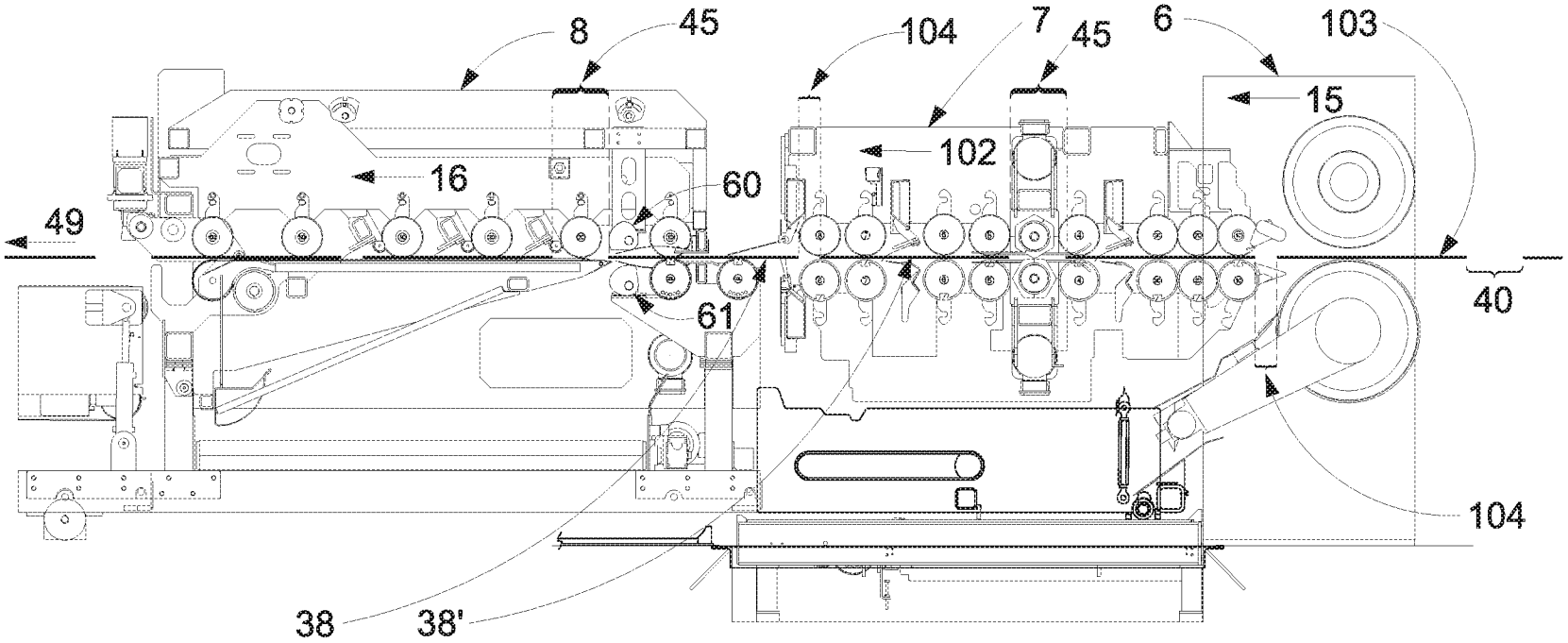
FIG. 4 depicts a zoomed side view of the middle system shown in FIG. 2B.

FIG. 4 depicts a zoomed side view of the middle system shown in FIG. 2B showing the internal transition from a Layboy Section 7 to the Sheet Quality Control Diverting Section 8.

Figure 5:
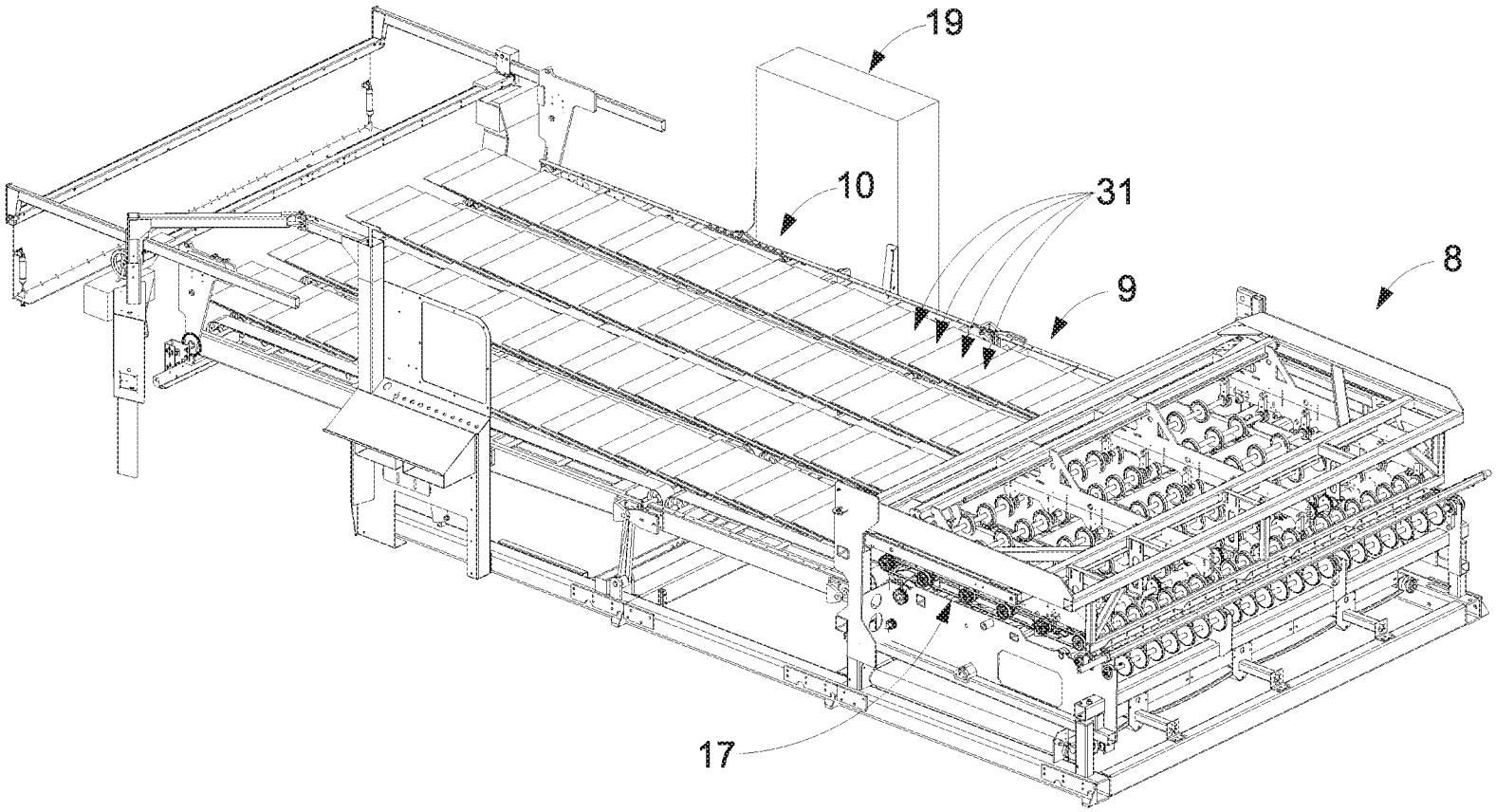
FIGS. 5 and 6 depicts perspective view of the just the Sheet Quality Control Diverter Section 8 with the Upper Board Conveyor Section 92 and Upper Diverter Section 93 included.
Figure 6:
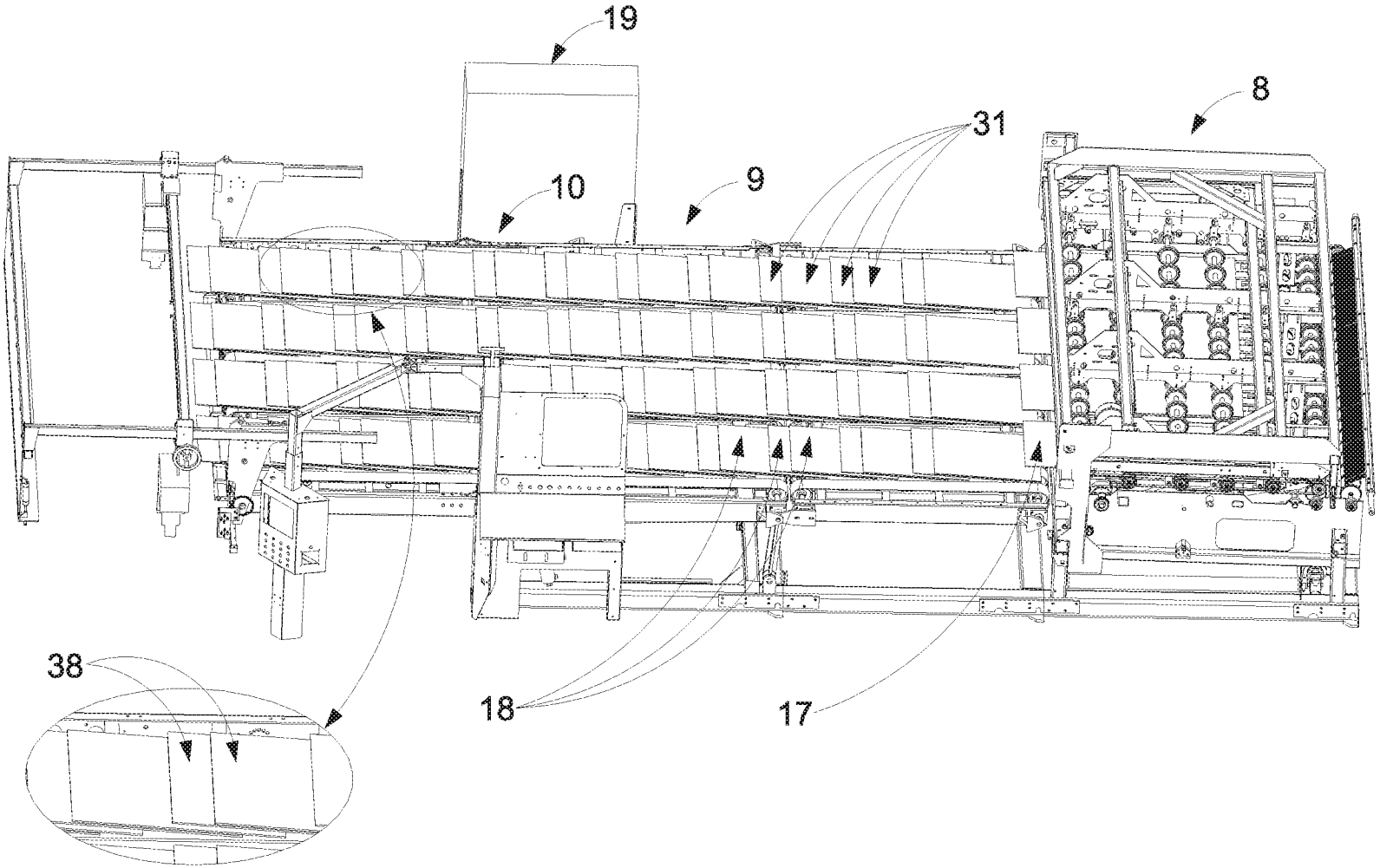
Figure 7:
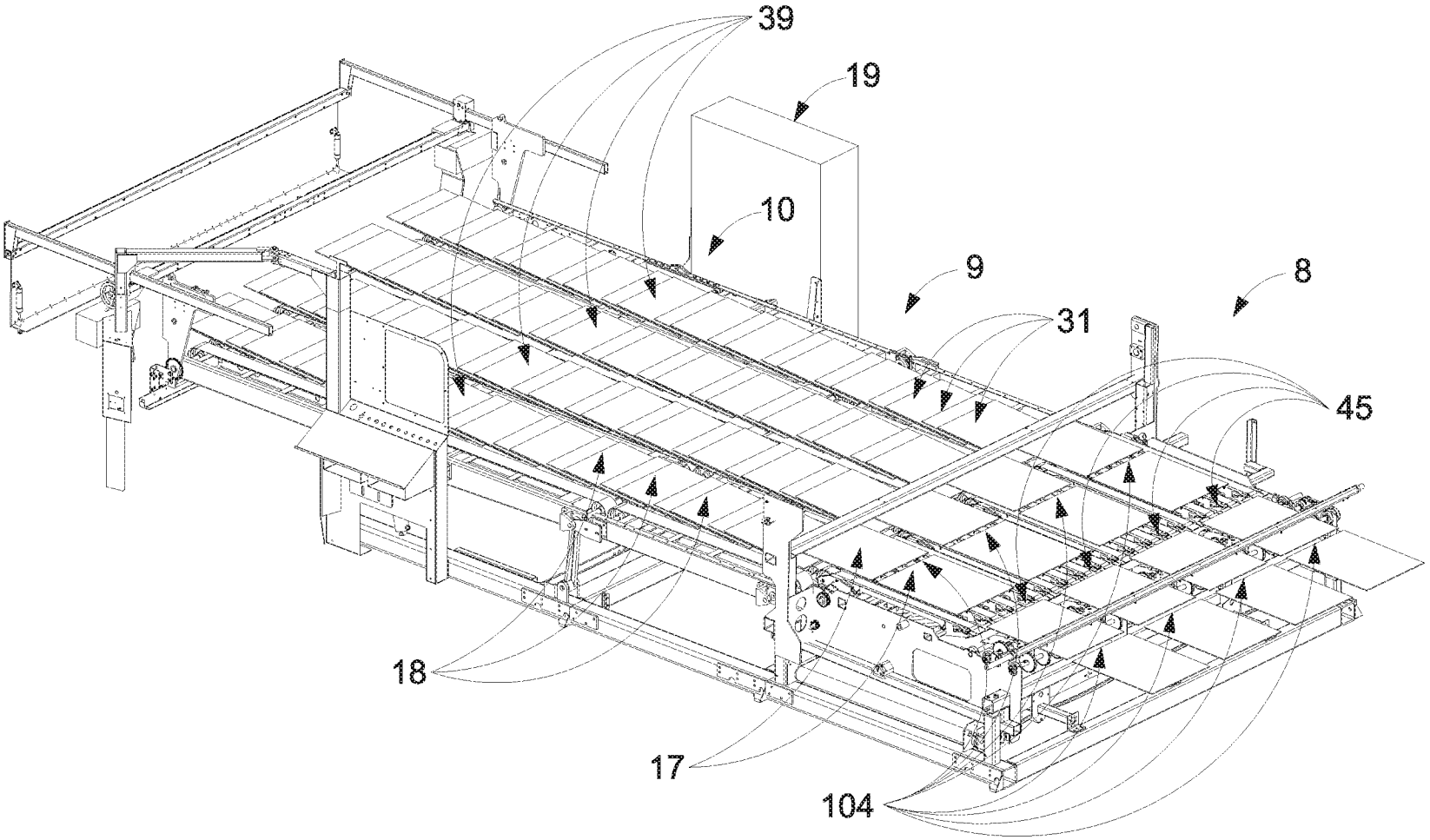
FIGS. 7 and 8 depicts similar view but with the Upper Board Conveyor Section 92 and Upper Diverter Section 93 removed.
Figure 8:
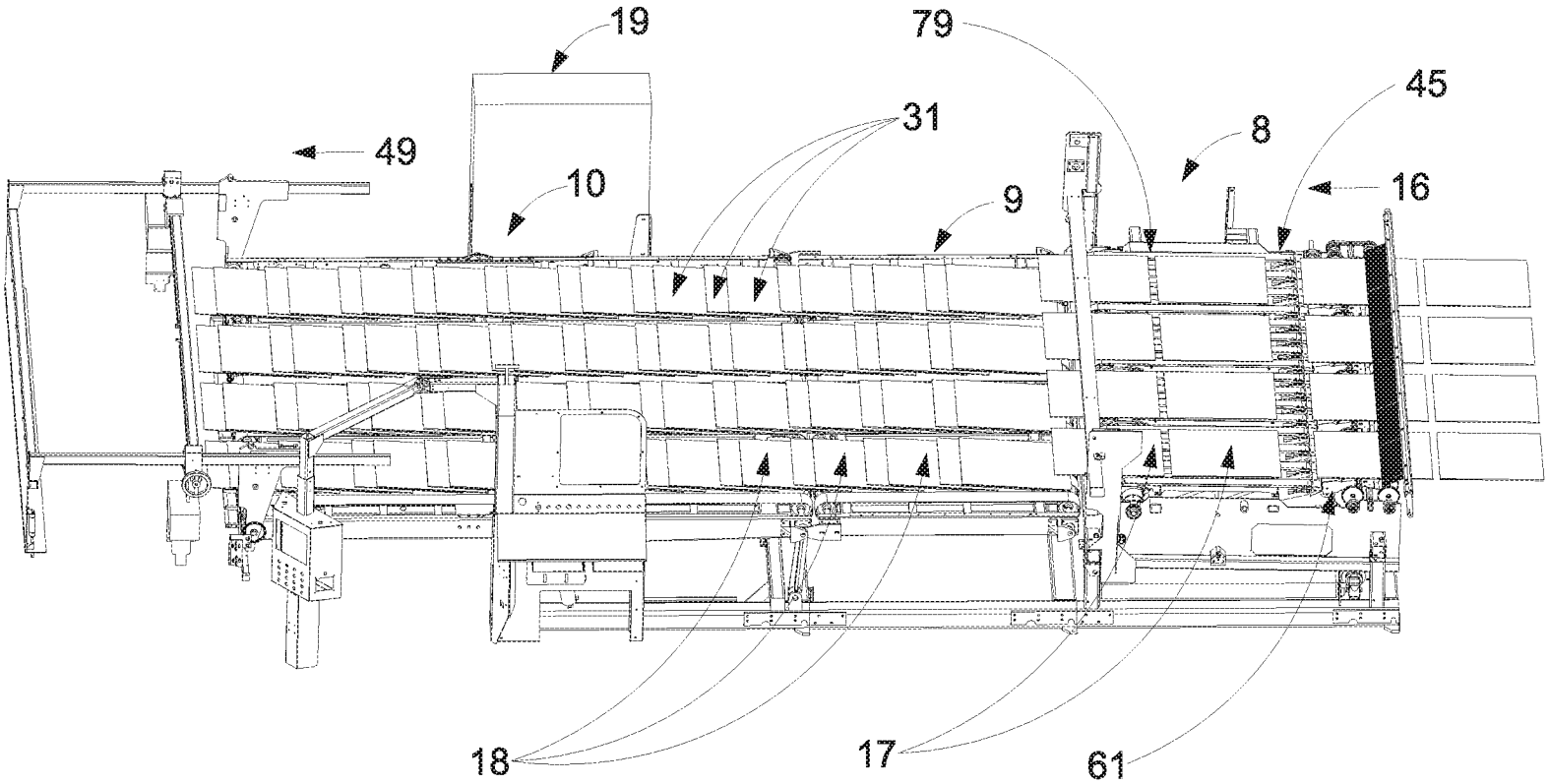
Figure 9:
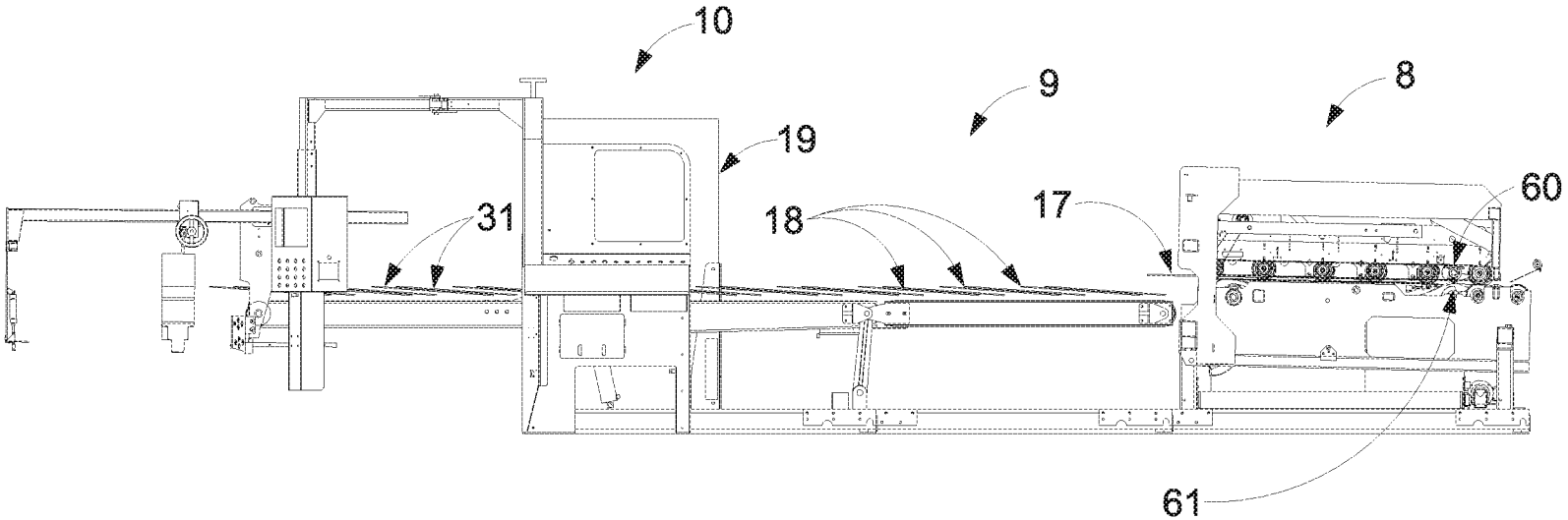
FIGS. 9 and 10 are side and top view of FIGS. 5 and 6.
Figure 10:
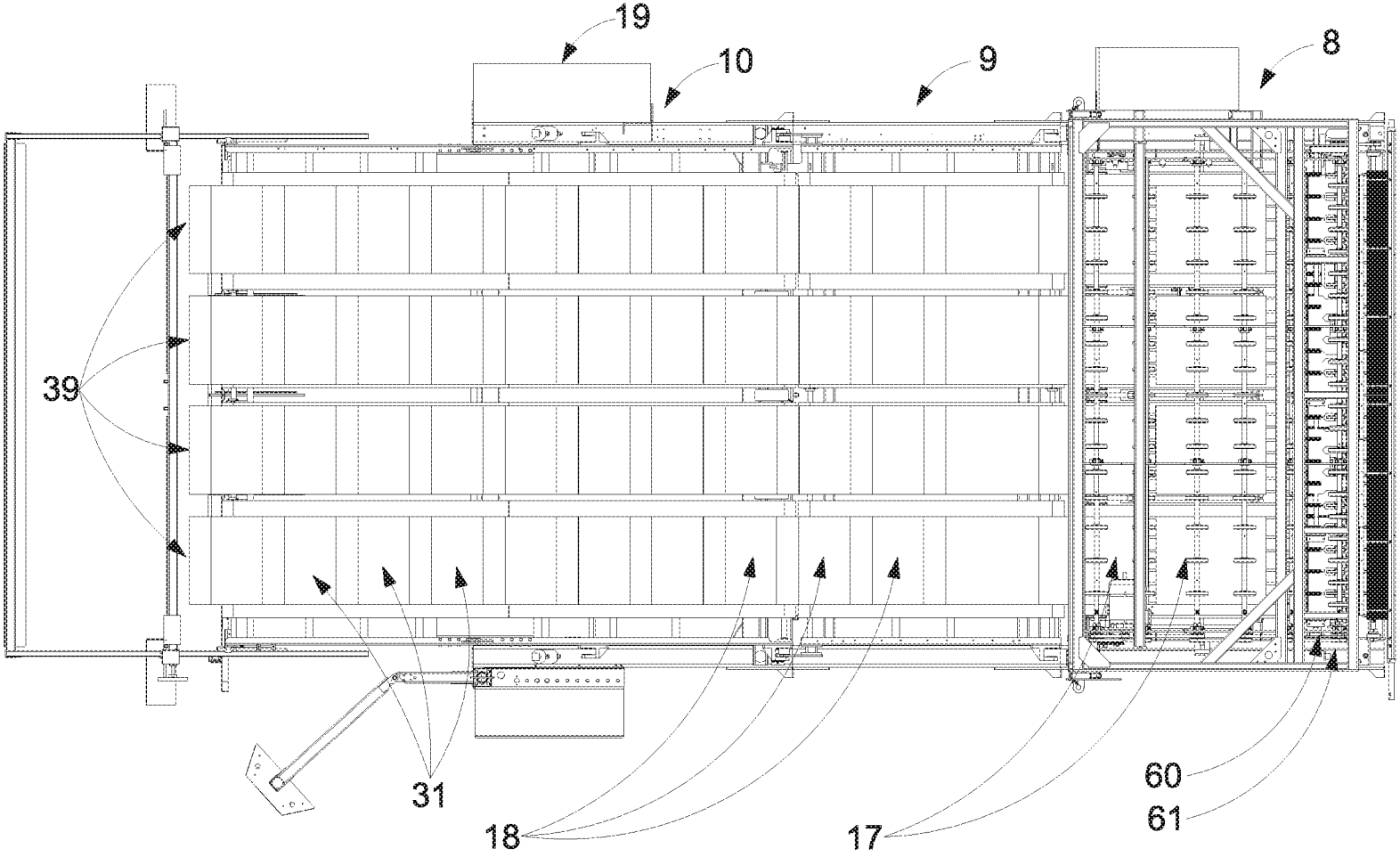

FIGS. 5 and 6 depict perspective views of the Sheet Quality Control Diverter Section 8 with the Upper Board Conveyor Section 92 and Upper Diverter Section 93 included. These figures also include the Shingling Section 9 and the Stacking Section 10. FIGS. 7 and 8 depicts similar view but with the Upper Board Conveyor Section 92 and Upper Diverter Section 93 removed. FIGS. 9 and 10 are side and top view of FIGS. 5 and 6. The Boxes are represented in Stream Mode 17 through the Sheet Quality Control Diverter Section 8. The Boxes are in Shingle Mode 18 through Shingling Section 9 and Stacking Section 10. The Stream Mode 17 to Shingle Mode 18 transformation is achieve by running the Shingling Section 9 conveying surfaces slower than the incoming Diverter Line Speed 16.

This has the advantage of partially slowing down the speed to the boxes which ultimately have to get to zero velocity in the final Loads 32.

The Corrugated Sheet Stock 30 is typically fed one sheet synchronized with each revolution of the Die Drum in the Die Cutting Section 6. The sheets are conveyed through the Rotary Die Cutter in Stream Mode 17. Stream Mode 17 is where the Corrugated Sheet Stock 30 or boxes are going the same speed or faster than they are being fed at the Feed Table 4 and thus there is no overlap of the Corrugated Sheet Stock 30 or boxes. In Stream Mode 17 both sides of the corrugated material are unobstructed for full inspection and there is a Sheet Gap 45 which is a good opportunity to divert the corrugated material from the Normal Production Flow 49.

The Stacking Apparatus 2 will often accelerate the boxes as they exit the Rotary Die Cutter 1 in a machine section commonly referred to as the Layboy Section 7 as shown in FIG. 4. This is done by running the conveying surfaces of the Layboy Section 7 at Layboy Line Speed 102 which is speed greater than the Die Cutter Line Speed 15. This aids when ultimately converting the stream flow of boxes created by the Rotary Die Cutter into an over lapping flow of boxes, known as a Shingle, within the Shingle Section of the Stacking Apparatus. This increase in speed from Die Cutter Line Speed 15 to the Layboy Line Speed 102 and Diverter Line Speed 16 has the effect of also increasing the Die Cutter Sheet Gap 40 to the Diverter Sheet Gap 45. For orders that have more than one Up 38, this will also increase the Die Cutter Up Gap 103 from zero to the Layboy Up Gap 104 by an amount related to the speed differential between the Die Cutter Line Speed 15 and the Layboy Line Speed 102 and the length of the box.

It should be noted that when referencing sheet gaps and up gaps the units can be distance or time depending on the context where the time units is the associated distance divided by the average velocity that applies.

With the increase speed within the Layboy Section 7, there is an increase in the kinetic energy and momentum of the boxes that are to be diverted when diverting is done after a Layboy Section 7.

Following the Layboy Section 7 is the Sheet Quality Control Diverter Section 8 includes Static Diverter System which includes a Top Electric Cam Diverter 60 and a Bottom Electric Cam Diverter 61. As the boxes are still in Stream Mode 17 upon exiting the Layboy Section 7, there is a Layboy Sheet Gap 45 and possibly a Layboy Up Gap 104 available to allow the Diverting Action to occur. The Layboy Sheet Gap 45 is always larger than the Layboy Up Gap 104. It is possible and applicable to use the Electric Cam Diverter for the diverting of a single set of boxes from a selected set of Ups of the Corrugated Sheet Stock 30 in the Layboy Up Gap 104. However, the Layboy Up Gap 104 can be a very small relative to the Layboy Sheet Gap 45 and typically the users of the machinery wants to inspect all the boxes being produced from the Corrugated Sheet Stock 30.

Figure 11:
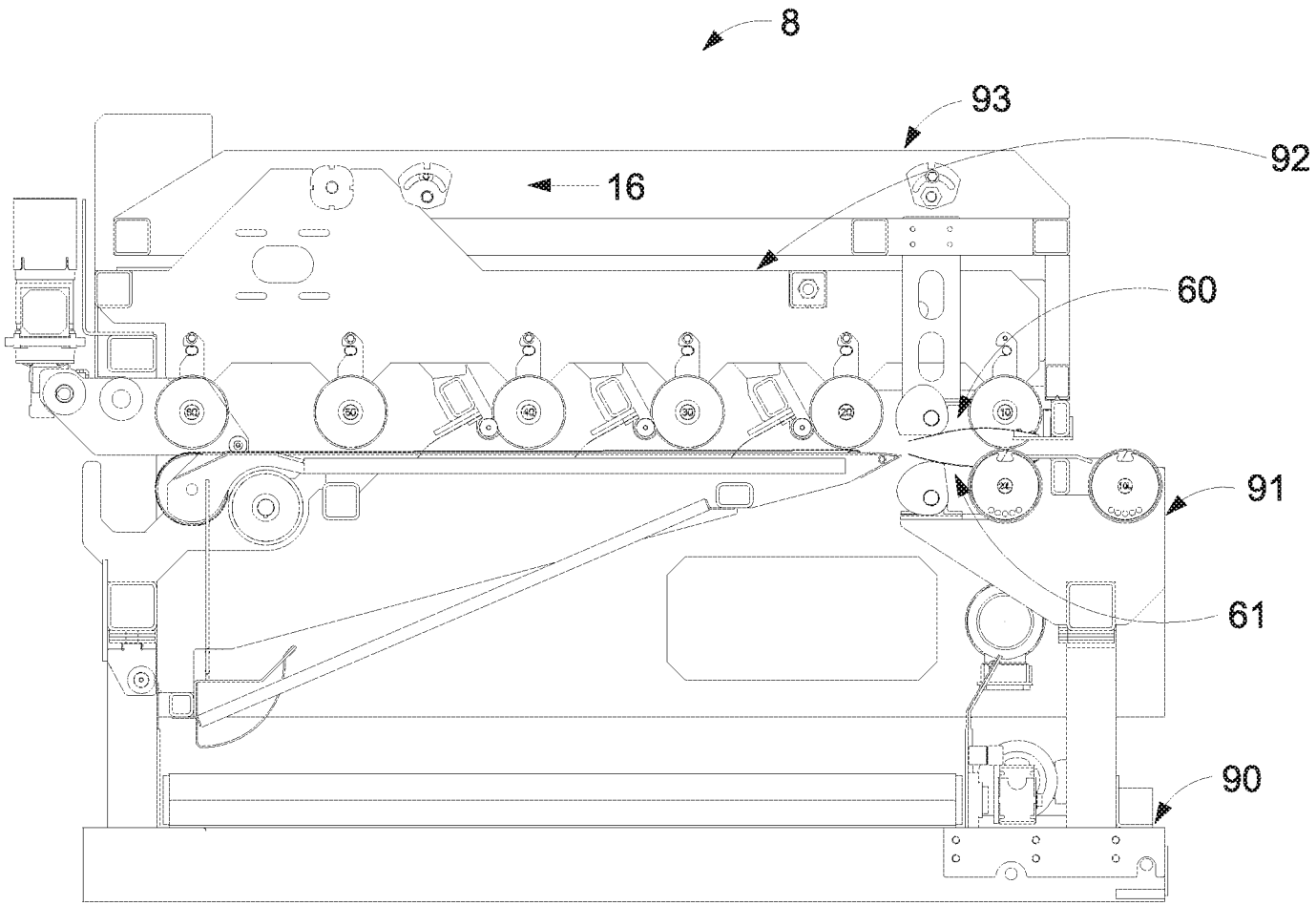
FIG. 11 depicts a zoomed side view of the system shown in FIG. 4 of only the Sheet Quality Control Diverting Section 8 with the guarding removed for clarity.

The Sheet Quality Control Diverter Section 8, shown in FIG. 11, includes a Base Cross Conveyor Section 90 for bringing the diverted sheet to the operator side of the machine for inspection. The conveyor within Base Cross Conveyor Section 90 can also be reversed and take any scrap to the drive side of the machine during normal operations.

While it would be possible to run the conveying surfaces within the Sheet Quality Control Diverter Section 8 at a different speed than the Layboy Section 7, typically speed changes are avoided unless required for a specific advantage and thus the Diverter Line Speed 16 would be similar to the Layboy Line Speed 102.

The final section of the Stacking Apparatus 7 is the Stacking Section 10, which can create completed Loads 32. These Loads 32 are then transported away from the system by the Load Takeaway System 3.

It should be noted that there are alternate configuration and combinations of the Stacking Apparatus 7 in which one or more Electric Cam Diverters can be embedded. One alternative would be, combining the Shingling Section 9 and the Stacking Section 10 into a single conveying system to accomplish both tasks. A second alternative would be, changing Stacking Section 10 have a fixed discharge elevation and the Load 32 down stacked at the discharge end of the machine with a separate elevating means. A third alternative would be, to include the Electric Cam Diverter in the discharge end of the Layboy Section 7. A fourth alternative would be, to compress both functions of the Layboy Section 7 and the Sheet Quality Control Diverter Section 8 into a single section in which one or more Electric Cam Diverters can be embedded. The valid combinations are not limited to those listed.

The Electric Cam Diverter is applicable to any location within the Stream Mode 17 which has a gap of sufficient size to allow the Diverting Action 67 to take place with the proper infeed and outfeed elements.

FIGS. 7 and 8 depicts two perspective views of a Sheet Quality Control Diverter Section 8, Shingling Section 9 and Stacking Section 10. The Boxes are in Shingle Mode 18 through Shingling Section 9 and Stacking Section 10. In this view both the Layboy Up Gap 104 and the Layboy Sheet Gap 45 can be observed. The Bottom Electric Cam Diverter 61 can be seen towards the entry end of the Sheet Quality Control Diverter Section 8. In this view the boxes are shown in a multiple Out configuration. A Nicked order is where the Boxes can remain attached to each other can also be diverted. This includes orders where the nicks connect the Outs 39, where the nicks connect the Ups 38 or both. Essentially, when nicked in both directions, the group of boxes are slightly smaller than the Corrugated Sheet Stock 30, but there still is a Layboy Sheet Gap 45 available for diverting.

FIG. 11 depicts a zoomed side view of the system shown in FIG. 4 of only the Sheet Quality Control Diverting Section 8 with the guarding removed for clarity.

Figure 12:
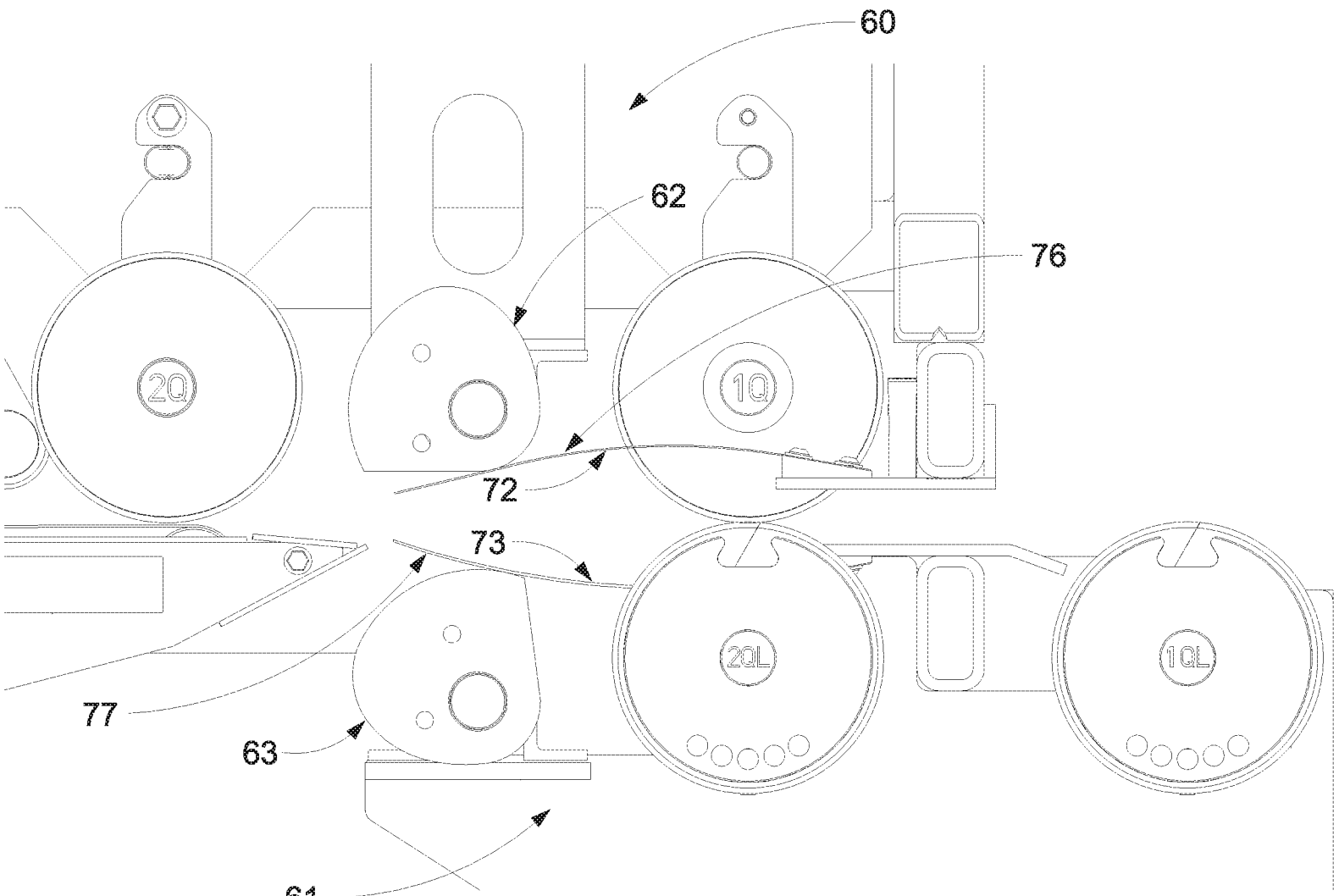
FIG. 12 depicts a further zoomed side view of the middle system shown in FIG. 11.

FIG. 12 depicts a further zoomed side view of the middle system shown in FIG. 11 of only the Sheet Quality Control Diverting Section 8 with the guarding removed for clarity showing a multiple diverting system with both a Top Electric Cam Diverter 60 and a Bottom Electric Cam Diverter 61.

The Electric Cam Diverter achieves it superior performance in the class of Static Diverter Systems by allowing an Electric Motor 106/107 operatively connected to a Diverter Cam 62/63 to be accelerated and decelerated at its peak torque over a period longer than the Diverting Action 67 time. By creating this relationship, energy is being built up and removed from the system while the Diverter Surface 72/73 remains relatively stationary. The Diverting Action 67 is created using only a portion of the rotation of the Cam which has already achieved a relatively high speed and momentum.

The term Servo Control is defined to be any control system using one or more feedback loops and is more sophisticated than a simple on/off basic starter system, which is often referred to as bang-bang controls. The use of a Servo Control Electric Motor 106/107 can be electronically synchronized by the Control System 19 which tracks both the boxes and its own Diverter Cam motion using modern day feedback controls such that any latency in the systems are in the 10 millisecond range or below. Just as important, these latencies tend to be consistent and can be measured and accounted for with offsets in the Control System 19. This allows the Electric Diverting system 60/61 to have a diverting repeatability able to position the Diverting Action 67 within the Layboy Sheet Gap 45 or Layboy Up Gap 104.

To make a system as cost effective and efficient as possible the relationship between the angle of the Diverter Cam 62/63 and the Diverting Surface 72/73 needs to be determined. The algorithm used to determine this relationship has the three key fundamentals. For purposes of this document, the term algorithm is expanded to include any iterative process to achieve the fundamental required relationship between angle of the Diverter Cam 62/63 and the Diverting Surface 72/73. This can include, but is not limited to, graphical modelling with CAD and empirical modelling and testing.

Figures 14A, 14B:
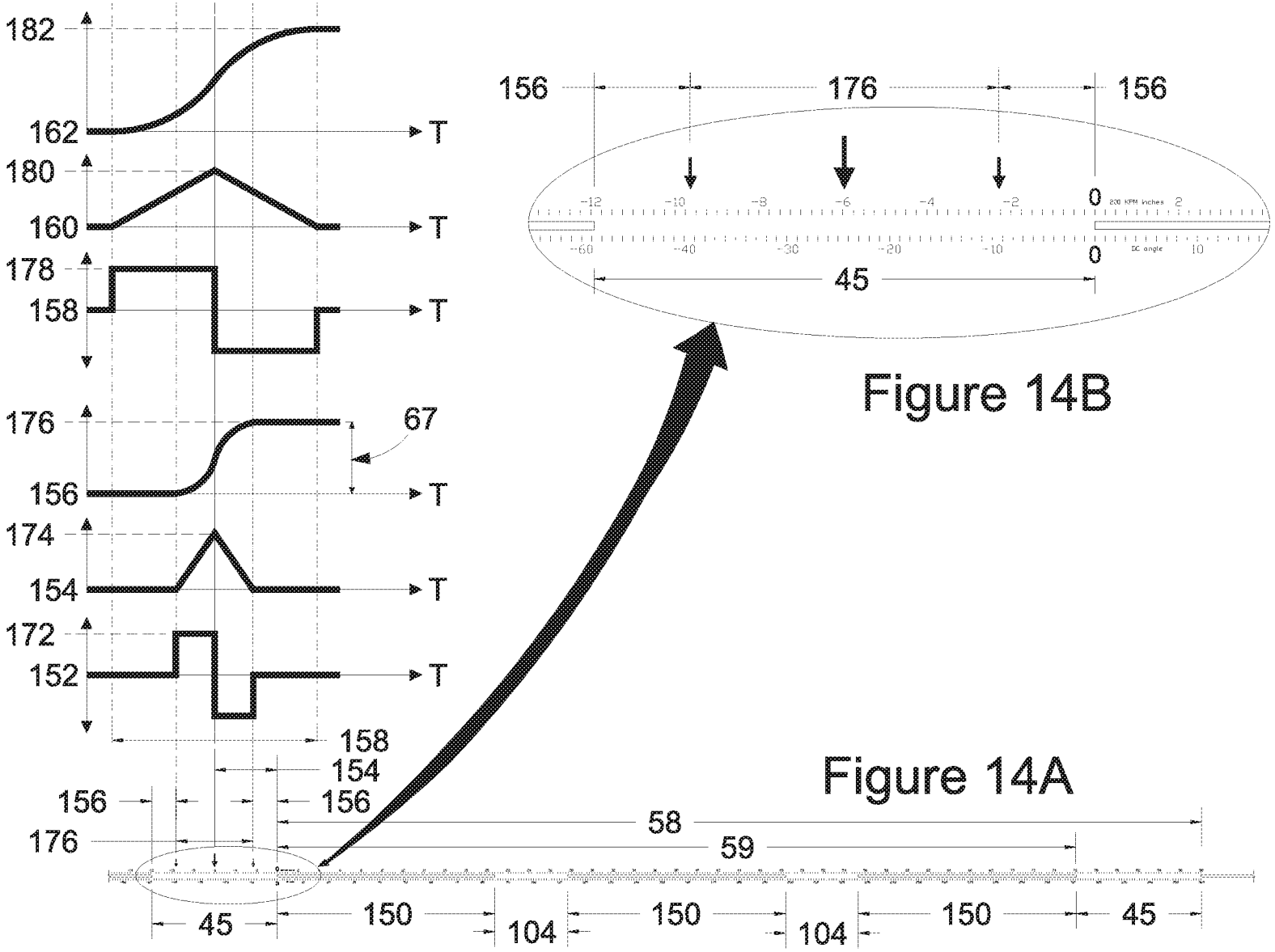
FIGS. 14A and 14B represents the general relationships between the board flow geometry and the dynamics of the Top Diverter Cam 62 and the Top Diverter 76.

FIG. 14A represents the general relationships between the board flow geometry and the dynamics of both the Top Diverter Cam 62 and the Top Diverter 76. The dynamics are shown as time graphs of acceleration, velocity and position. FIG. 14B is a zoomed in view of the Layboy Sheet Gap 45.

When describing the dynamics of the various elements, the general terms position or angle, velocity, acceleration and jerk are understood to be linear or angular based on the element being discussed. The boxes move linearly and thus have a position and linear velocity. The Diverter Cams 62/63 rotates and thus have an angle and angular velocity. Velocity is the rate of change of position or angle. Acceleration is the rate of change of velocity. Jerk is the rate of change of acceleration.

The first fundamental is that the Control System 19 will optimize the motion profile of the Electric Motor 106/107. For most common Servo Control Electric Motor, this would mean full acceleration torque for the first half of Diverter Cam 62/63 rotation and full deceleration torque for the second half of the Diverter Cam 62/63 rotation, if the profile is symmetrical. If the system has constant full torque, this would yield a linear increase and decrease in velocity with the peak velocity at the half rotation point of the Diverter Cam 62/63. The angular position of the rotation would follow a second order curve based on the torques and the Cam Maximum Rotation. The jerk would be zero.

The second fundamental is that the Diverter 76/77 and its Diverting Surface 72/73 should have limited movement for both the initial portion of the Diverter Cam 62/63's acceleration and the final portion of the Diverter Cam 62/63's deceleration. This fundamental can be ignored and still yield an Electric Cam Diverter 60/61 with the required Diverting Repeatability but will not achieve the same level Diverting Action 67 performance. It is also possible to vary the relationship such that modest movement of the Diverter 76/77 and its Diverting Surface 72/73 occur during the initial portion of the Diverter Cam 62/63's acceleration and the final portion of the Diverter Cam 62/63 deceleration with greater movement of the Diverter 76/77 and its Diverting Surface 72/73 occurring in between.

The third fundamental is that the Diverter 76/77 and its Diverting Surface 72/73 should experience a reasonable Diverting Profile 156 during the Diverting Action 67. Excessive forces from the Diverter Cam 62/63 can cause damage to the Diverter 76/77. An unreasonable profile could also cause position overshoot of the Diverting Surface 72/73.

Graphical modelling with CAD or empirical modelling with physical testing can be done iteratively to achieve the fundamentals described and the relationship between angle of the Diverter Cam 62/63 and the Diverting Surface 72/73. An effective method is to structure a computer algorithm to determine the relationship. This is referred to as the Cam Generation Simulator 105. This has the advantage of being able to quickly evaluate many combinations of parameters as well as defining the two constraints of the Cam Profile 162/111 and the Diverter Profile 156 and generate a cam profile that will the solution to these two profiles.

One method of constructing a Cam Generation Simulator 105 is to use iteration and a concept referred to as Cam Diverter Tangential Contact Lines 78. The concept is to define the dynamic profile of the Cam Angle 74/75 (e.g., angle of rotation of the cam) as one constraint, which you can consider to be the input. The Diverter Surface Profile 156 which is the collection of Diverter Surface Position 72/73 is the second constraint, which you can consider to be the output. The Diverter Surface Position 72/73 can alternatively be modelled as angles using the Diverter Surface (72/73). By iteratively stepping through the Cam Angles 74/75 and the desired Diverter Surface Position 72/73 it is possible to generate a required Cam Diverter Tangential Contact Line 78 for each step in the iteration. The Cam Diverter Tangential Contact Line 78 could also be considered a contact point or area instead of a line but for mathematically generating the cam a line works well. These Cam Diverter Tangential Contact Line 78 are stored for each iterations Cam Angle 74/75 and taken as a group define the cutting perimeter of the Diverter Cam 60/61 which can be transferred to CAD programs or CNC systems for production.

The first constraint, Cam Profile 162, has only two primary parameters, the Cam Position Profile Maximum 182 and the Cam Acceleration Profile 158. Note that term acceleration includes deceleration as it is negative acceleration. The Cam Acceleration Profile 158 is classically optimized as a constant positive Cam Acceleration Profile Maximum 178 value during acceleration and the same constant negative value during deceleration. Most servo motors can accept substantially more current which generates the torque for short periods of time based on the duty cycle and the optimal torque could have a different profile. The Cam Position Profile Maximum 182 is optimized by making it as large as possible. For a classic cam the maximum possible is 360 degrees, but with the Cam Generation Simulator 105 the practical results because of mechanical limit when using Spring Diverters is found to be less than 360 degrees. Standard calculus will define the Cam Velocity Profile 160 with its Cam Velocity Profile Maximum 180.

The second constraint, Diverter Profile 156, has only two primary parameters, the Diverter Position Profile Maximum 176 and the Diverter Acceleration Profile 152. The Diverter Acceleration Profile 152 can have a variety of profiles as it is not electronically limited with one optimal design assuming a constants Diverter Acceleration Profile Maximum 172 which would create the Cam Diverter Force 116. This would mean a constant acceleration of the Diverter 76 and its Diverting Surface 72. In this case the Diverter Profile 156 would follow a second order function over the range of Diverting Action 67. Using Finite Element Analysis or empirical strength testing on the Diverter 76 design could allow further optimization by which the Diverter Acceleration Profile 152 is not constant. Standard calculus will define the Diverter Velocity Profile 154 with its Diverter Velocity Profile Maximum 174.

The Cam Generation Simulator 105 can also be tied directly to a graphical user interface to also include showing the motion of the boxes and the array of Cam Diverter Tangential Contact Lines 78, which provides a visual of the final cam shape. This can then be iteratively calculated for various scenarios of Layboy Sheet Gap 45 sizes, Servo Control Electric Motor 106/107 systems and Diverter designs. Sample results of one scenario are shown in FIG. 13A.

Figures 13A, 13B, 13C:
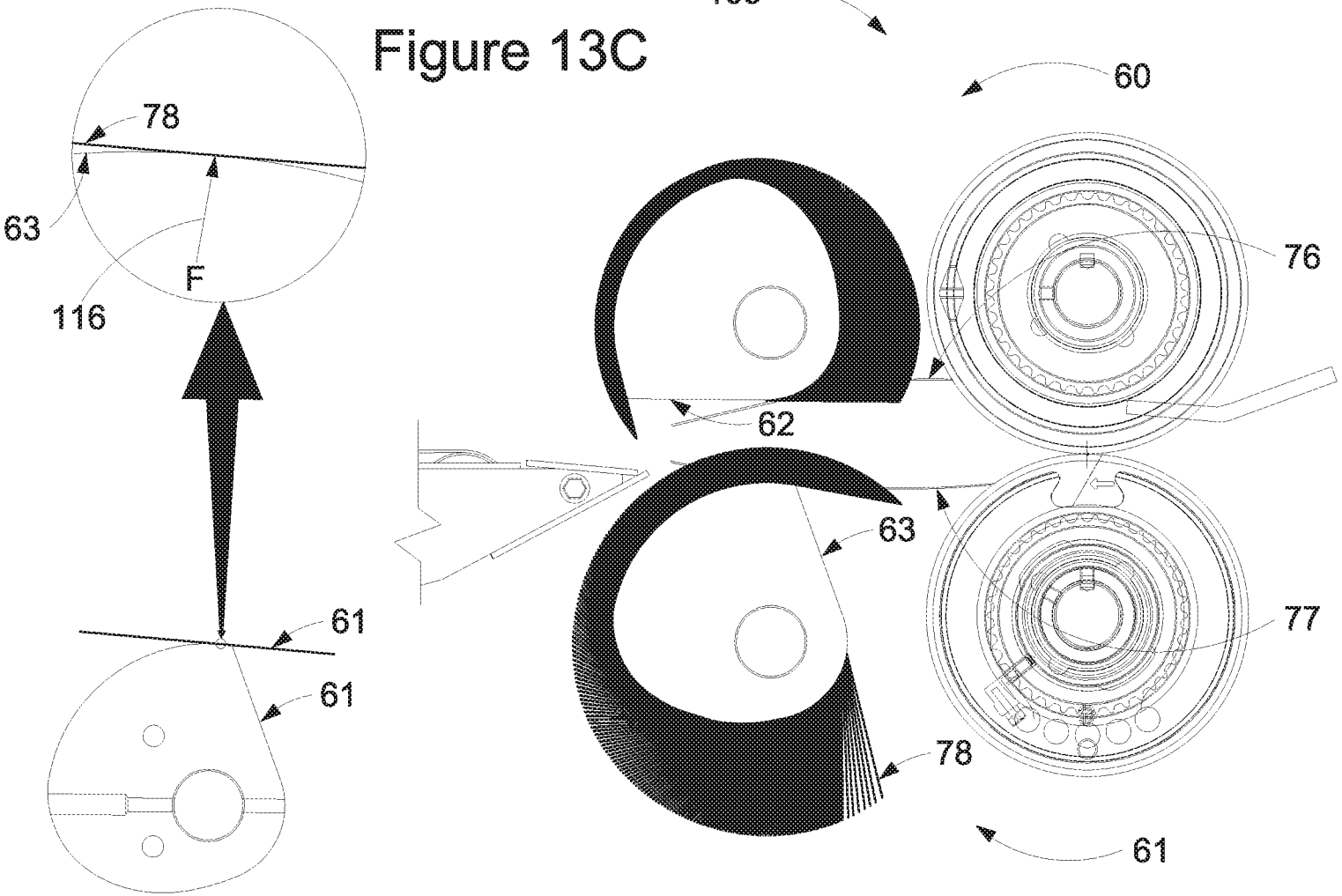
FIGS. 13A, 13B and 13C shows the results The Cam Generation Simulator 105.

FIG. 13B is just the Bottom Diverter Cam 63 with a single Cam Diverter Tangential Contact Lines 78. FIG. 13C is a highly zoomed in view of the contact between Bottom Diverter Cam 63 and the Cam Diverter Tangential Contact Lines 78. These Cam Diverter Tangential Contact Lines 78 as a collection mathematically define a series of surfaces that when generated at an adequately high enough resolution can produce a 3D CAD model, CNC program or other data sets for cam production.

Figures 15A, 15B, 15C:
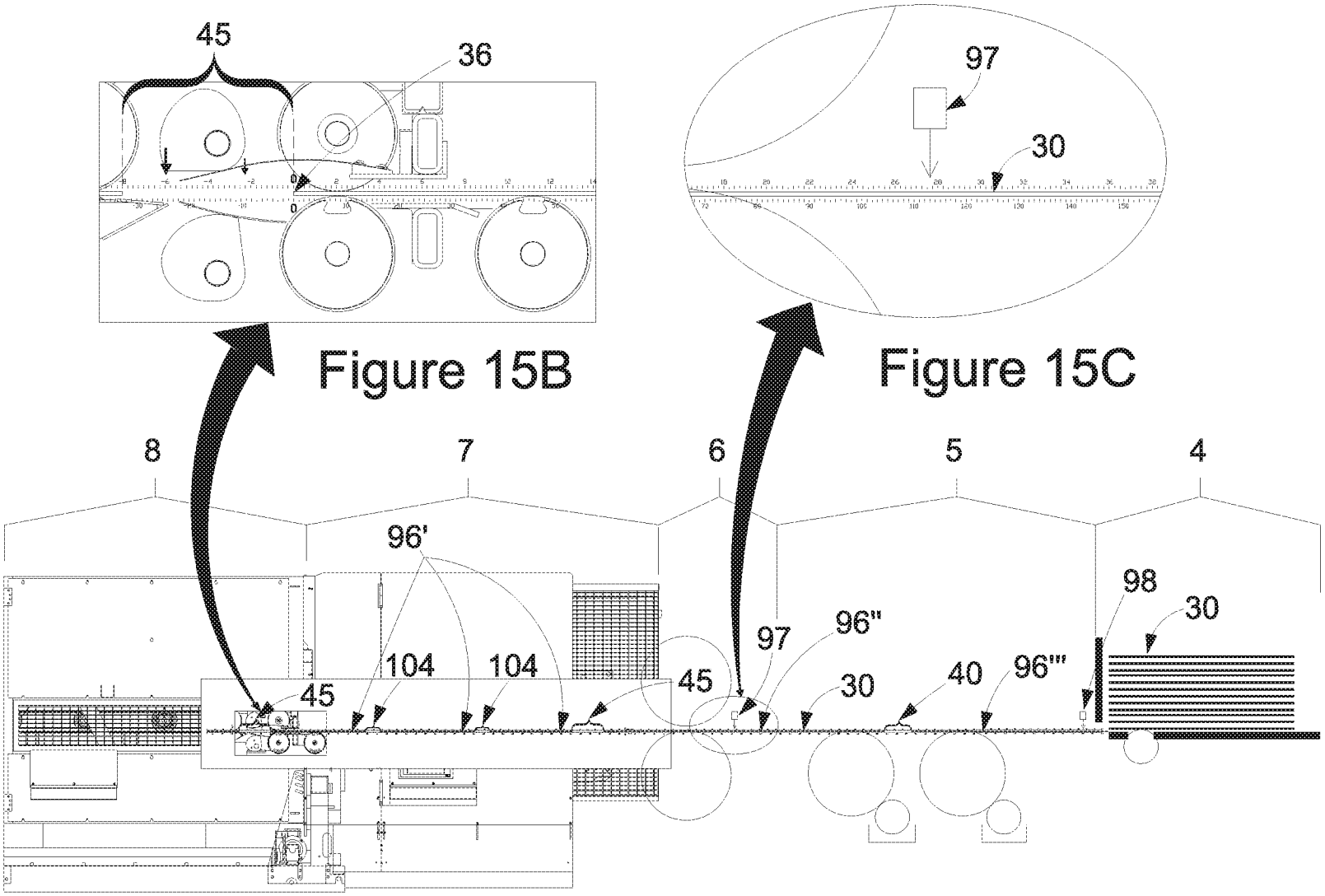
FIGS. 15A, 15B and 15C represents Virtual Sheet Tracking.

FIG. 15A represents the Normal Production Flow 49 of Corrugated Sheet Stock 30 through a Rotary Die Cutter 1, a Layboy Section 7 and a Sheet Quality Control Diverting Section 8 with simplified cut away to represent the concept of Virtual Sheet Tracking 99 of Virtual Sheets 96'/96"/96'". The Control System 19 may include Virtual Sheet Tracking 99 in order to improve the Diverting Repeatability when used in conjunction with an Electric Cam Diverter 60/61. Virtual Sheet Tracking is a software technique by which a Corrugated Stock Sheets 30, their Die Cutter Sheet Gaps 40 and their Layboy Sheet Gaps 45 are represented in the computer's memory in order to allow electronic synchronization of the Diverter Profile 156 within the Layboy Sheet Gaps 45.

For systems which have Bad Sheet Detection System 97, Virtual Sheet Tracking 99 also provides the ability to track and divert the one or more specified bad sheets detected. Bad Sheet Detection 97 is represented as a simple sensor in FIGS. 14A and 14C but can include a wide range of systems such as vision systems looking for defects in the printing on the Corrugated Sheet Stock 30. They must be upstream of the Electric Cam Diverter 60/61 and provide an electronic signal Bad Sheet Detection Signal 144 with adequate time to allow processing and execution of the Cam Profile 162 which also would include the Diverter Profile 156. The timing of the Bad Sheet Detection Signal 144 is not critical to the Diverting Repeatability since the Virtual Sheet Tracking 99 uses one or more Virtual Sheets Edge Detectors 98 and either a reference position or velocity data source to create the Virtual Sheet Model 145.

There are a variety of low-level software memory techniques known by various names such as 'stacks', 'ring buffers', 'arrays', 'record-sets' and 'collections' which may be employed to create Virtual Sheet Tracking 99. However, the key element is to store and track the edge of the multiple Corrugated Sheet Stock 30 as Virtual Sheets 96'/96"/96'" after they are fed at the Feed Table Section 4 and until they are pass the Electric Cam Diverter 60/61.

The reference position could be an encoder on the Die Drum 11 or any other conveying surface that does not have significant slip with the Corrugated Sheet Stock 30. Alternatively, a velocity data source from a tachometer or motor drive could also be used by integrating the signal to convert back into position information. At least one Virtual Sheets Edge Detector 98 is used to add a new Virtual Sheet to memory and the repeatability of the signal from the Virtual Sheets Edge Detector 98 is important to the ultimate Diverting Repeatability. When the Virtual Sheet is added its position is stored based on the reference data. As time continues, the Control System 19 updates the position of all the Virtual Sheets in memory based on the reference data which provides knowledge of the Die Cutter Sheet Gap 40 and the Layboy Sheet Gap 45. Note that if the Layboy Line Speed 102 is difference than the Die Cutter Line Speed 15, the difference needs to be known and applied to the reference data for accuracy.

The memory structure would also include the ability to tag one or many Virtual Sheets as being bad sheets and thus needing to be diverted once they get to the Electric Cam Diverter 60/61.

The Control System with the Virtual Sheet Model 145 in memory and known Cam Profile 162 can now know precisely when to start executing the Cam Profile 162 in order to position the ultimate Diverter Profile properly within the Layboy Sheet Gaps.

A simple design for the Diverter 76/77 is to use spring type materials to create a Diverter 76/77 with one side for contacting the Diverter Cam 62/63 and the other side acting as the Diverting Surface 72/73. The Diverter 76/77 can be preloaded against the Cam in order to allow adequate return force and thus no need for a complicated connection between the Diverter Cam 62/63 and the Diverter 76/77. Alternative Cam-Diverters could have Cam slotted with a variety of followers and linkages that can achieve the same results but would be more complicated.

While the Diverter Tangential Contact Lines 78 from the Cam Generation Simulator 105 essential shows the whole cycle in a single figure, FIGS. 16-25 depicts ten of the interesting stages of the cycle.

Figure 16:
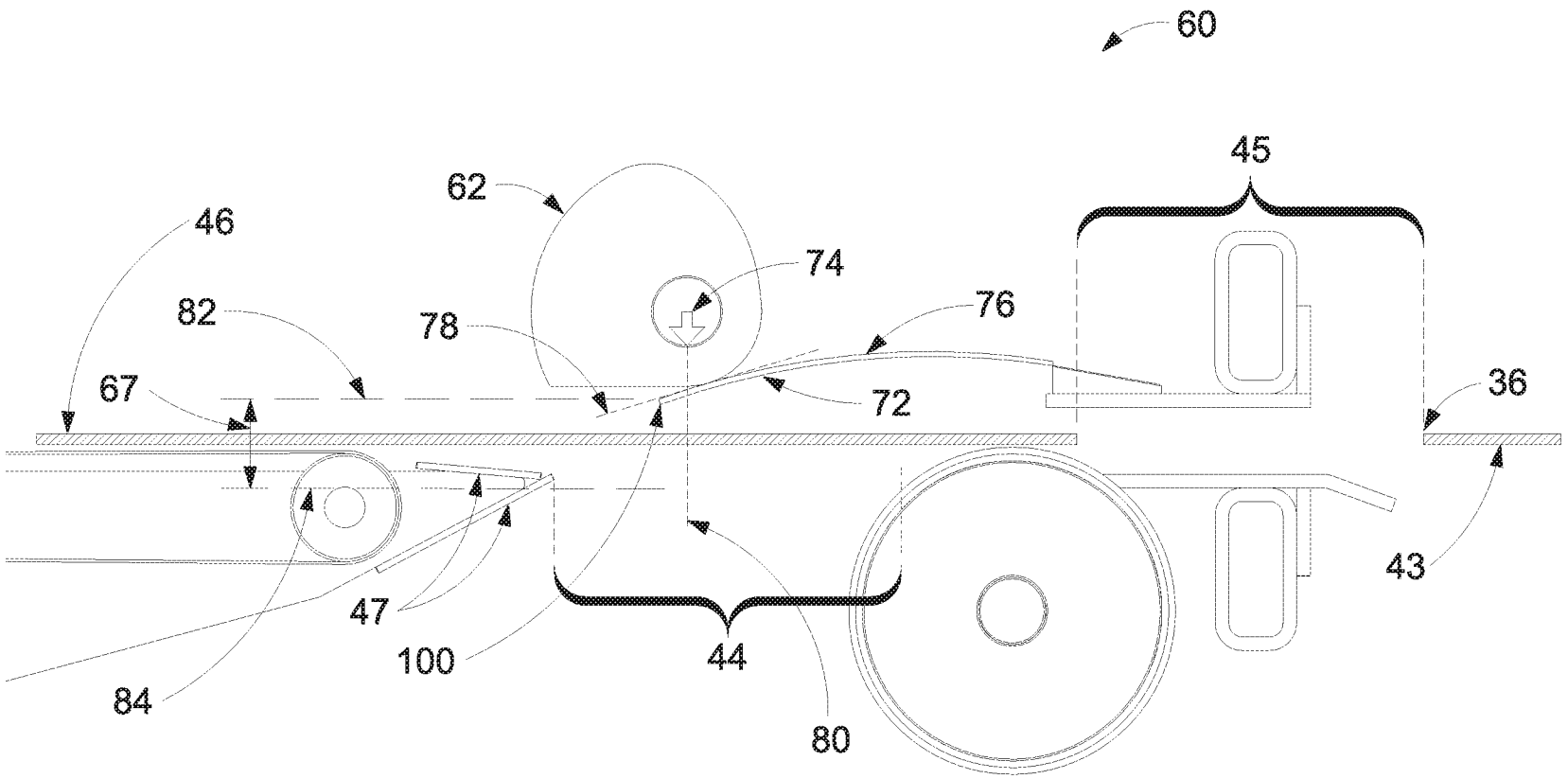
FIG. 16 is a Top Electric Cam Diverter 60 depicting a first position.

FIG. 16 is a Top Electric Cam Diverter 60 depicting a first position with the first Box Lead Edges 36 of the First Diverted Boxes 43 approaching and progressing right to left through the Diverting system 50. Non-Diverted Box 46 are passing though and is still partially in the Diverting Zone 44. The Top Cam Angle 74 and the Top Diverter Surface 72 are at their Zero Rotation/Position 80 and 82 respectively. It is understood that the Cam Generation Simulator 105 items displayed are not required to match the actual items in geometric accuracy other than to the extent that the relationship between the Top Cam Angle 74 and Top Diverting Surface 72 relative to the Lower Conveyor Nose Surfaces 47.

Figure 17:
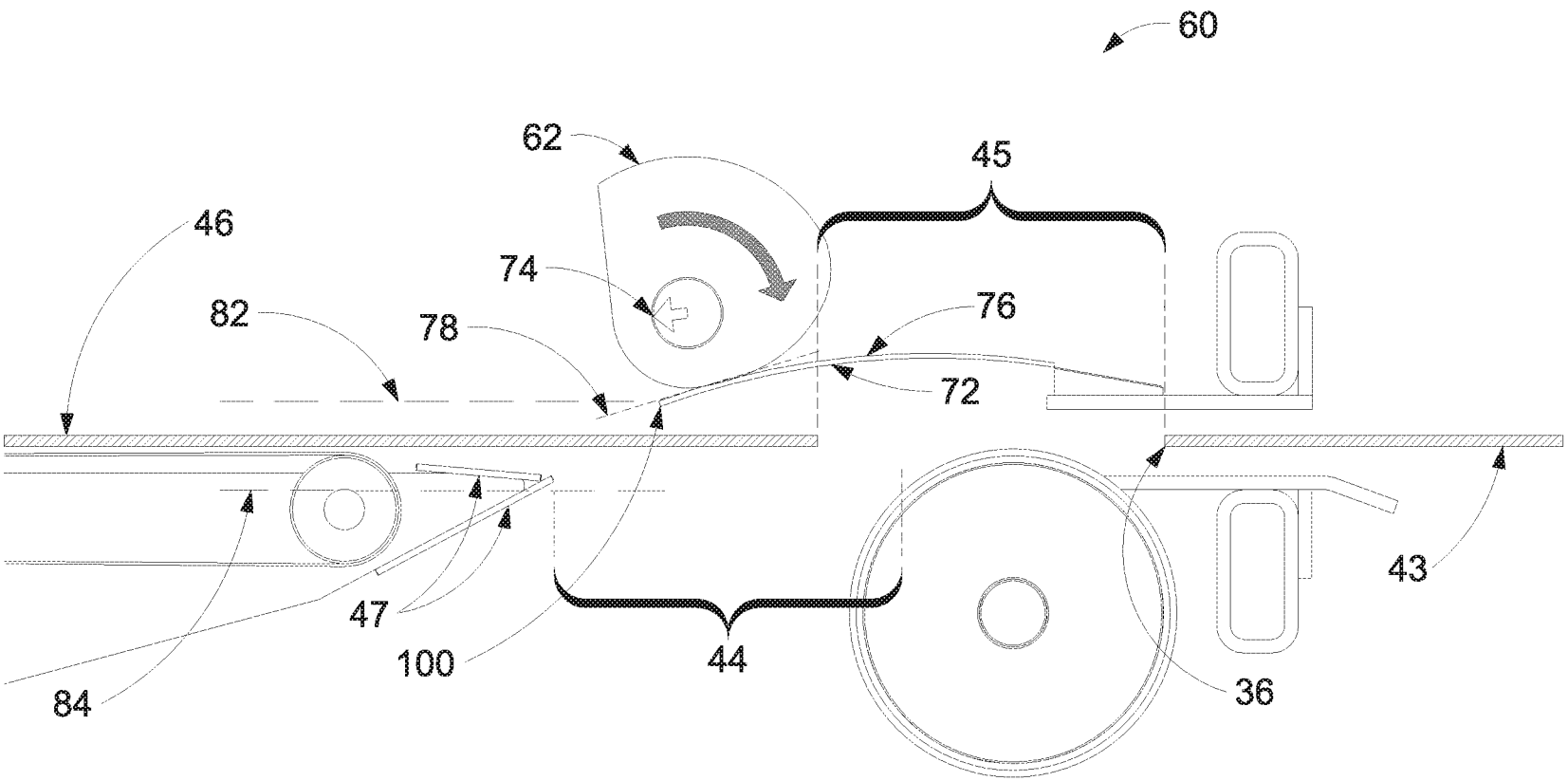
FIG. 17 is a Top Electric Cam Diverter 60 depicting a second position.

FIG. 17 is a Top Electric Cam 60 depicting a second position with the first Box Lead Edges 36 of the First Diverted Boxes 43 progressing right to left. The Top Diverter Cam 62 has begun to rotate its Top Cam Angle 74 defining a Cam Diverter Tangential Contact Line 78 between the Top Diverter Cam 62 and the Top Diverter 76 which operatively controls the Top Diverter Surface 72. The Top Diverter 76 is still at its starting Top Diverter Zero Position 82. This is allowing the Top Diverter Cam 62 to increase speed and energy without a substantial change to the position of the Top Diverter Surface 72.

Figure 18:
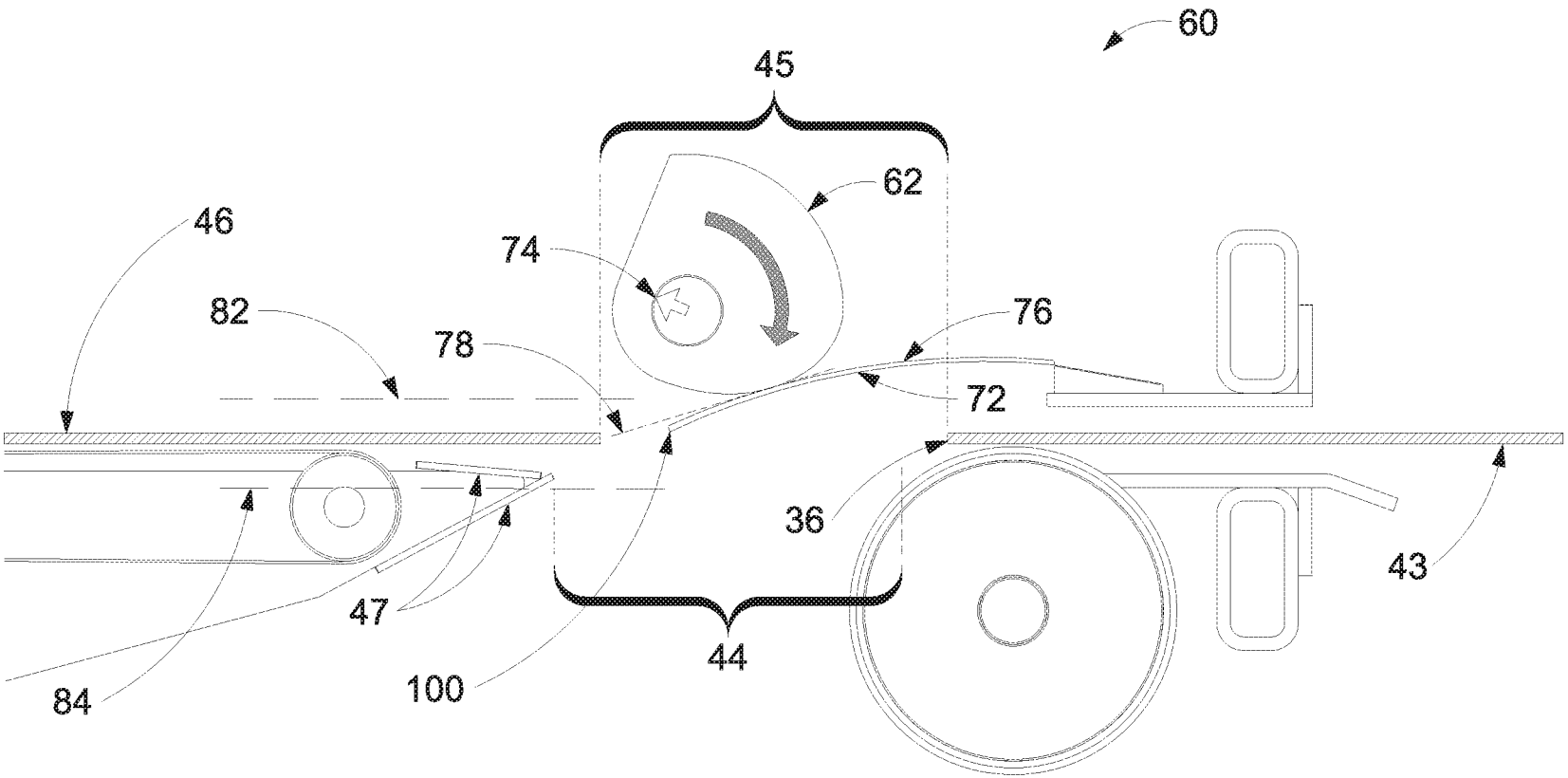
FIG. 18 is a Top Electric Cam Diverter 60 depicting a third position.

FIG. 18 is a Top Electric Cam Diverter 60 depicting a third position. The Top Diverter Cam 62 continues to rotate its Top Cam Angle 74 defining a Cam Diverter Tangential Contact Line 78 which operatively controls the Top Diverter Surface 72. The Top Diverter 76 is moving away from its Top Diverter Zero Position 82 and the Layboy Sheet Gap 45 is nearly into the Diverting Zone 44. The Top Diverter Lead Edge 100 is now in the Layboy Sheet Gap 45.

Figure 19:
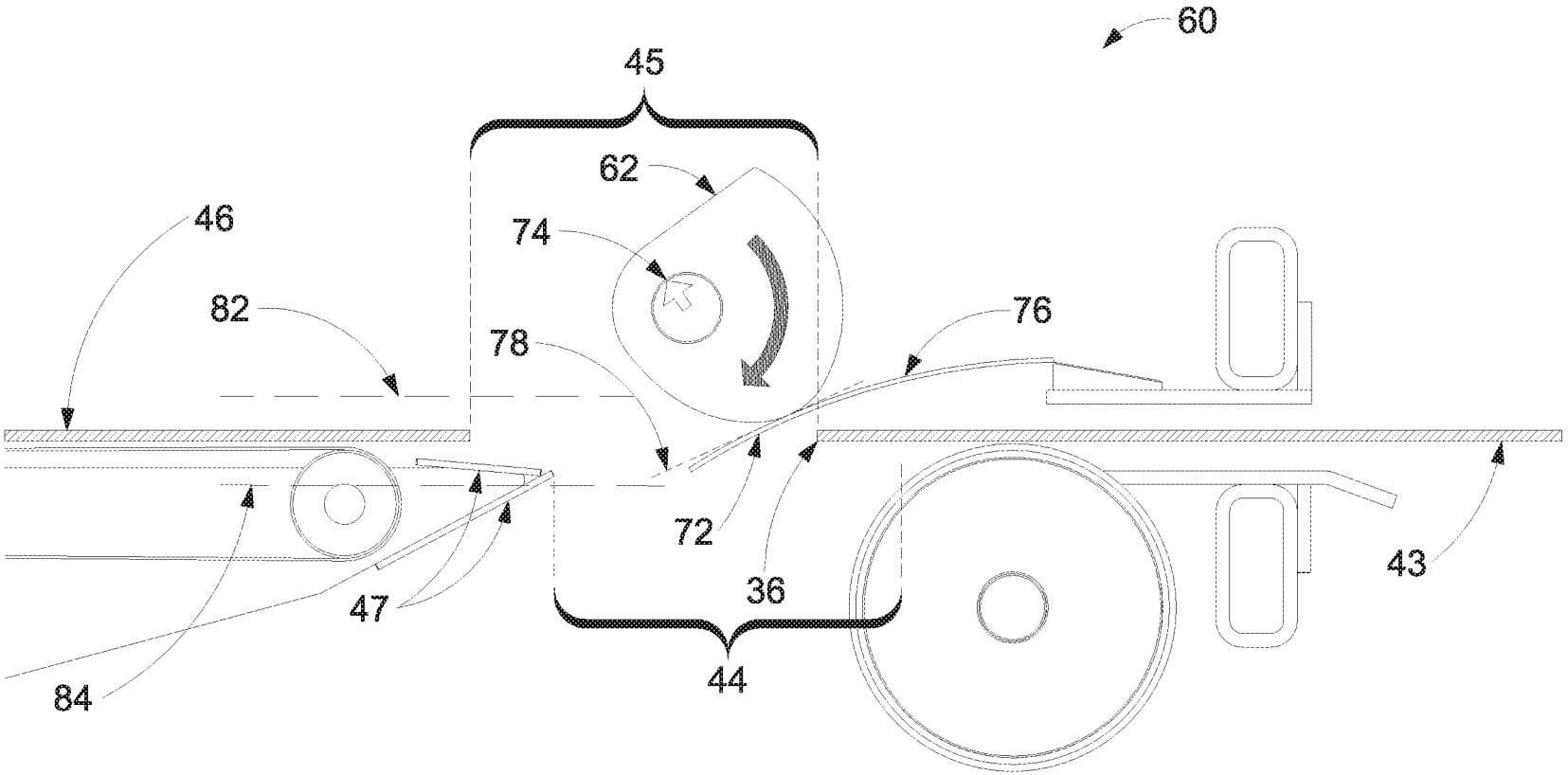
FIG. 19 is a Top Electric Cam Diverter 60 depicting a fourth position.

FIG. 19 is a Top Electric Cam Diverter 60 depicting a fourth position. The Top Diverter Cam 62 continues to rotate its Top Cam Angle 74 defining a Cam Diverter Tangential Contact Line 78 which operatively controls the Top Diverter Surface 72. The Top Diverter 76 is now nearly in its Top Diverting Position. The Layboy Sheet Gap 45 is into and pass the Diverting Zone 44.

Figure 20:
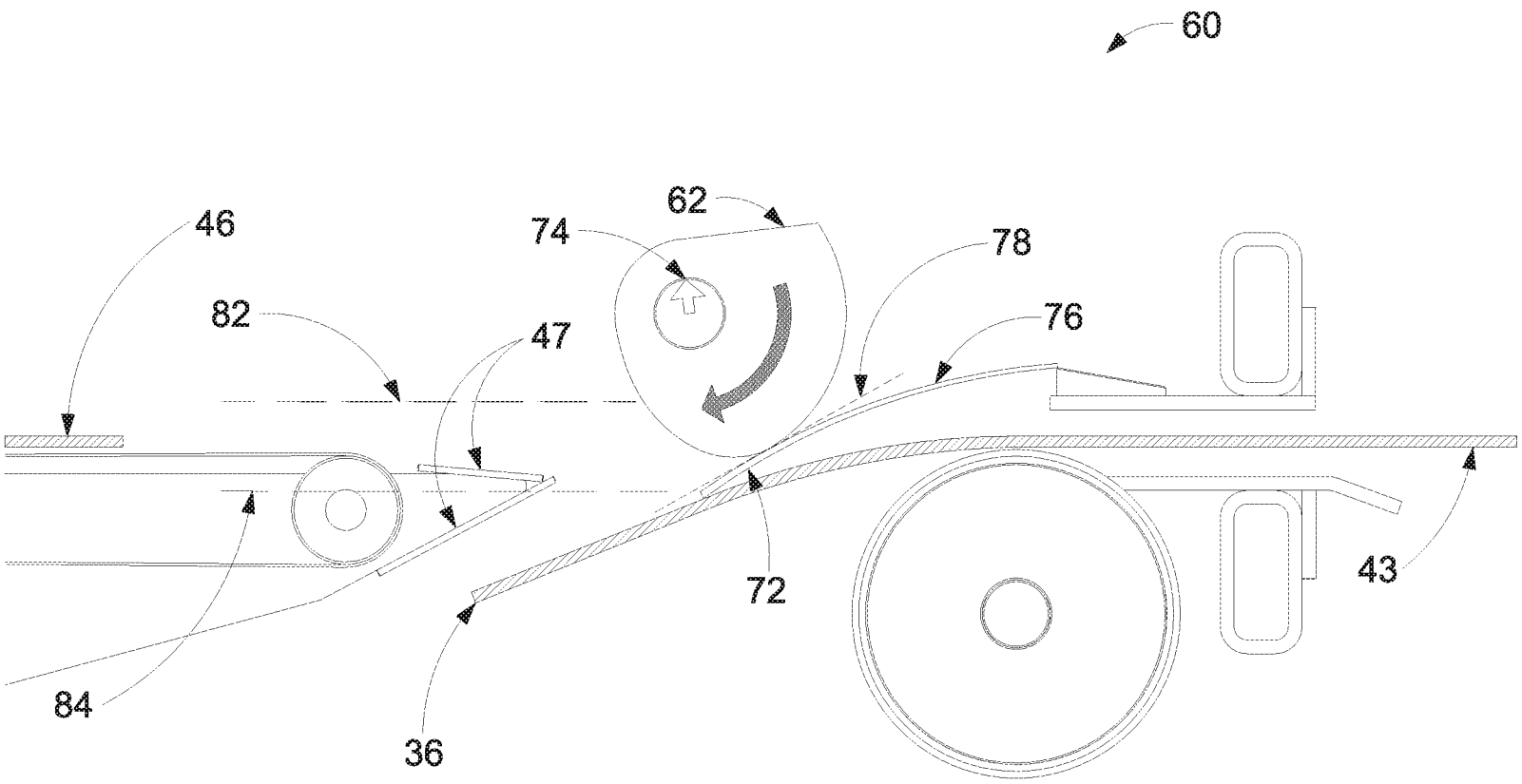
FIG. 20 is a Top Electric Cam Diverter 60 depicting a fifth position.

FIG. 20 is a Top Electric Cam Diverter 60 depicting a fifth position. The First Diverted Boxes 43 are being diverted under the Lower Conveyor Nose Surfaces 47. The Top Diverter Cam 62 continues to rotate its Top Cam Angle 74 defining a Cam Diverter Tangential Contact Line 78 which operatively controls the Top Diverter Surface 72. The Top Diverter 76 is now holding in its Top Diverter Position Profile Maximum 176. This is allowing the Top Diverter Cam 62 to decrease speed and energy without a substantial change to the position of the Top Diverter Surface 72.

Figure 21:
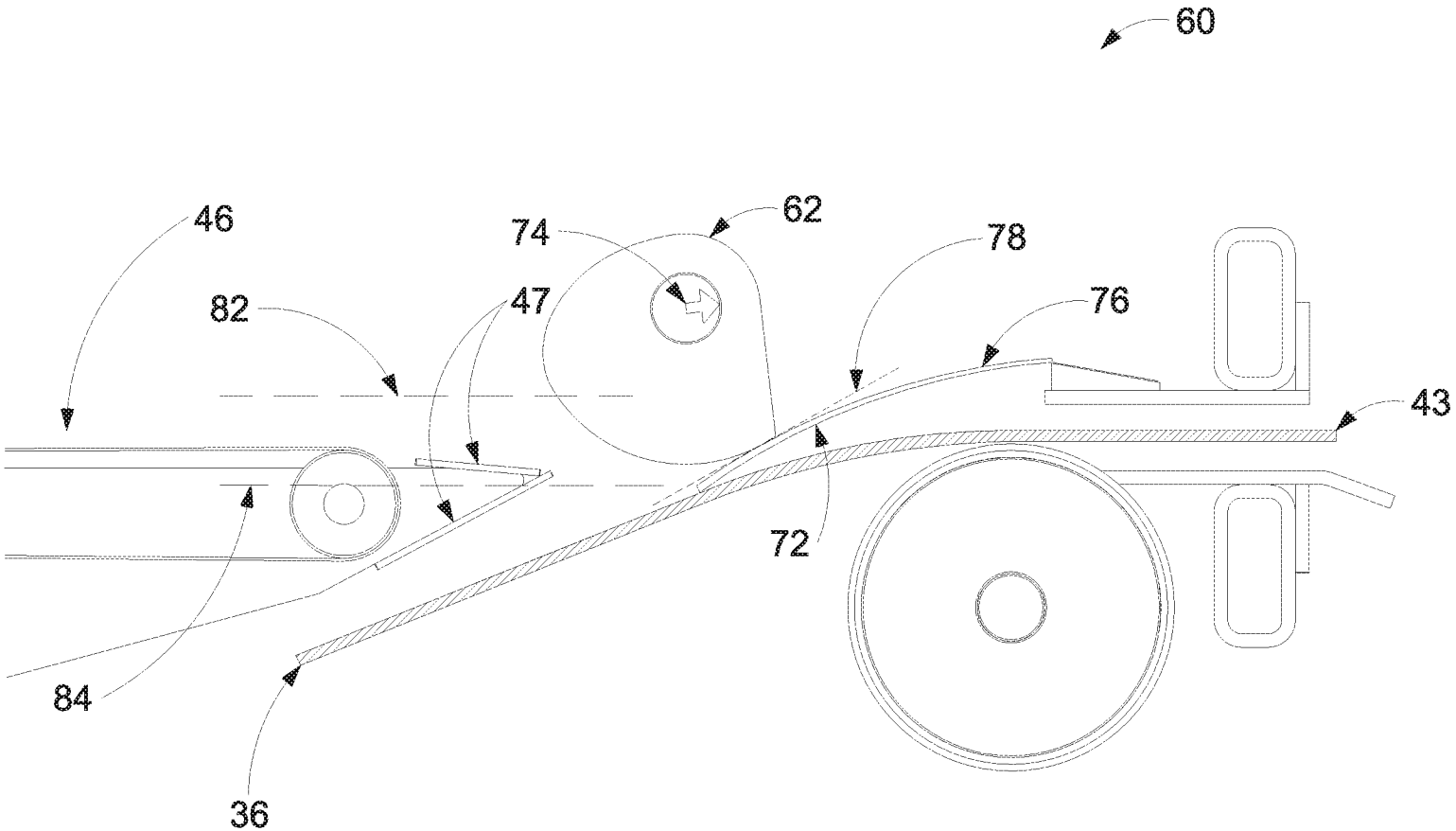
FIG. 21 is a Top Electric Cam Diverter 60 depicting a sixth position.

FIG. 21 is a Top Electric Cam Diverter 60 depicting a sixth position. The First Diverted Boxes 43 are being diverted under the Lower Conveyor Nose Surfaces 47. The Top Diverter Cam 62 has stopped and is holding its Top Cam Angle 74 defining a Cam Diverter Tangential Contact Line 78 which operatively controls the Top Diverter Surface 72. The Top Diverter 76 is still in its Top Diverter Position Profile Maximum 176 and the Top Diverting is no longer changing which is defines the Cam Diverter Tangential Contact Line 78. This position can be held indefinitely to divert one or more sets of Boxes.

Figure 22:
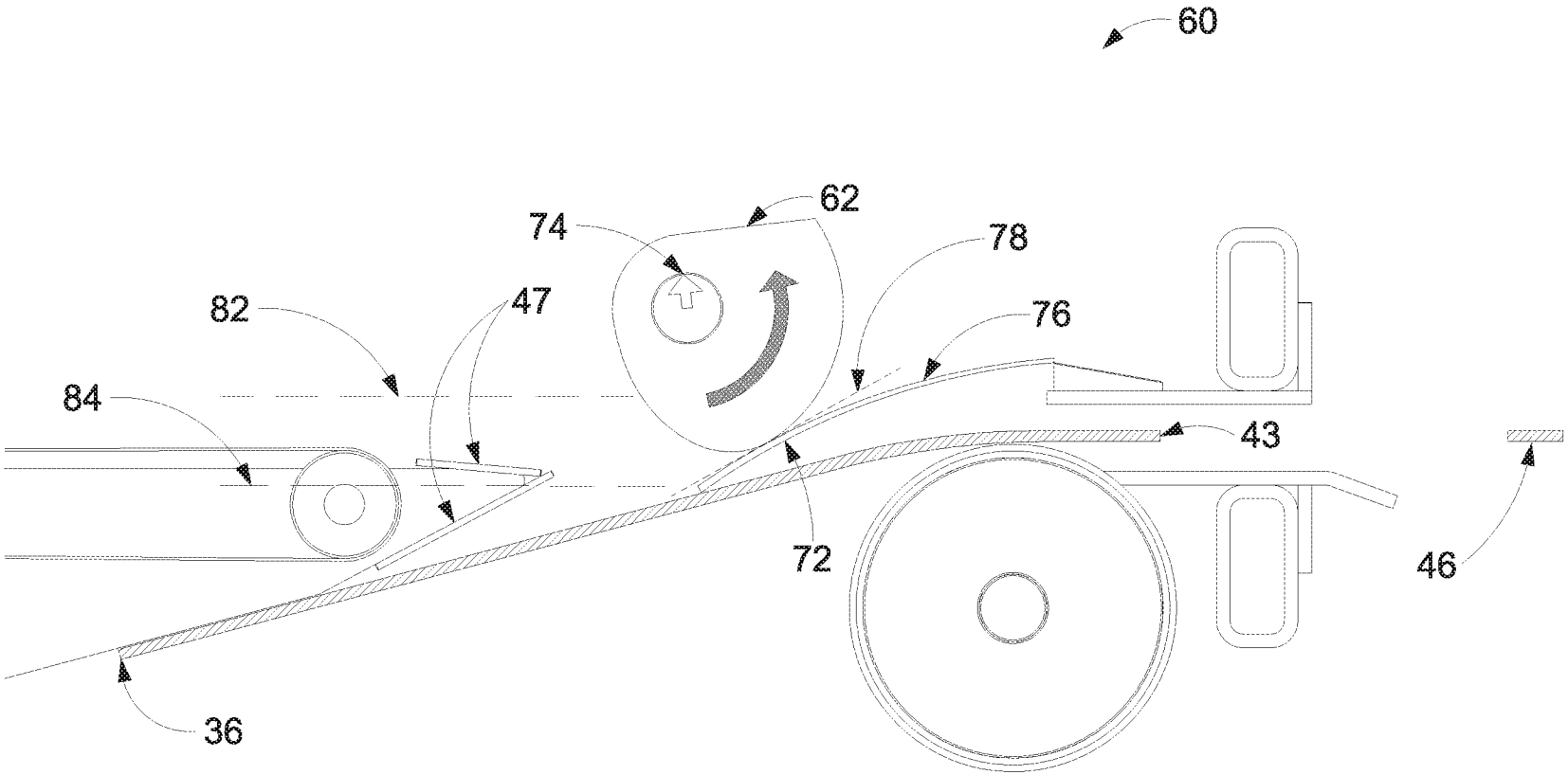
FIG. 22 is a Top Electric Cam Diverter 60 depicting a seventh position.

FIG. 22 is a Top Electric Cam Diverter 60 depicting a seventh position. The Top Diverter Cam 62 has reversed the rotation of its Top Cam Angle 74 defining a Cam Diverter Tangential Contact Line 78 which operatively controls the Top Diverter Surface 72. The Top Diverter 76 is still at its Top Diverter Position Profile Maximum 176. The Boxes are still being diverted to the bottom side of the Lower Conveyor Nose Surfaces 47.

Figure 23:
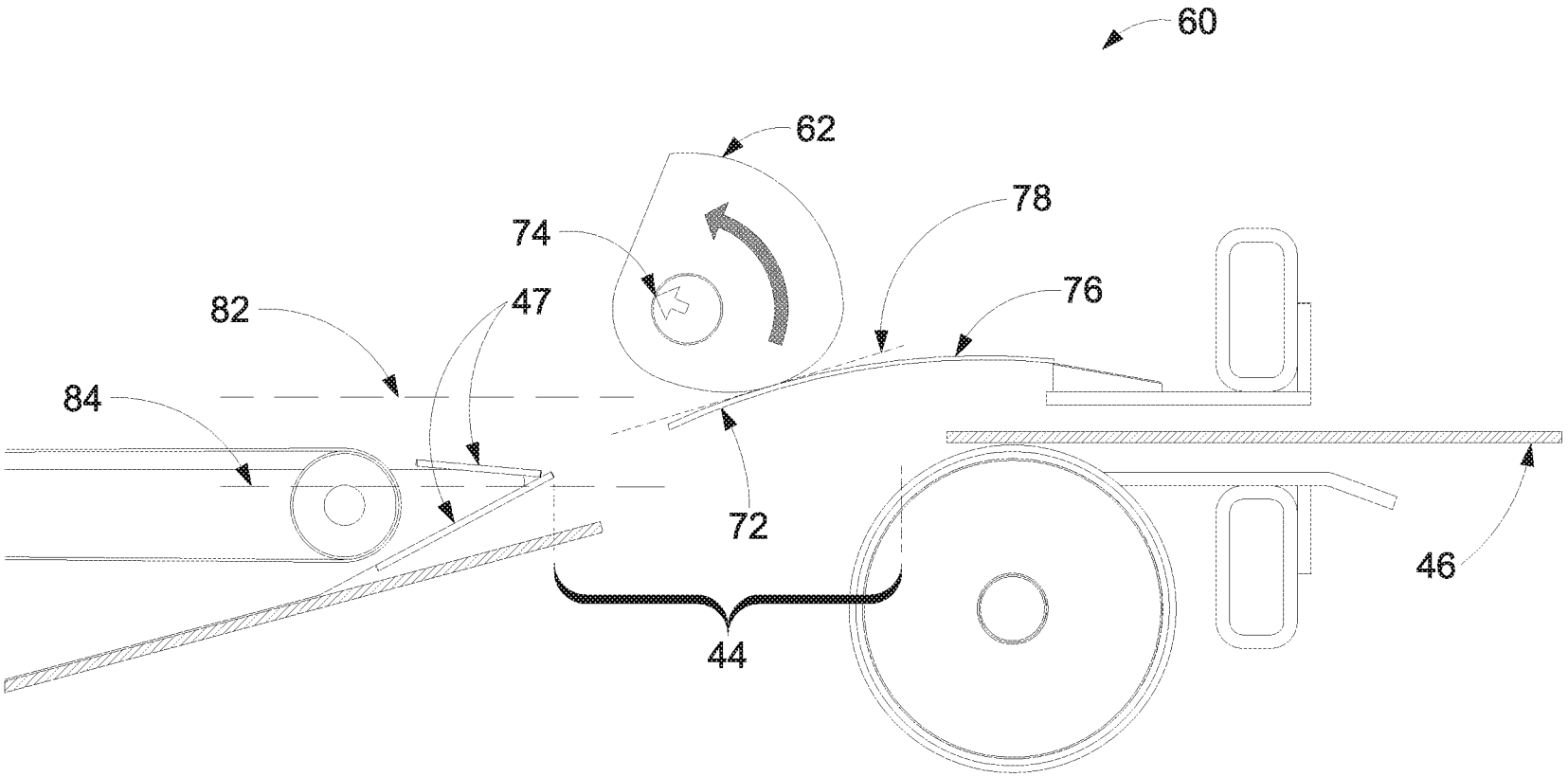
FIG. 23 is a Top Electric Cam Diverter 60 depicting an eight position.

FIG. 23 is a Top Electric Cam Diverter 60 depicting an eight position. The Top Diverter Cam 62 continues its reverse rotation of its Top Cam Angle 74 defining a Cam Diverter Tangential Contact Line 78 which operatively controls the Top Diverter Surface 72. The Top Diverter 76 is moving back towards its Top Diverter Zero Position 82. The Boxes are still being diverted to the bottom side of the Lower Conveyor Nose and their Boxes Trail Edge 37 is now pass the Diverting Zone 44.

Figure 24:
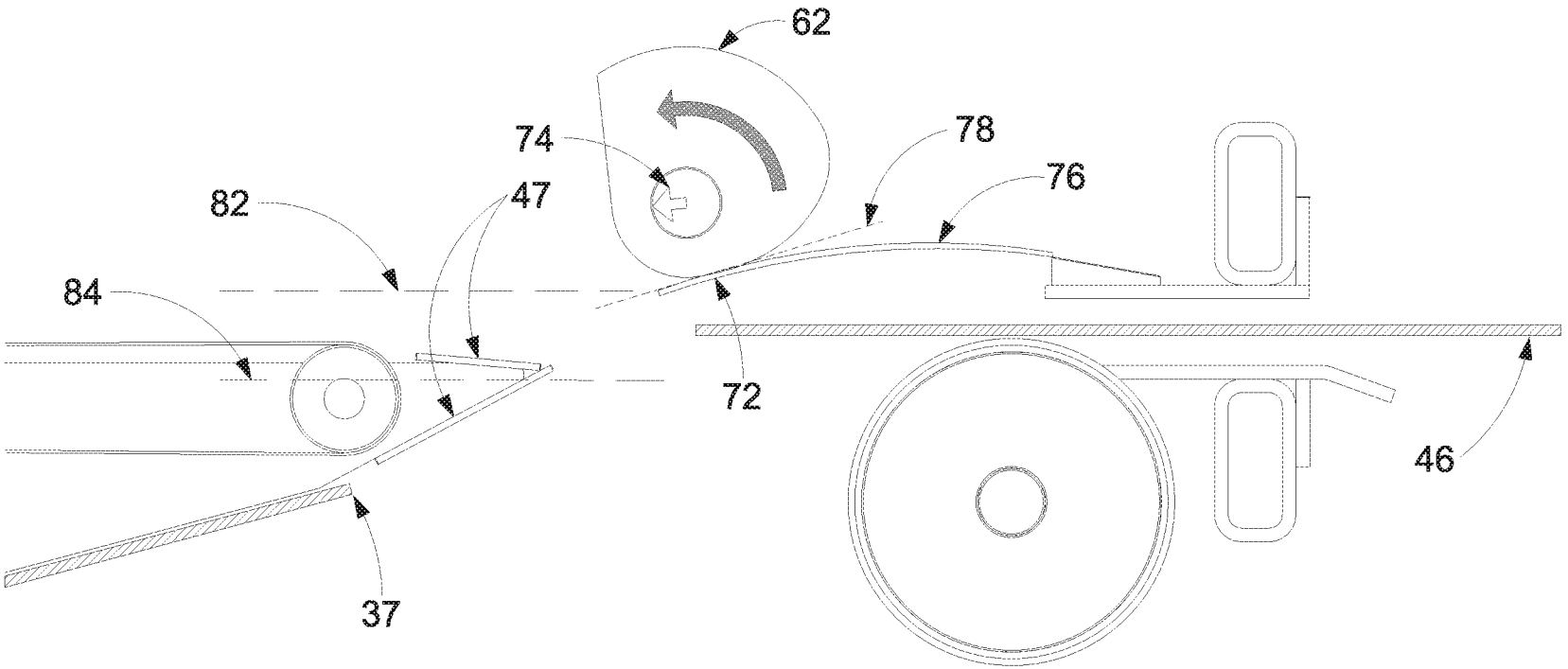
FIG. 24 is a Top Electric Cam Diverter 60 depicting a ninth position.

FIG. 24 is a Top Electric Cam Diverter 60 depicting a ninth position. The Top Diverter Cam 62 is near the end of the rotation of its Top Cam Angle 74 defining a Cam Diverter Tangential Contact Line 78 which operatively controls the Top Diverter Surface 72. The Top Diverter 76 is still in its Top Diverter Zero Position 82. The following Non-Diverted Boxes 46 are allowed to pass while the Top Diverter Cam 62 decreases speed and energy without a substantial change to the position of the Top Diverter Surface 72.

Figure 25:
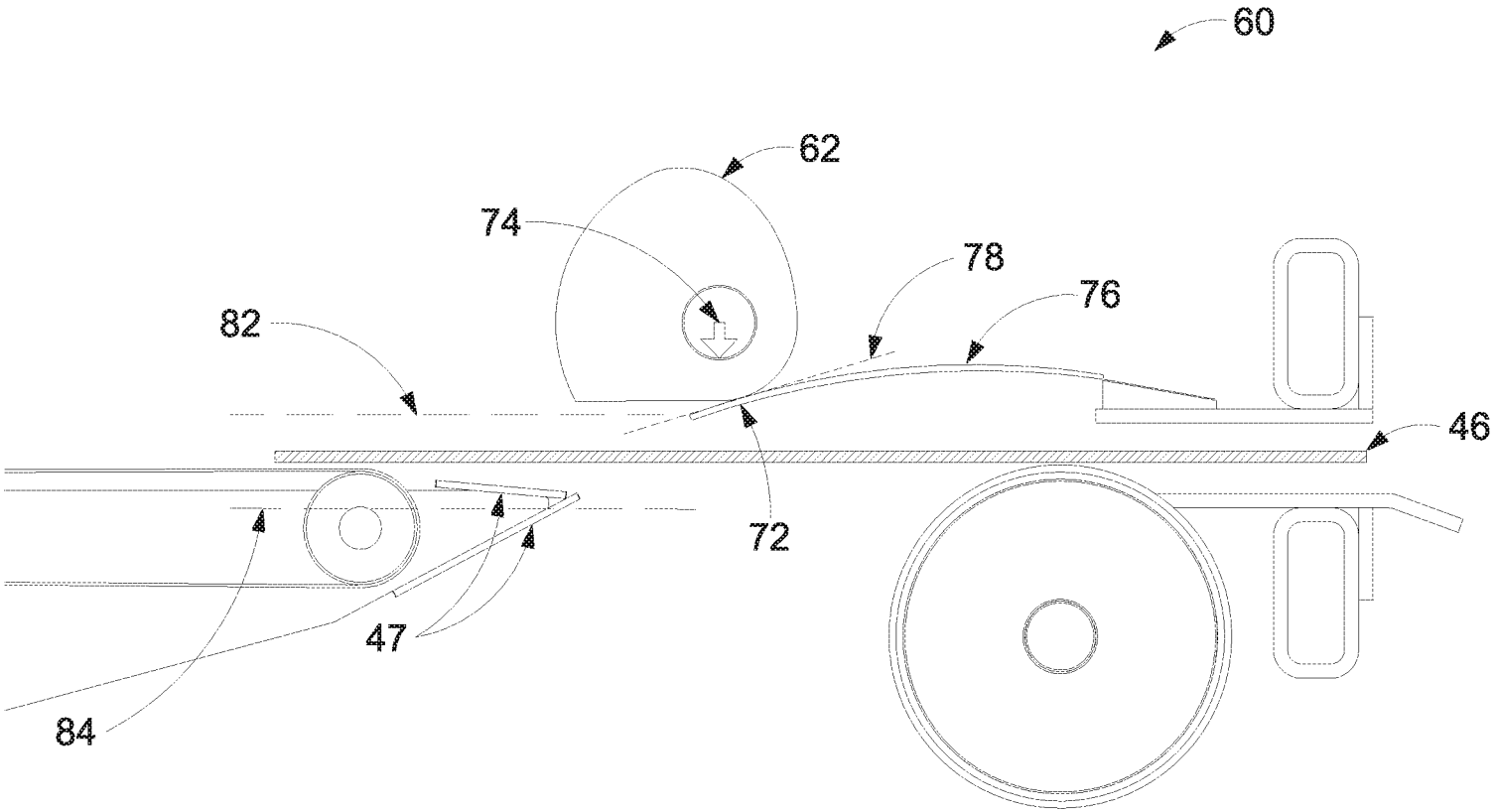
FIG. 25 is a Top Electric Cam Diverter 60 depicting a tenth position.

FIG. 25 is a Top Electric Cam Diverter 60 depicting a tenth position. This is the conclusion of the cycle and is the same as state shown in FIG. 16.

FIGS. 26, 27, 28 and 29 depicts a perspective view, a side view, a top view and an end view of a Sheet Quality Control Diverting Section 8 including an embodiment of two Electric Cam Diverters 60/61. This view includes a Base Cross Conveyor Section 90, a Lower Board Conveyor Section 91, an Upper Board Control Section 92 and an Upper Diverter Section 93.

Figure 30:
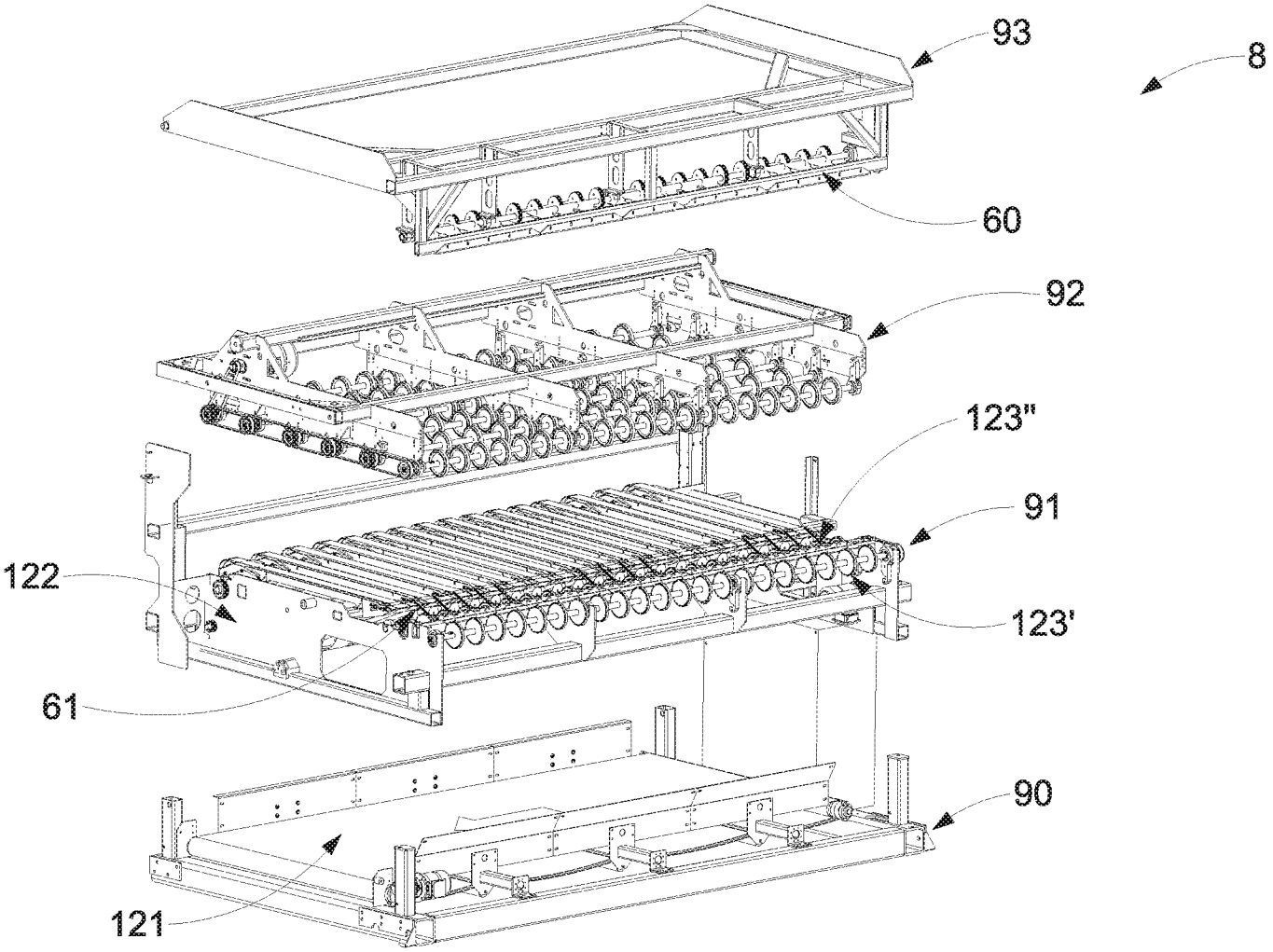
FIGS. 30 and 31 depicts an exploded perspective view and a side view of a Sheet Quality Control Diverting Section 8 including an embodiment of two Electric Cam Diverters 60/61.
Figure 31:
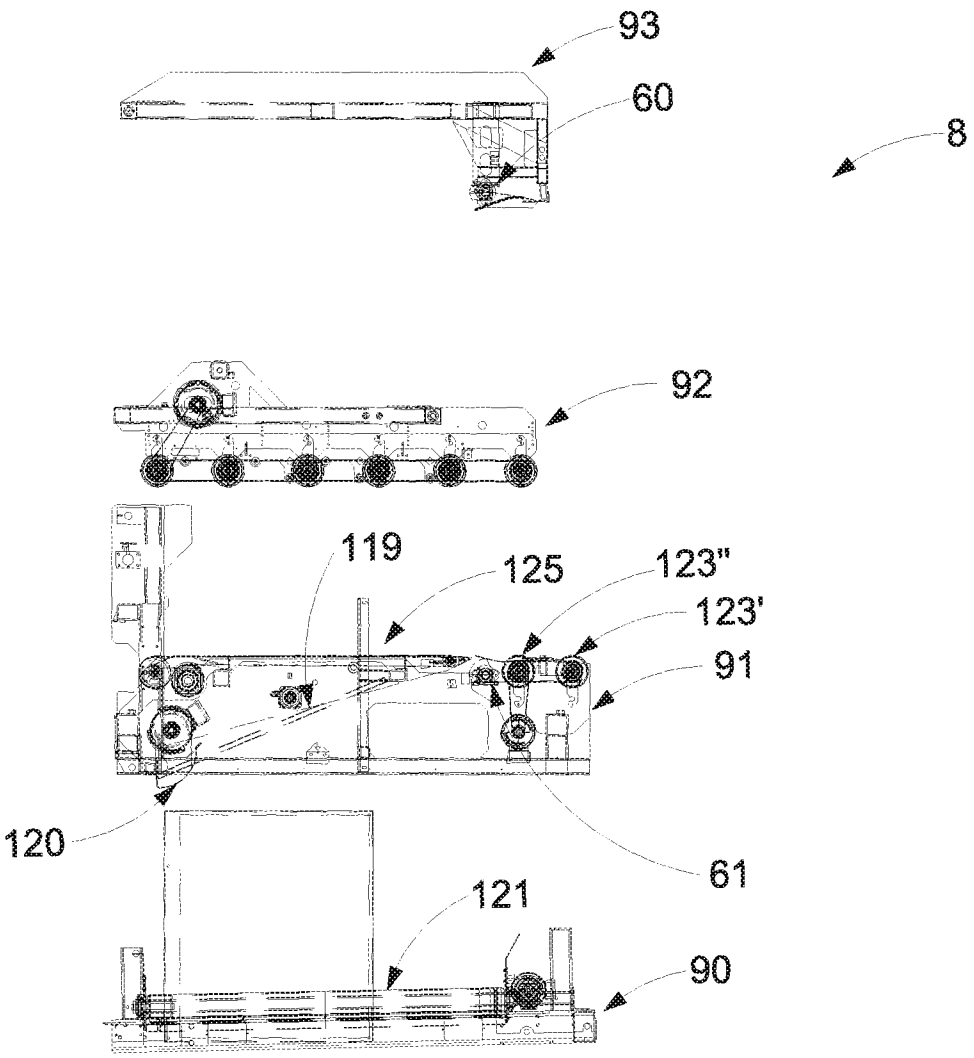

FIGS. 30 and 31 depicts an exploded perspective view and a side view of a Sheet Quality Control Diverting Section 8 including an embodiment of two Electric Cam Diverters 60/61.

The Base Cross Conveyor Section 90 provides the foundation of the entire Sheet Quality Control Diverting Section 8. The Lower Board Conveyor Section 91 transports the boxes in their Normal Production Flow 49 and is design with a Lower Conveyor Nose 48 and an upstream Bottom Electric Cam Diverter 61 which is an option part of the diverting system. The Top Electric Cam Diverter 60 could act alone as a diverting system, but the combination of the Top Diverter 76 and the Bottom Diverter 77 decreases the likelihood that an edge or flap of the box will catch during Normal Production Flow 49. The upstream diverting system can selectively direct boxes under the Lower Conveyor Nose 48 down onto the Cross Conveyor 121 of the Base Cross Conveyor Section 90. The Upper Board Control Section 92 provides control of the boxes as they are travelling at high speeds in Stream Mode 17 and air resistance alone could be enough to disrupt the flow without this additional board control. The Upper Diverter Section 93 includes an upstream Top Electric Cam Diverter 60 which is part of the diverting system. When the Clam Shell 130 is closed, the Top Diverter 76 is positioned generally above the Bottom Diverter 77 creating a Diverting Funnel 66 between the Top Diverting Surface 72 and the Bottom Diverting Surface 73.

Figure 26:
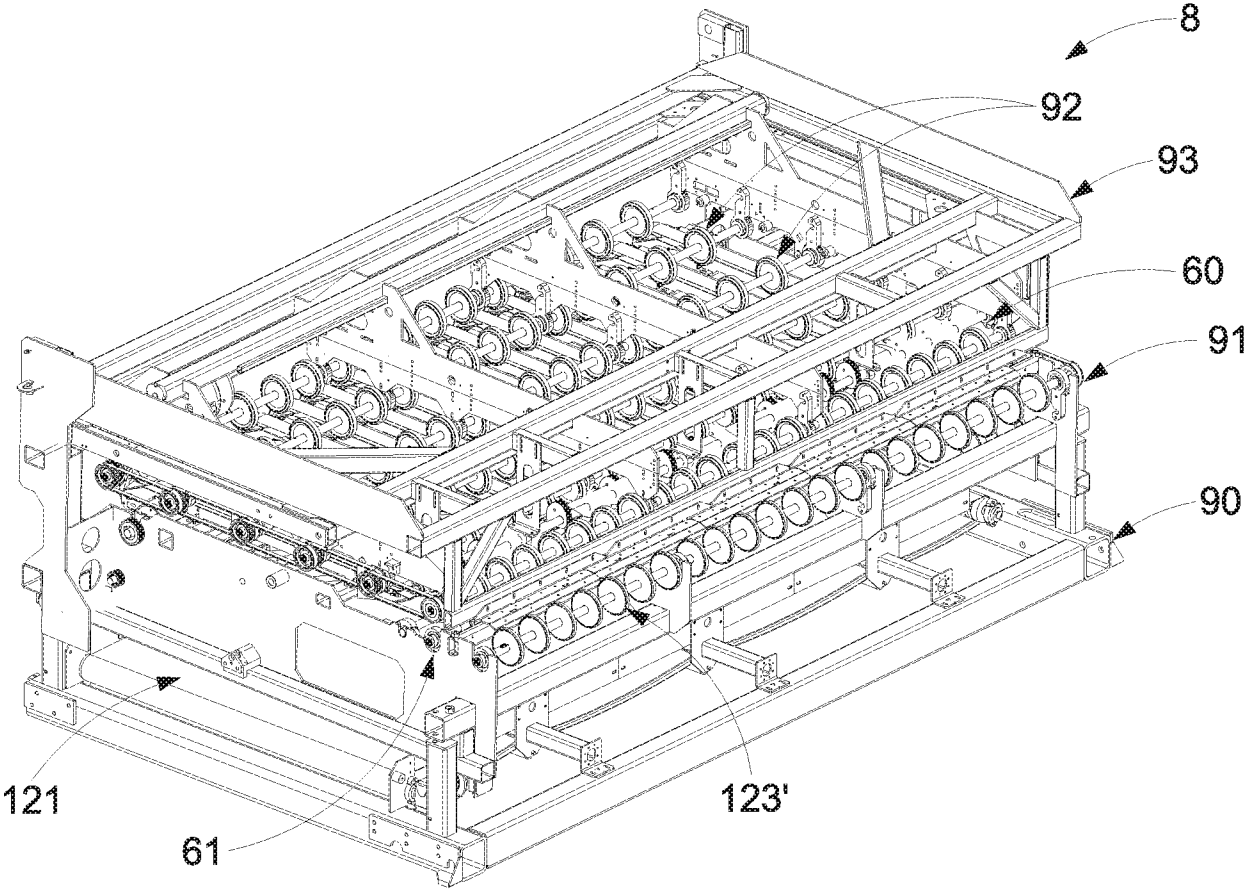
FIGS. 26, 27, 28 and 29 depicts a perspective view, a side view, a top view and an end view of a Sheet Quality Control Diverting Section 8 including an embodiment of two Electric Cam Diverters 60/61.
Figure 27:
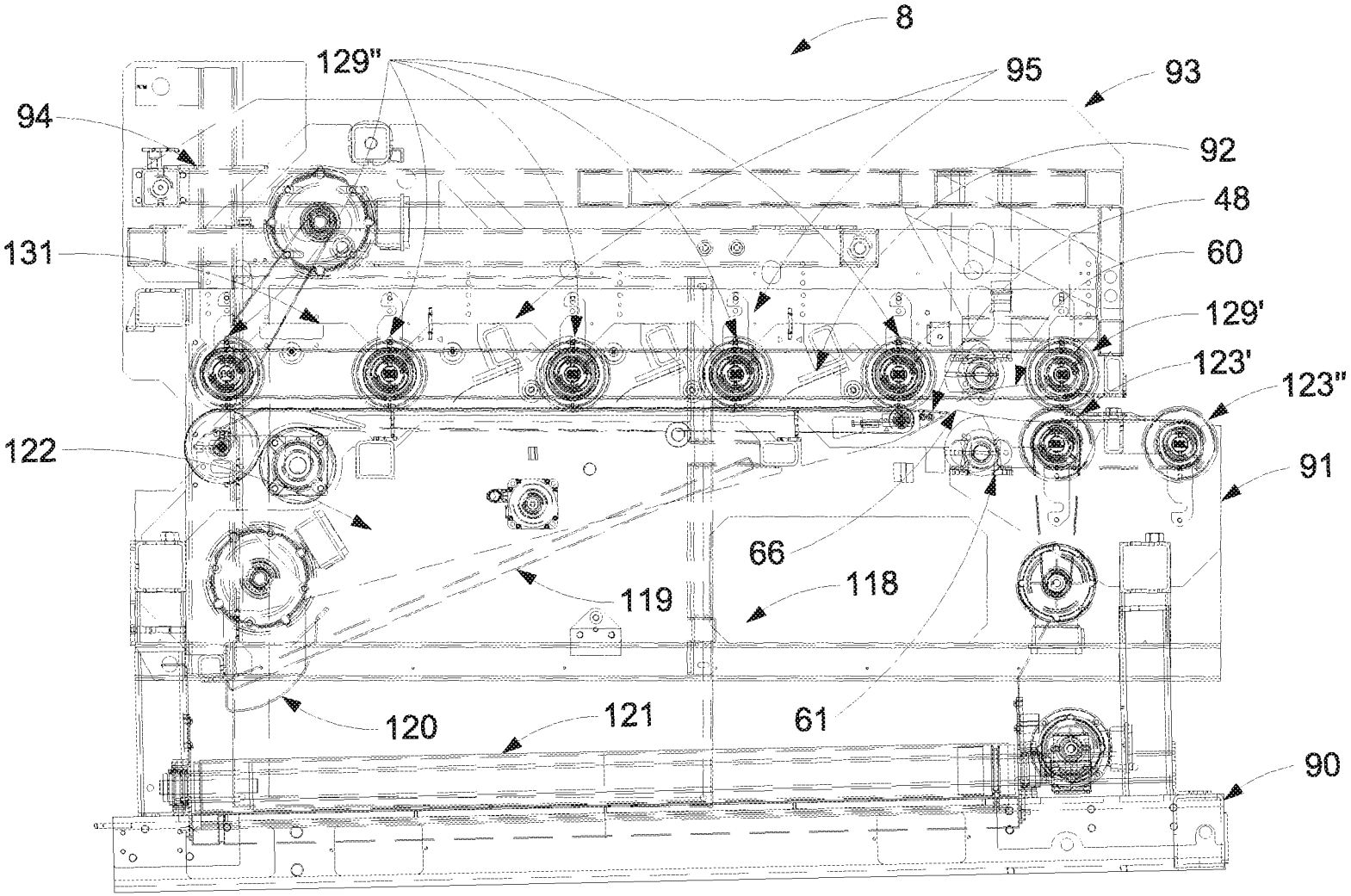
Figure 28:
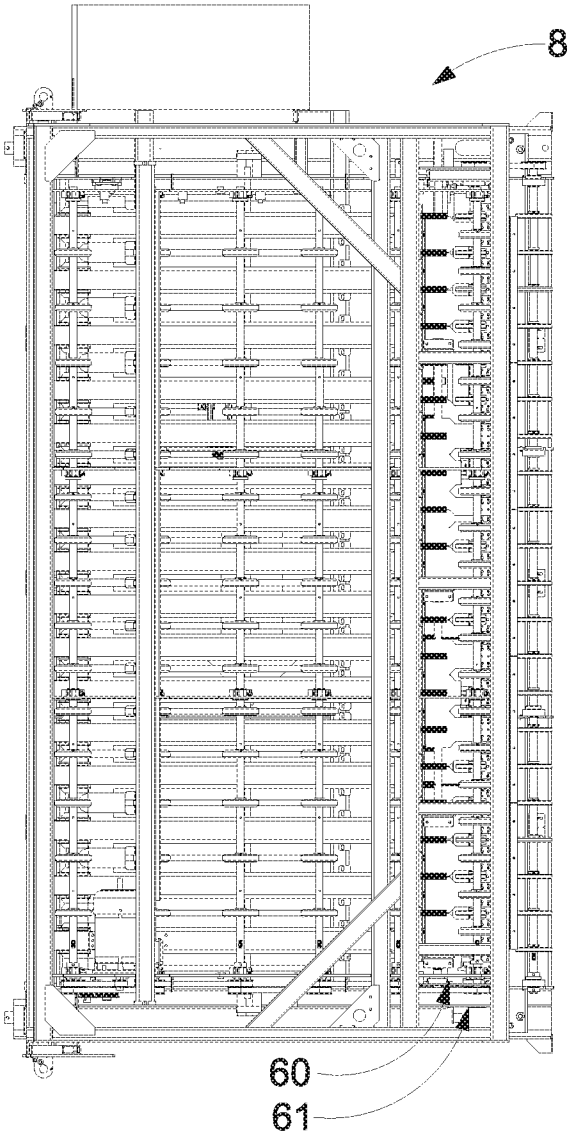
Figure 29:
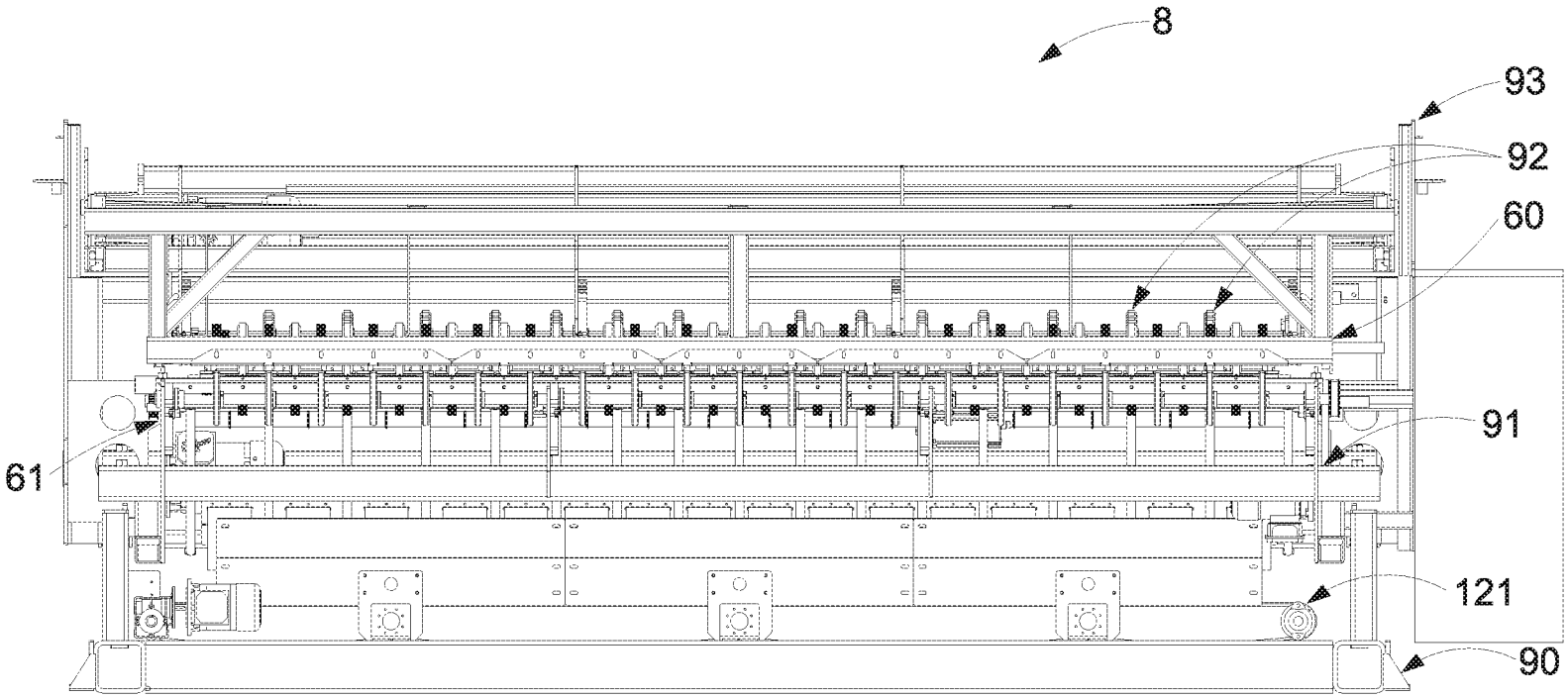

FIG. 27 depicts a side with hidden lines of FIG. 26. This view shows the Diverting Hopper 118 with the Diverted Sheet Board Guide 119 and Diverted Sheet Board Decelerators 120. The Diverted Sheet Board Guide 119 and Diverted Sheet Board Decelerators 120 are interleaved with each other and will reduce the damage to the boxes diverted onto the Cross Conveyor 121 of Base Cross Conveyor Section 90 for discharging the diverted boxes. Damage outside the Normal Production Flow 49 could potentially confuse to operator performing the quality control.

The Lower Board Conveyor Section 91 includes a Lower Board Conveyor Frame 122 with a pair of Lower Wheel Assemblies 123'/123" positioned at the entrance end. The first Lower Wheel Assembly 123' creates a transport surface into the Sheet Quality Control Diverting Section 8. The second Lower Wheel Assembly 123" will either act as a transport surface for Normal Production Flow 49 or act as the primary driving force to divert the boxes when the Diverting system is actively diverting. The Bottom Diverter 77 is in the next downstream position which would normally be in the position shown in FIG. 27 for Normal Production Flow 49. The Bottom Diverter Surface 73 provides support to the boxes and keep the boxes edges and flaps from catching on the Lower Conveyor Nose 48. The Lower Board Conveyor 125 is created with a plurality of Lower Board Conveyor Arms which have a lead in vertical narrow Lower Conveyor Nose 48. The Lower Board Conveyor Arms 126 have a small idler pulley at the entrance end and a larger idler pulley at the exit end. A Lower Drive Roller 127 is positioned such when the Lower Board Conveyor Arms 126 are mounted a belt path is created for the Lower Board Conveyor Belt 128. This provides most of the transportation distance in the through machine direction.

An alternate configuration of the Lower Board Conveyor Section 91 would be to replace the Lower Board Conveyor Arms 126 with a series of Lower Wheel Assemblies 123 positioned to oppose the Upper Wheel Assemblies that are located on the Upper Board Conveyor Section 92.

The Upper Board Control Section 92 includes an Upper Board Control Frame 131 with an Upper Wheel Assembly 129' positioned at the entrance end. The Upper Wheel Assembly 129' will either act as a board control surface for Normal Production Flow 49 or work with the opposing Lower Board Conveyor Section 91 Lower Wheel Assembly as the primary driving force to divert the Boxes when the Diverting system is actively diverting. The Top Electric Cam Diverter 60 is in the next downstream position which would normally be in the position shown in FIG. 27 for Normal Production Flow 49. The Top Diverter Surface 72 is normally not in contact with the boxes except in the case of flutter or bent flaps. The Top Diverter Surface 72 and the Bottom Diverter Surface 73 create the Diverting Funnel 66. However, the Top Diverter 76 is operatively mounted to the Upper Clam Shell Frame 94. This allows the Upper Board Control Frame 131 to move and increase the nip without changing the relationship between the Top Diverting Surface 72 and the Lower Conveyor Nose 48. It would be a viable alternative to mount the Top Electric Cam Diverter 60 to the Upper Board Control Frame 131 however the engineering design would have to account for the adjustment in nip affecting the size of the Diverting Funnel 66 and the relationship to the Lower Conveyor Nose 48. The remaining distance for the rest of the Upper Board Control Section 92 is a combination of Upper Wheel Assemblies 129" and Scrap Scrapers 95. The Upper Wheel Assemblies 129" are shown as powered in order to match the Diverter Line Speed 16 set by the Lower Board Conveyor Belts 128. An alternate configuration would be to simply distribute idling dangling roller wheels that ride on the Lower Board Conveyor Belts 128 in order to provide the upper board control.

Figure 32:
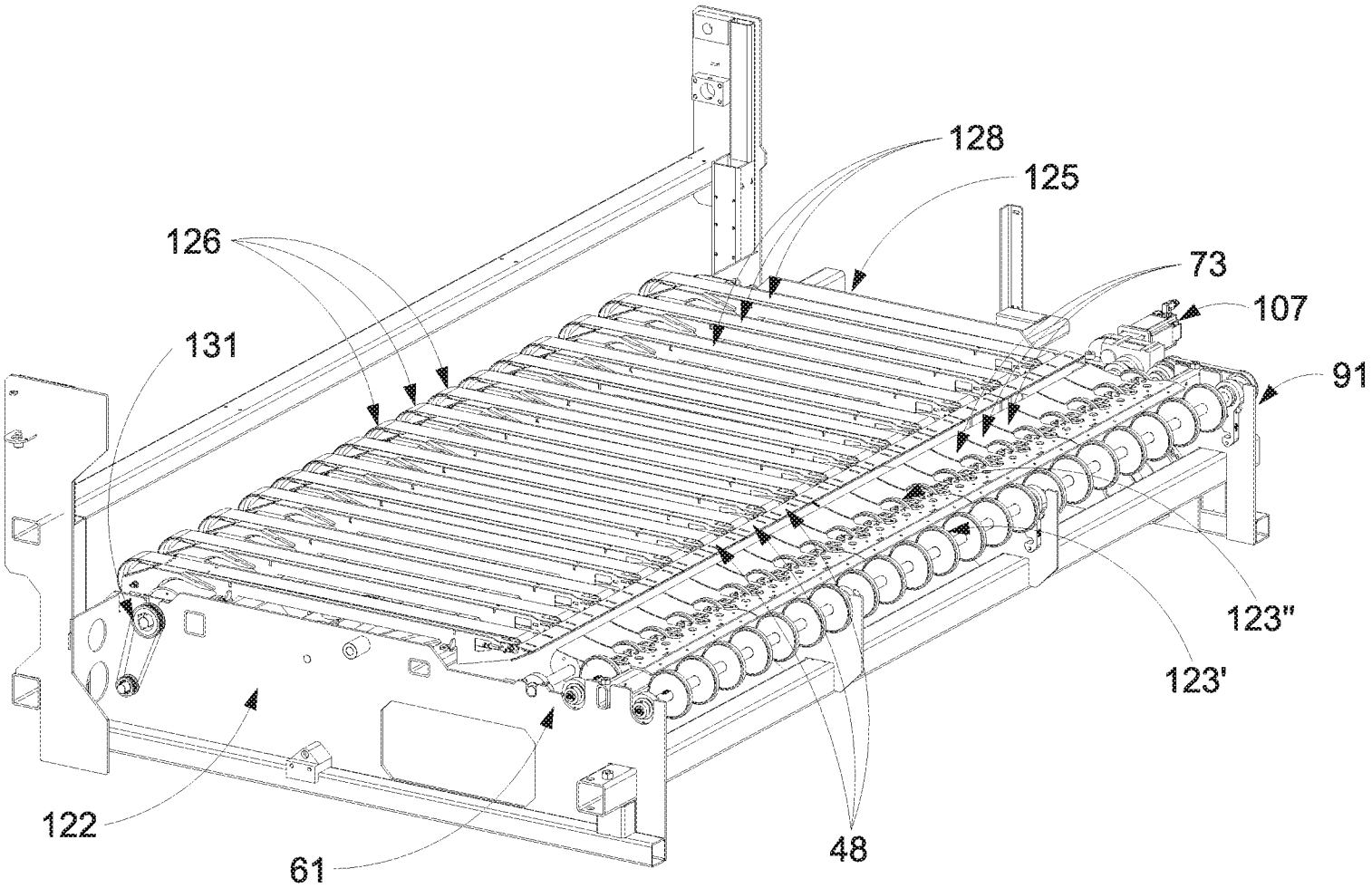
FIG. 32 depicts a perspective view of a Lower Board Conveyor Section 91 including an embodiment of a Bottom Electric Cam Diverter 61.

FIG. 32 depicts a perspective view of a Lower Board Conveyor Section 91 including an embodiment of a Bottom Electric Cam Diverter 61. This view shows the Lower Board Conveyor Frame 122 and the drive system for the Bottom Electric Cam Diverter 61 and the Lower Board Conveyor Belts 128. The clearance between the Bottom Diverting Surface 73 and the Lower Conveyor Nose 48 is also shown.

Figure 33:
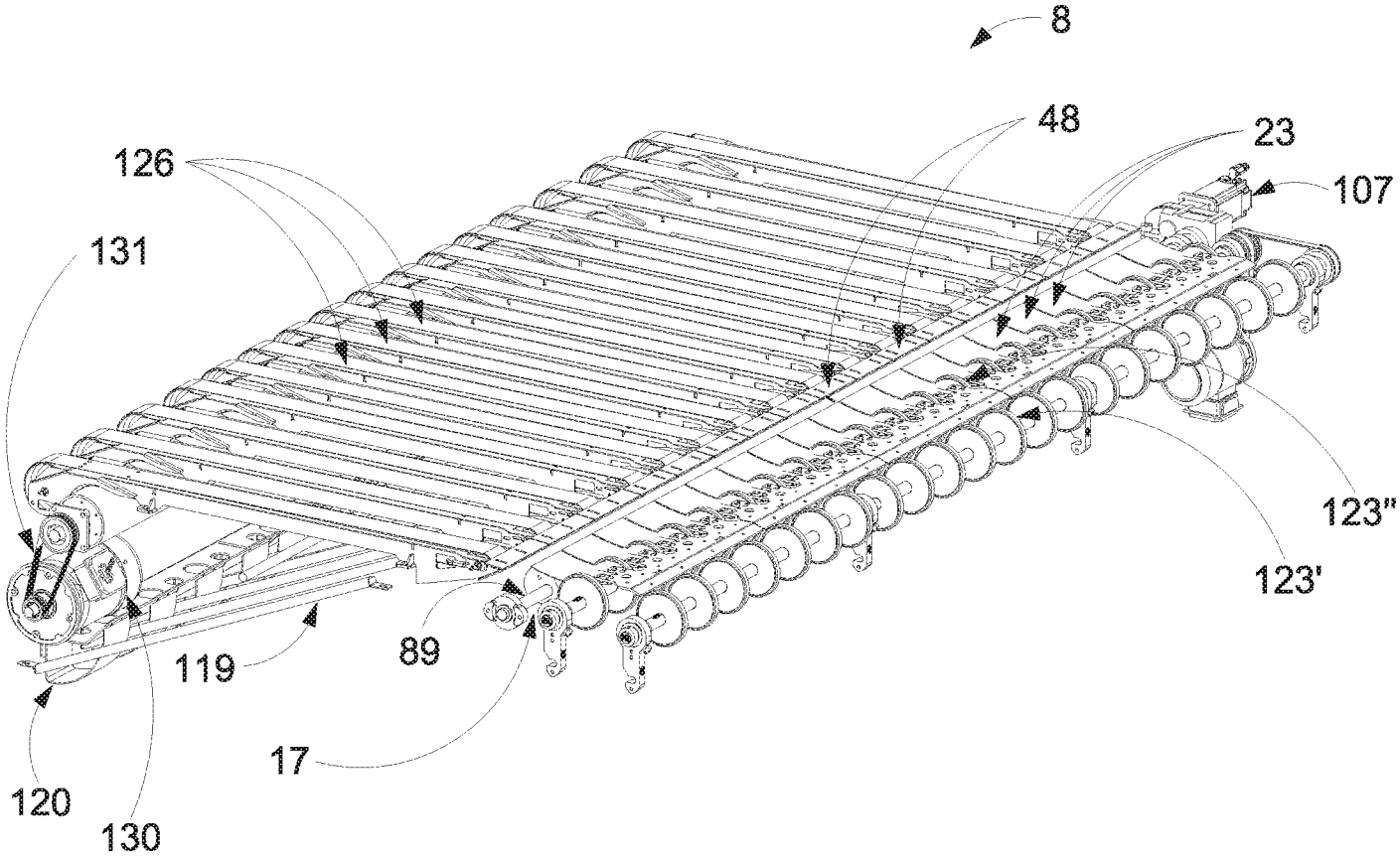
FIG. 33 is a further simplified view of FIG. 32.

FIG. 33 is a further simplified view of FIG. 32.

Figure 34:
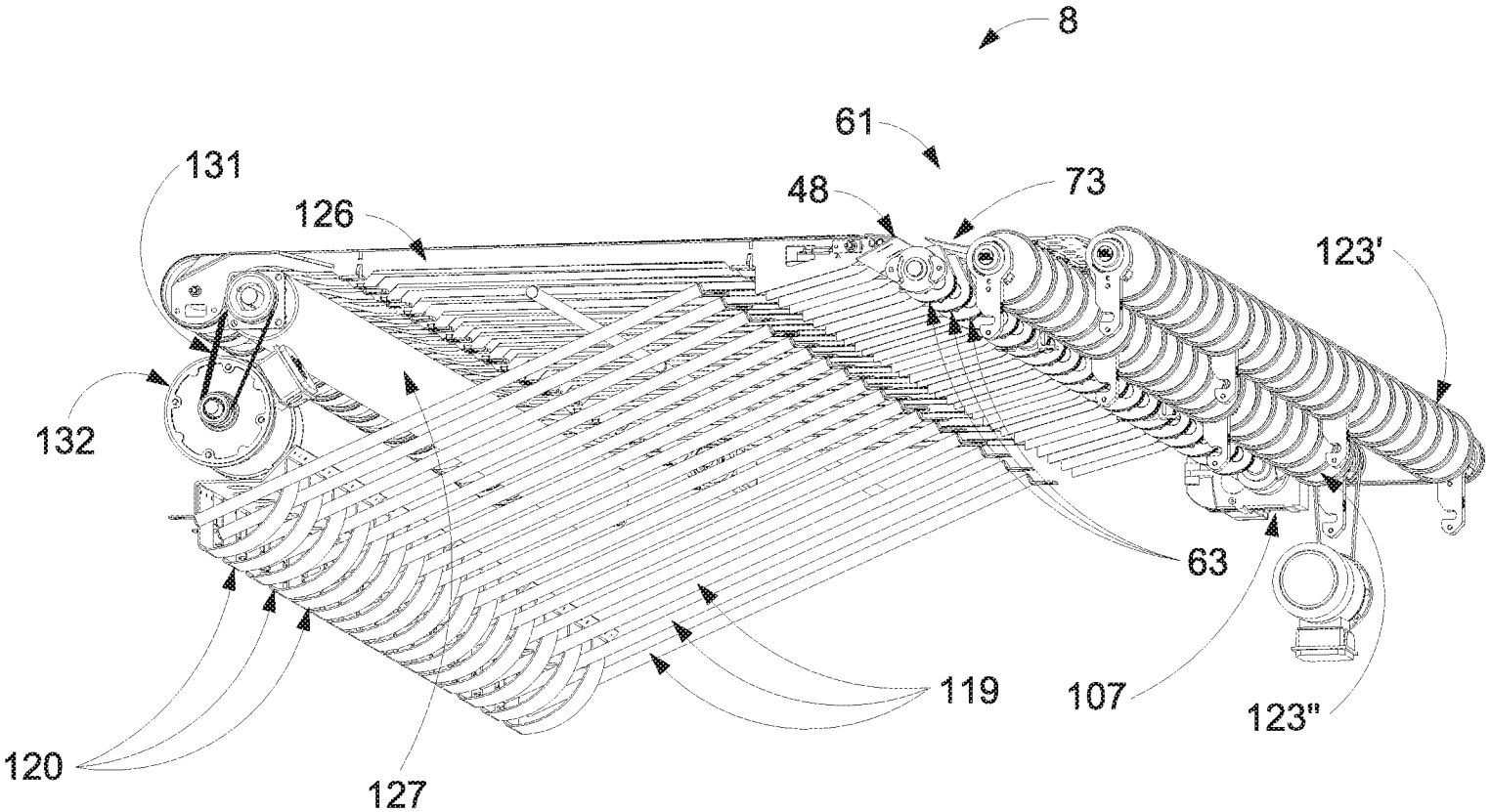
FIG. 34 depicts a perspective view of a simplified view of the Lower Board Conveyor Section 91.

FIG. 34 depicts a perspective view of a simplified view of the Lower Board Conveyor Section 91 with just a pair of Lower Wheel Assemblies 123'/123", the Bottom Electric Cam Diverter 61, a plurality of Lower Board Conveyor Arms 126, a Lower Drive Roller 127, the Lower Drive Roller Motor 132 and the Lower Driver Roller Belt Drive 133, the Diverted Sheet Board Guides 119 and the Diverted Sheet Board Decelerators 120.

Figure 35:
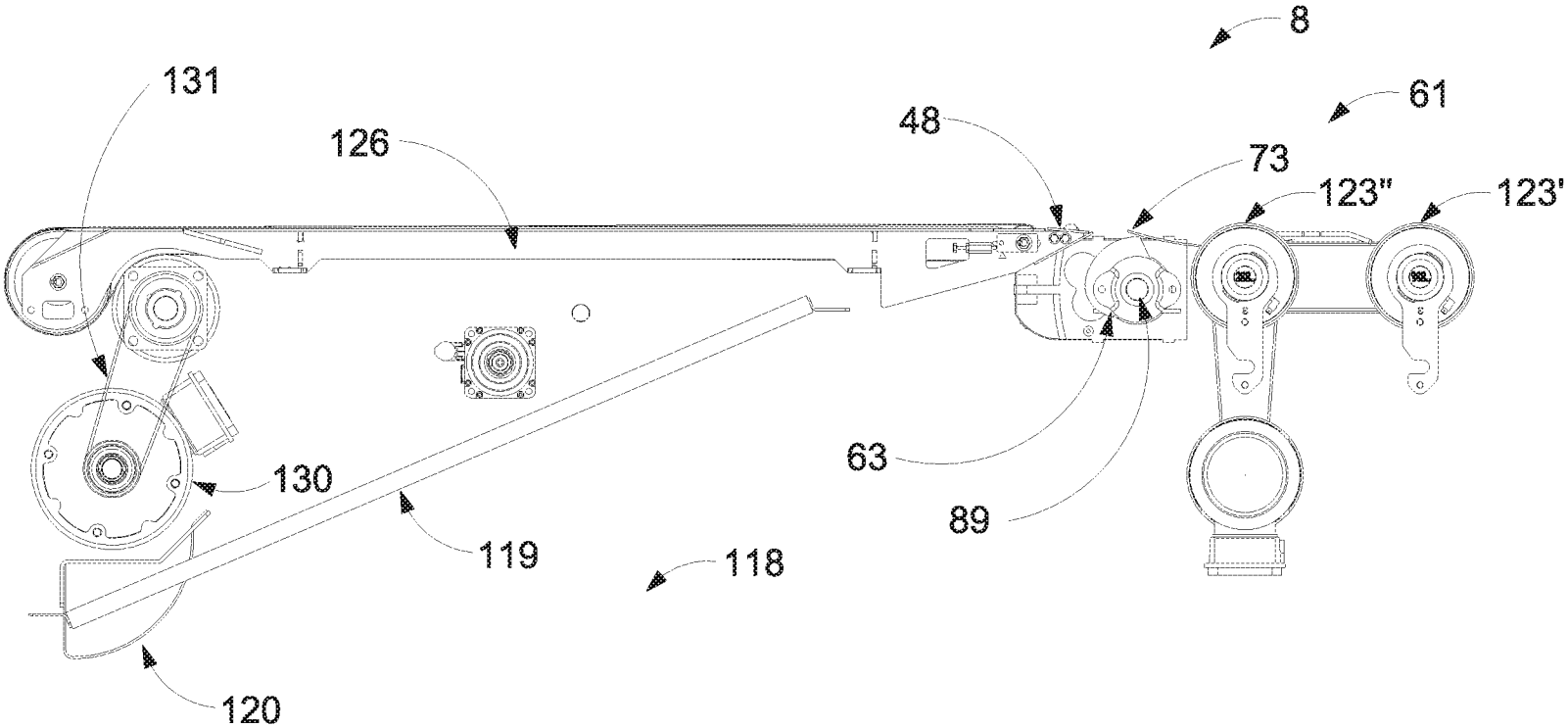
FIG. 35 depicts a side view of FIG. 34

FIG. 35 depicts a side view of FIG. 34.

Figure 36:
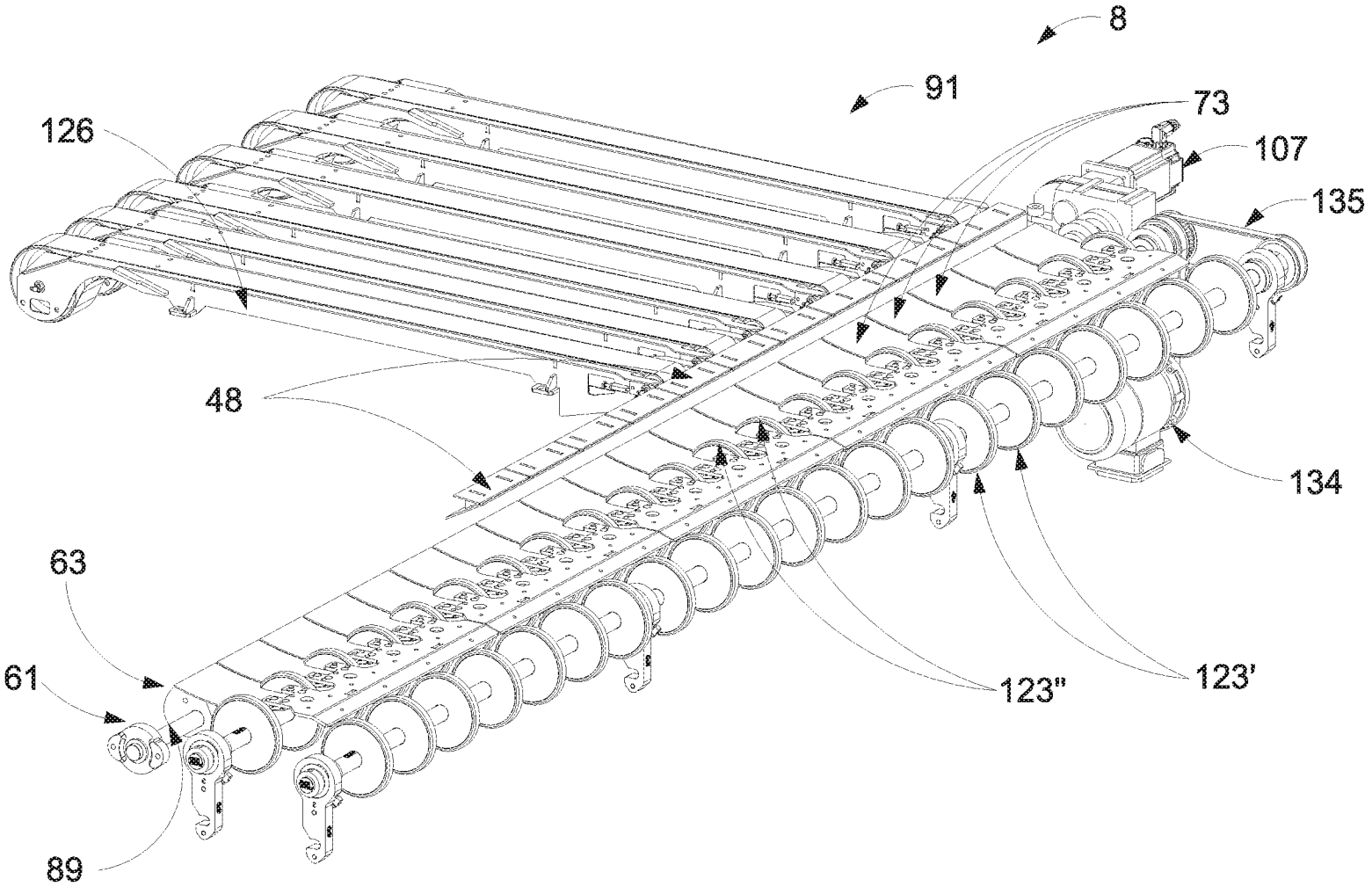
FIG. 36 depicts a first perspective view of a simplified view of the Lower Board Conveyor Section 91.
Figure 37:
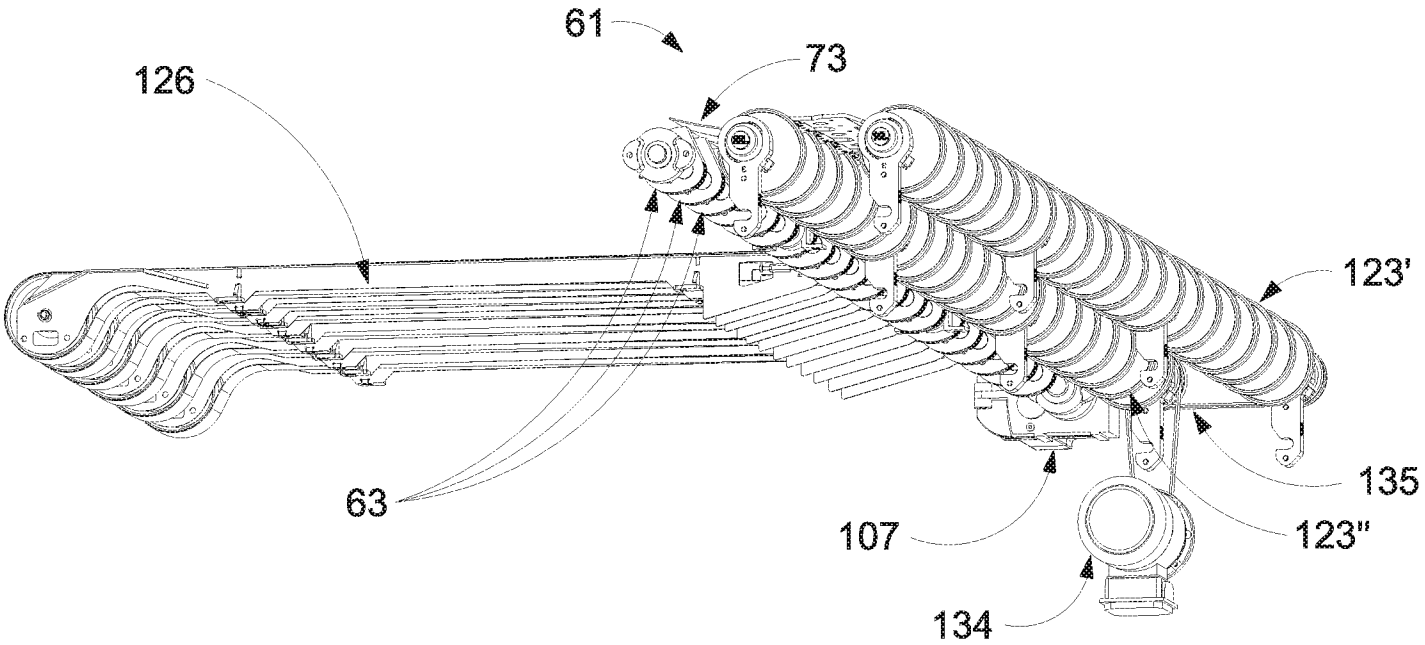
FIGS. 37, 38, 39 and 40 depicts a second, third and fourth perspective view and side view of the elements in FIG. 36
Figure 38:
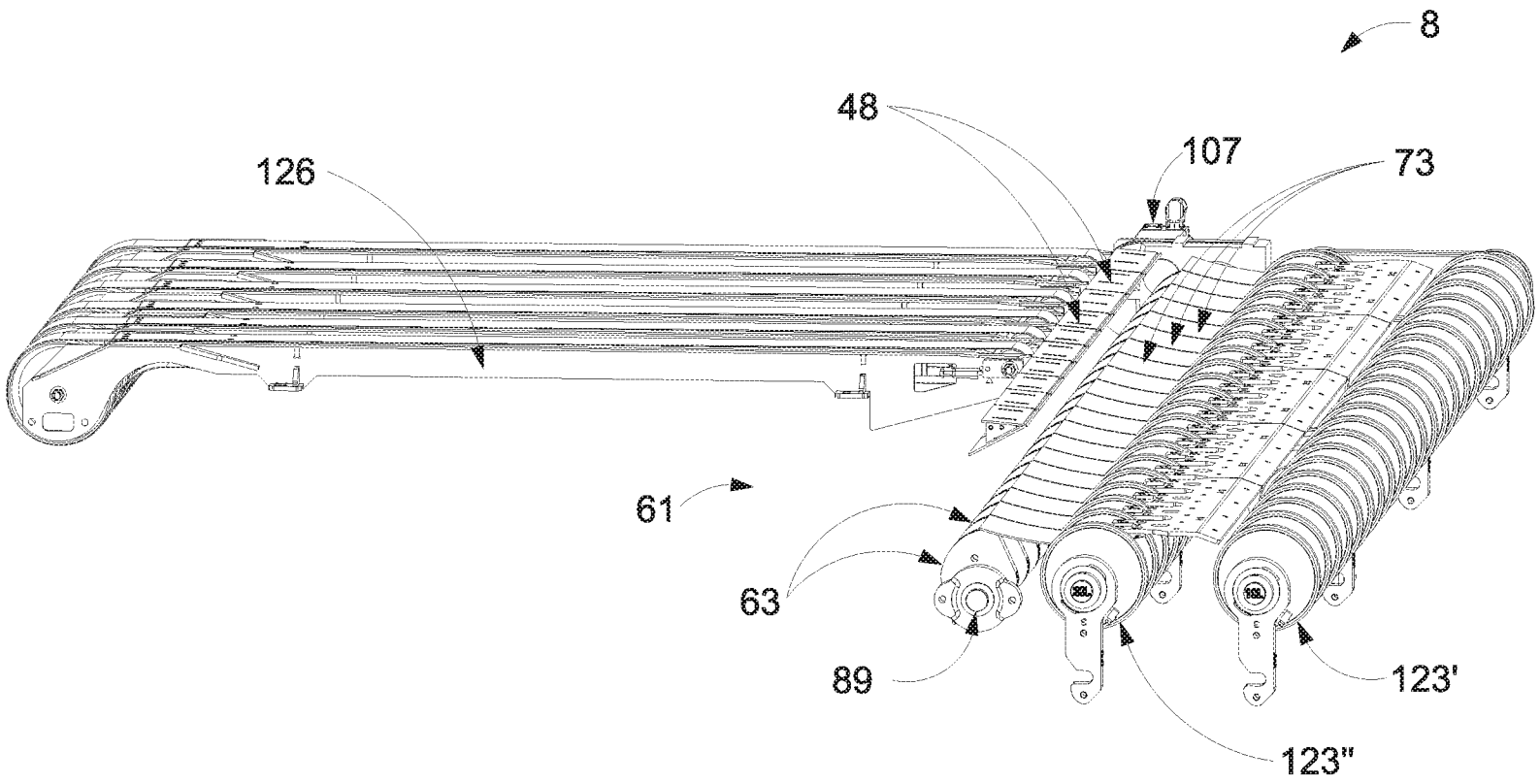
Figure 39:
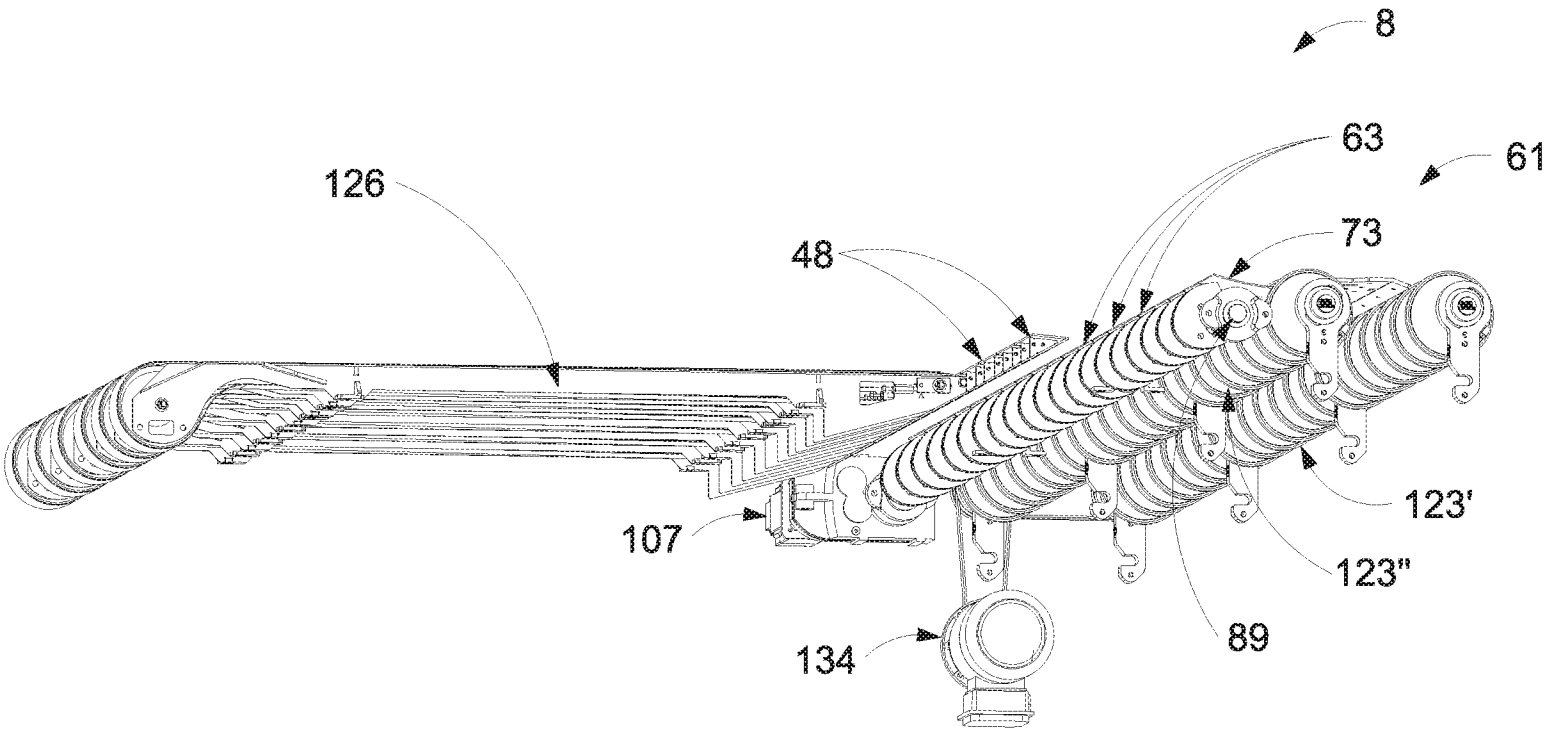
Figure 40:
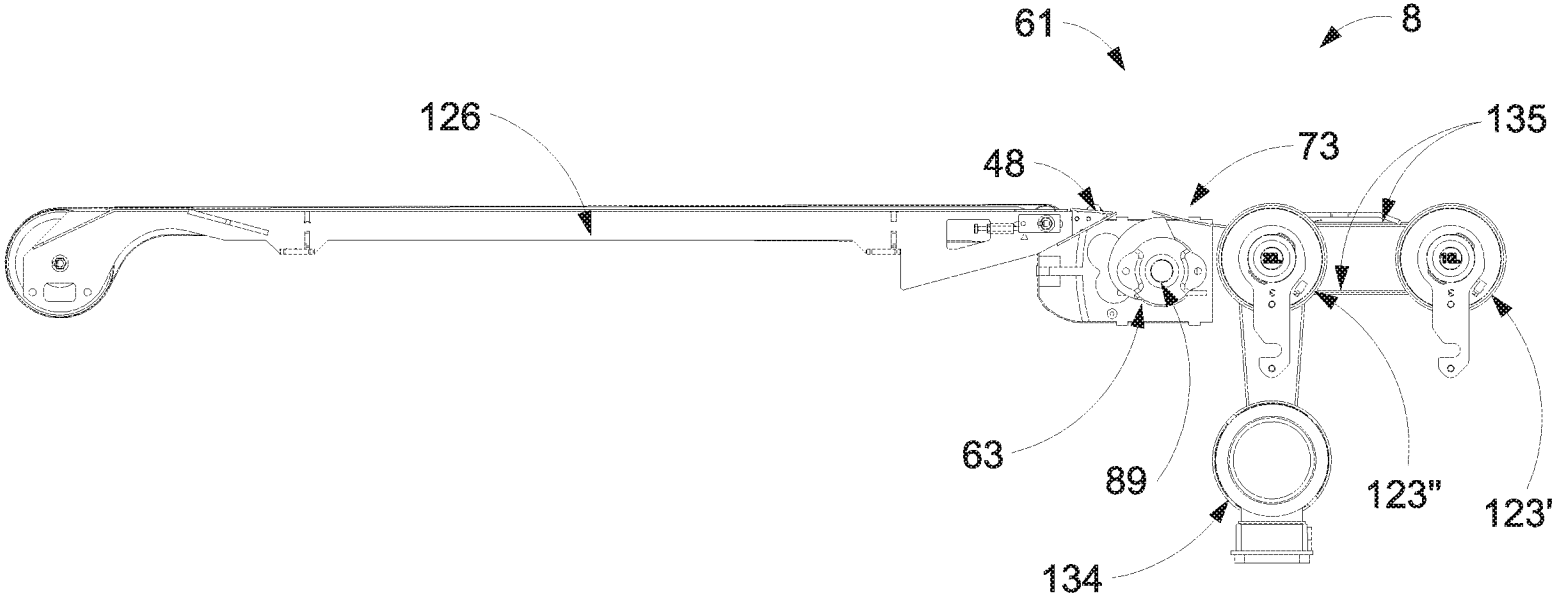

FIG. 36 depicts a first perspective view of a simplified view of the Lower Board Conveyor Section 91 with just a pair of Lower Wheel Assemblies 123'/123", the Bottom Electric Cam Diverter 61, a partial plurality of Lower Board Conveyor Arms 126, the Lower Conveyor Noses 48, the Lower Wheel Assemblies Motor 134 and the Lower Wheel Assemblies Belt Drive 135.

FIGS. 37, 38, 39 and 40 depicts a second, third and fourth perspective view and side view of the elements in FIG. 36

Figure 41:
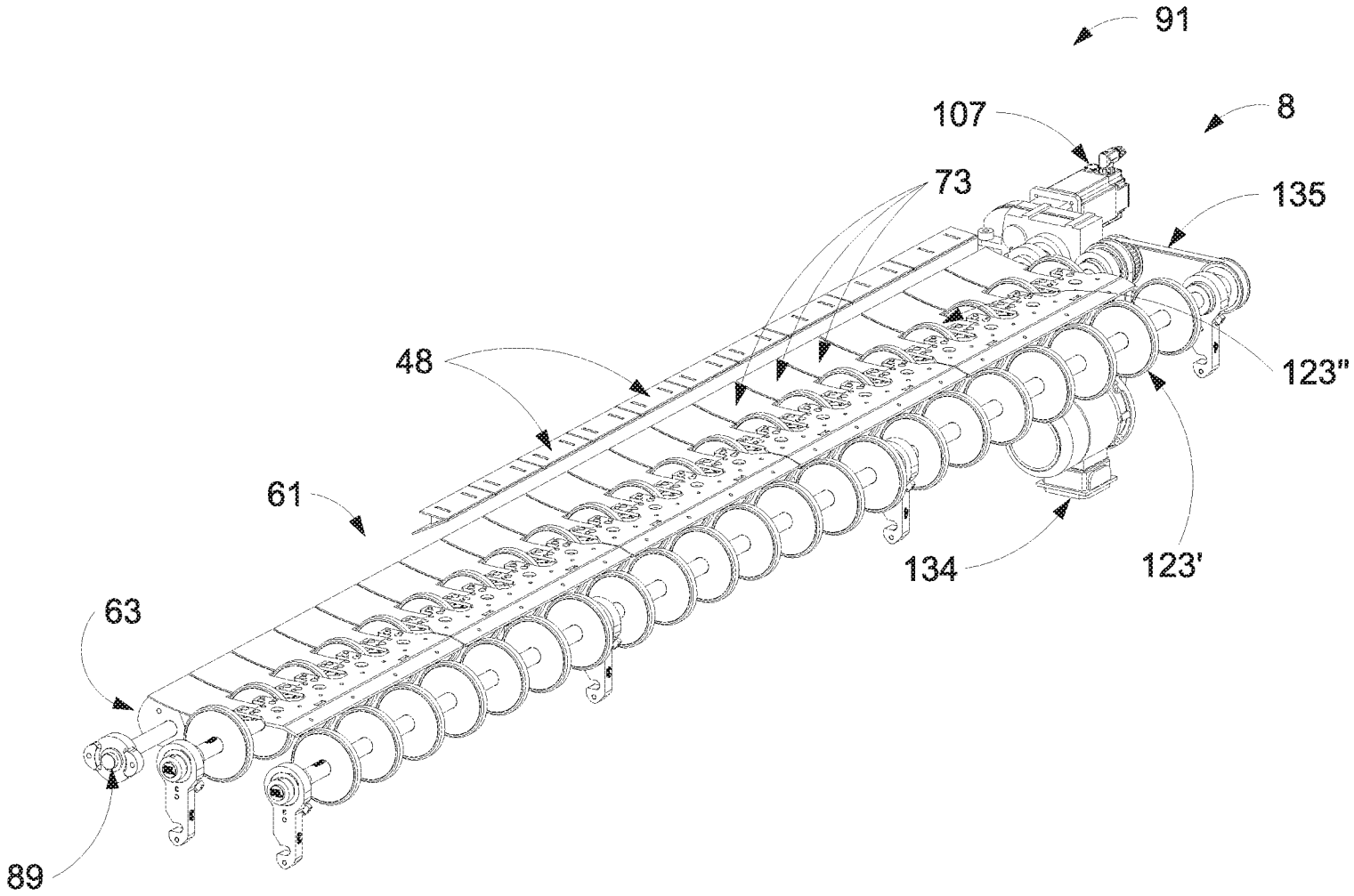
FIGS. 41, 42 and 43 depicts two perspective view and a side view of a simplified view of FIG. 36.
Figure 42:
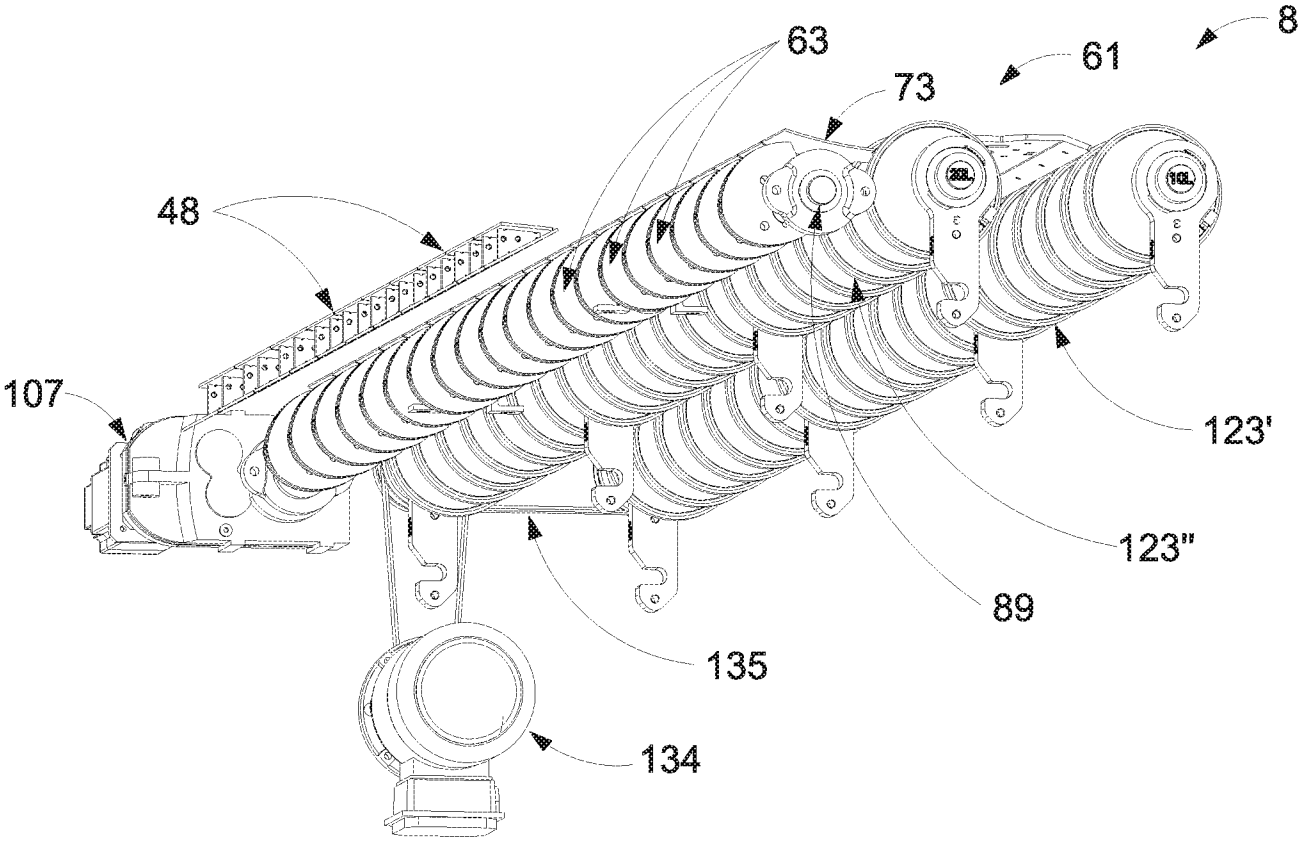
Figure 43:
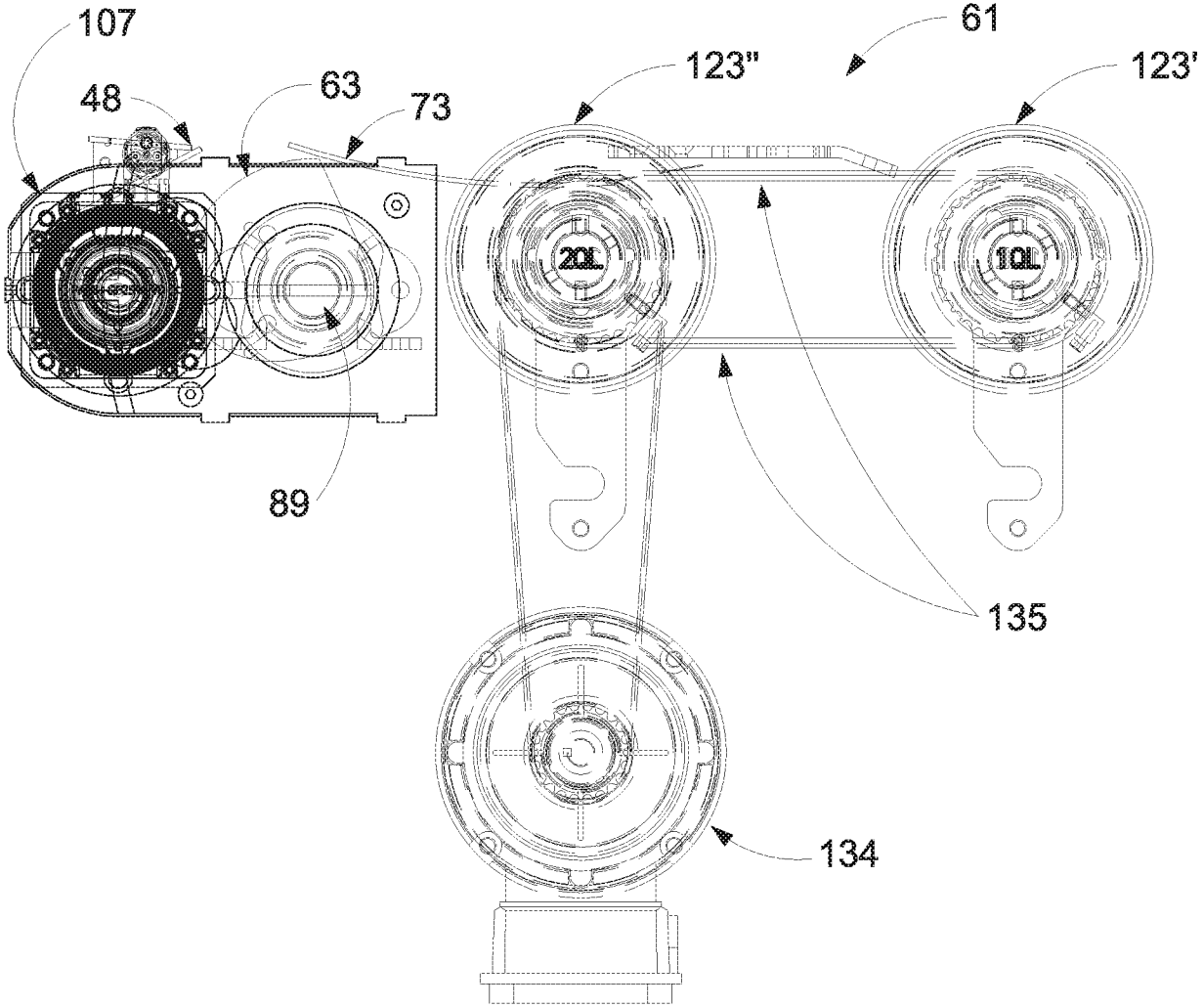

FIGS. 41, 42 and 43 depicts two perspective view and a side view of a simplified view of FIG. 36. It is the Lower Board Conveyor Section 91 with just a pair of Lower Wheel Assemblies 123'/123", the Bottom Electric Cam Diverter 61, the Bottom Cam Drive Shaft 89, the Bottom Diverter Cams 63, the Bottom Cam Motor 107 and the Lower Conveyor Noses 48.

Figure 44:
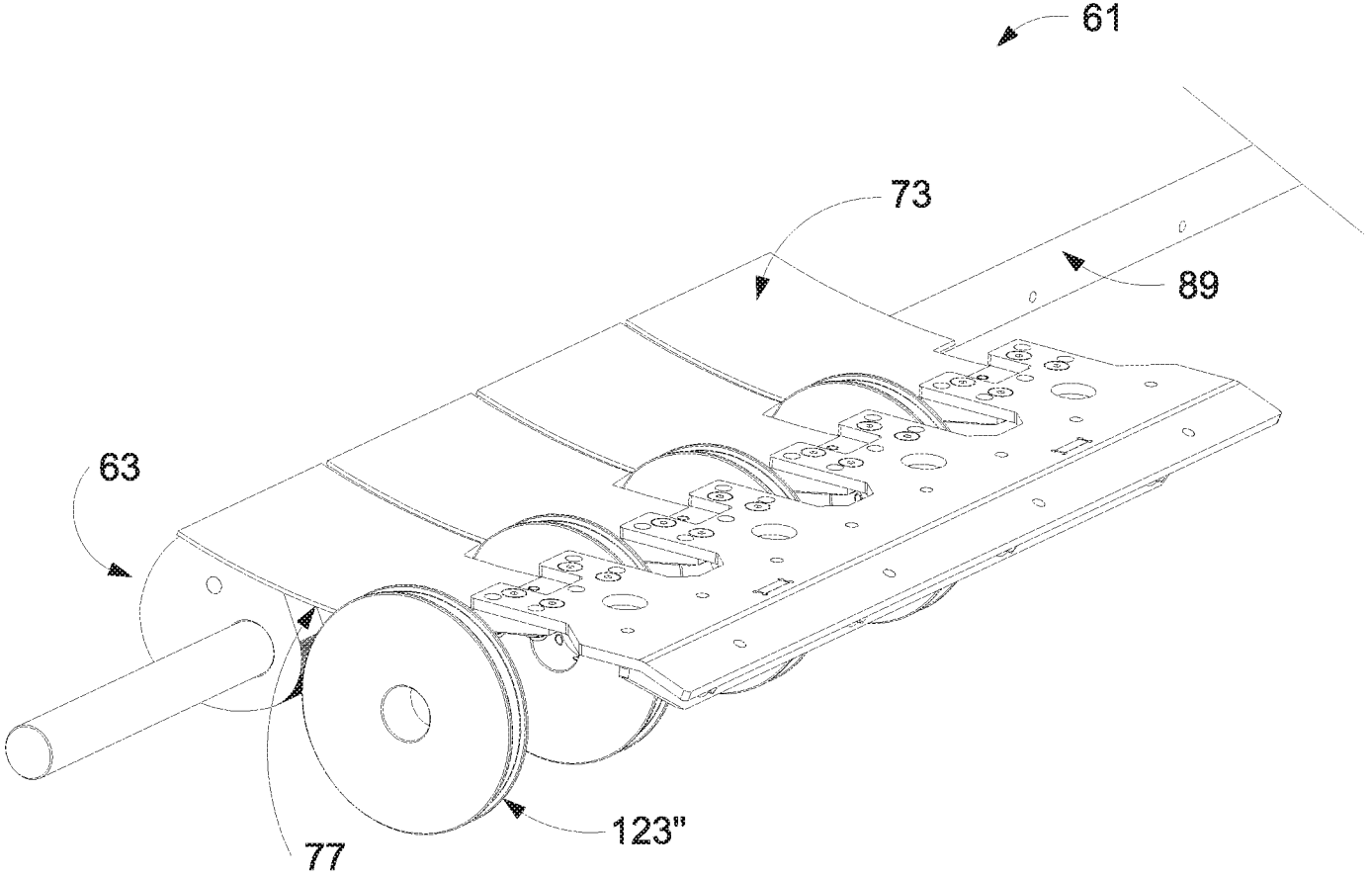
FIGS. 44, 45 and 46 depicts two perspective view and a side view of a simplified version of the Bottom Electric Cam Diverter 61.
Figure 45:
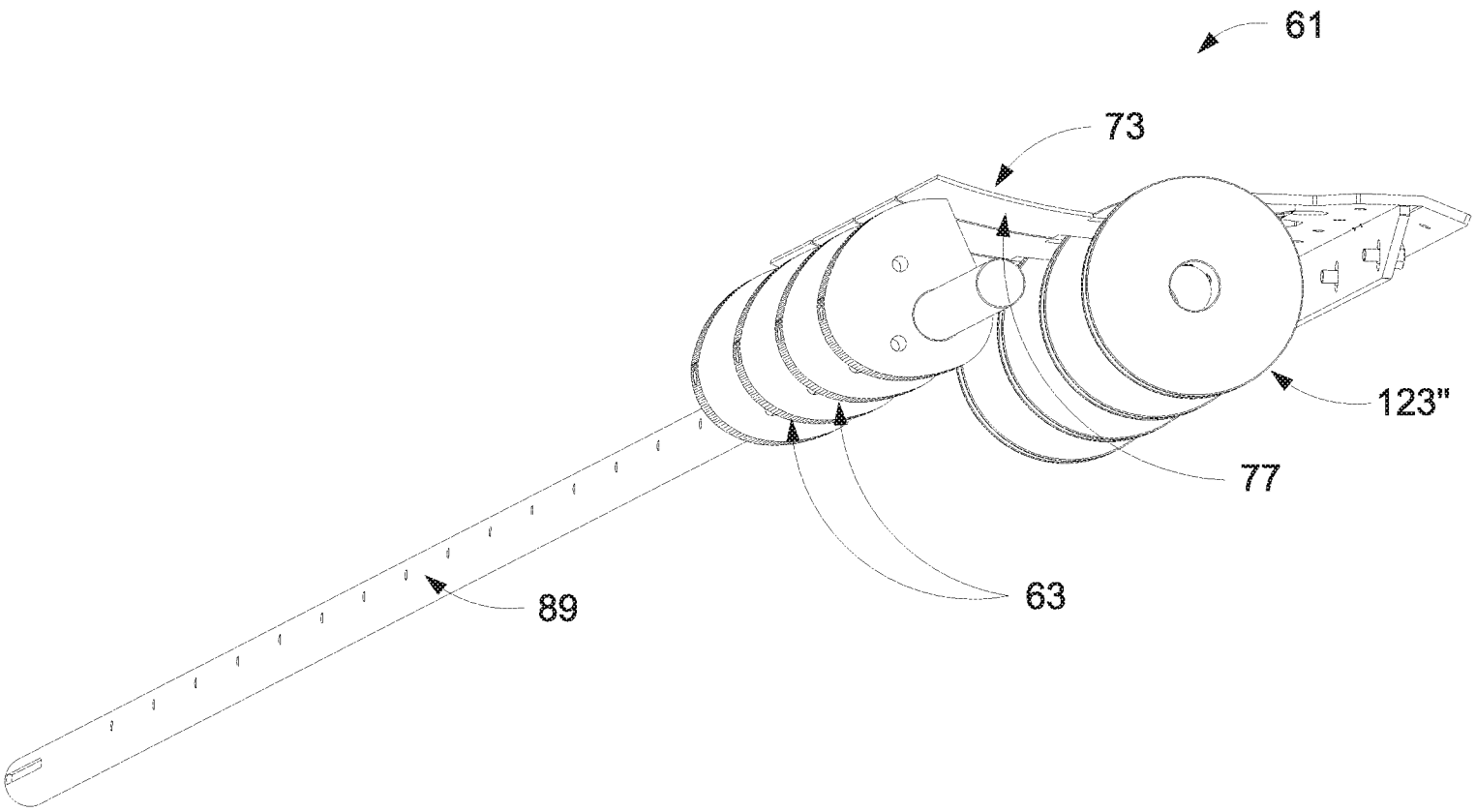
Figure 46:
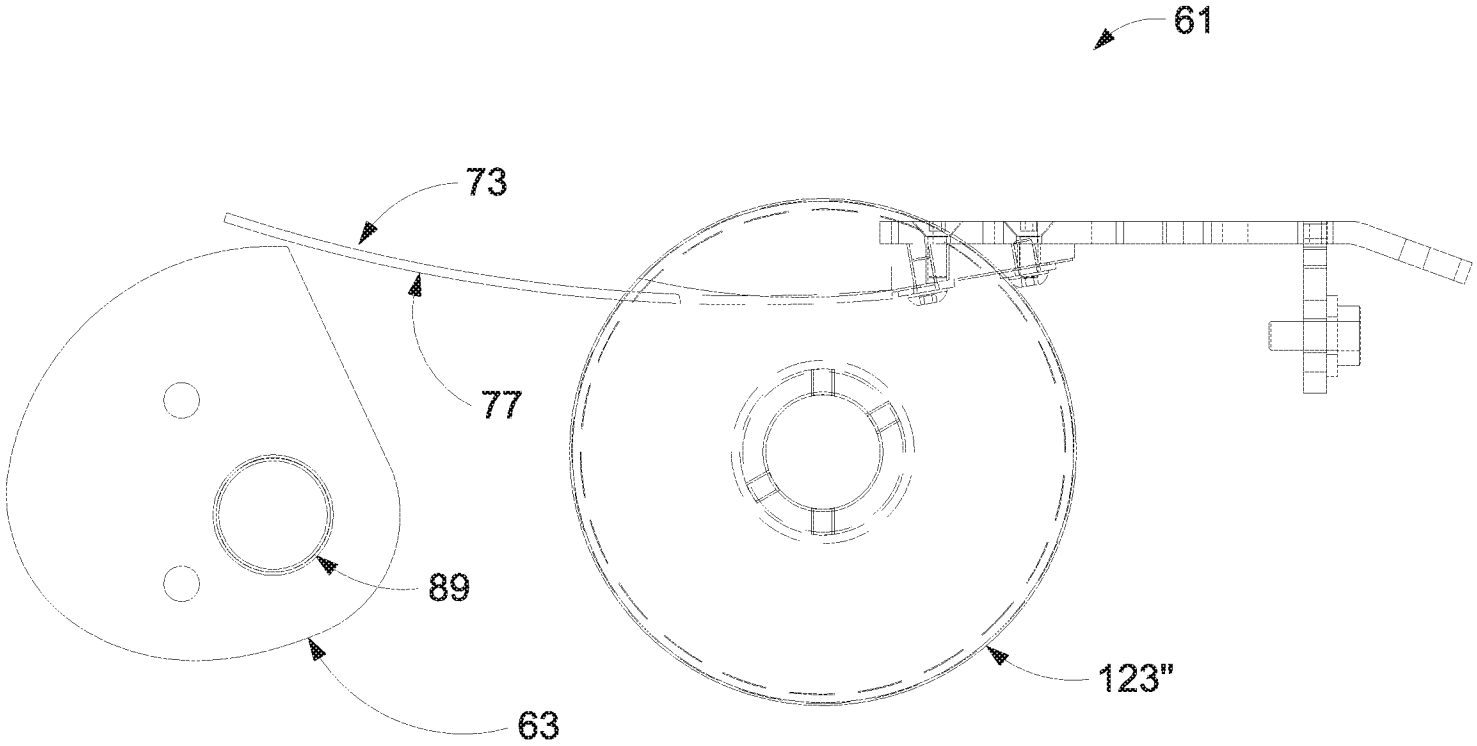

FIGS. 44, 45 and 46 depicts two perspective view and a side view of a simplified version of the Bottom Electric Cam Diverter 61 with partial of wheels from one of the Wheel Assemblies 123', the Bottom Cam Drive Shaft 89, the Bottom Diverter Cams 63, the Bottom Cam Motor 107 and a partial of the Bottom Diverters 77

Figure 47:
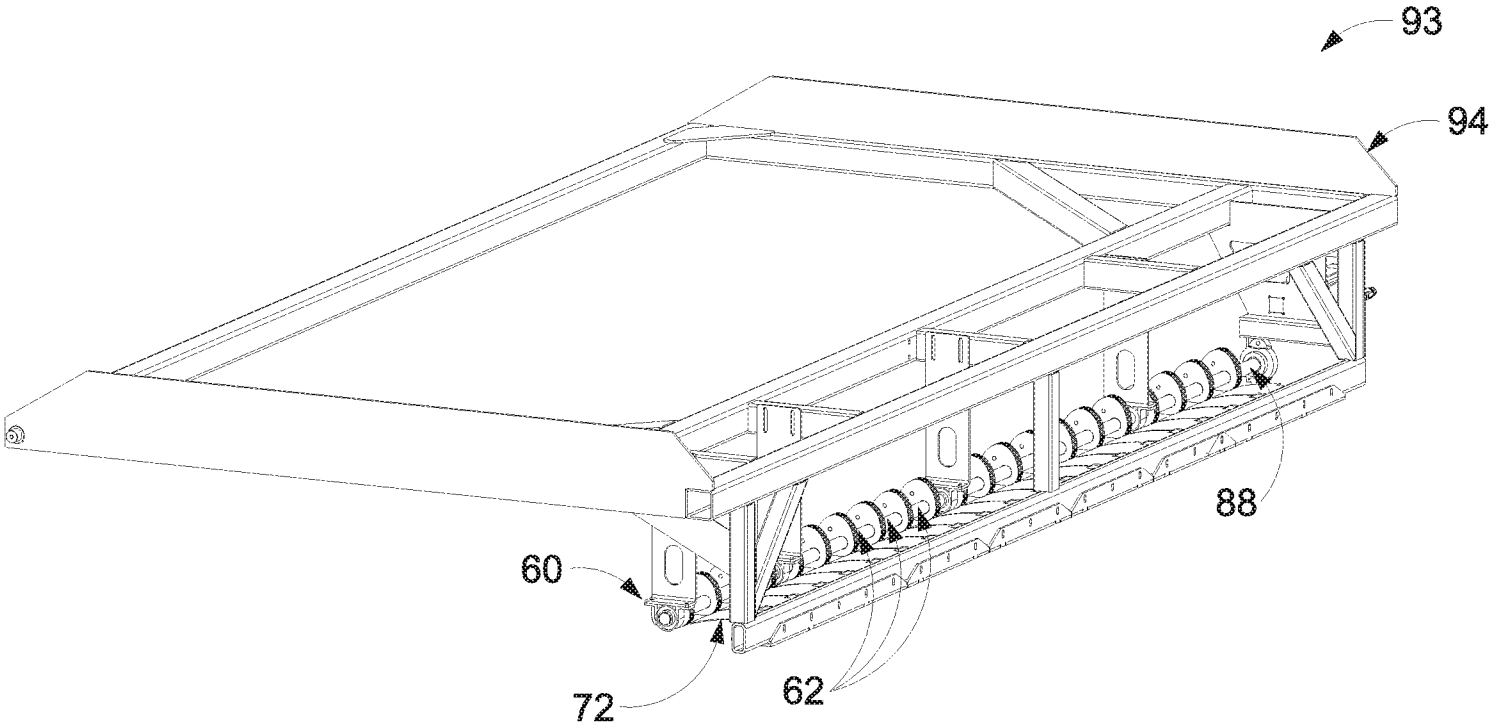
FIGS. 47, 48 and 49 depicts two perspective view and a side view of a simplified of the Upper Divert Section 93.
Figure 48:
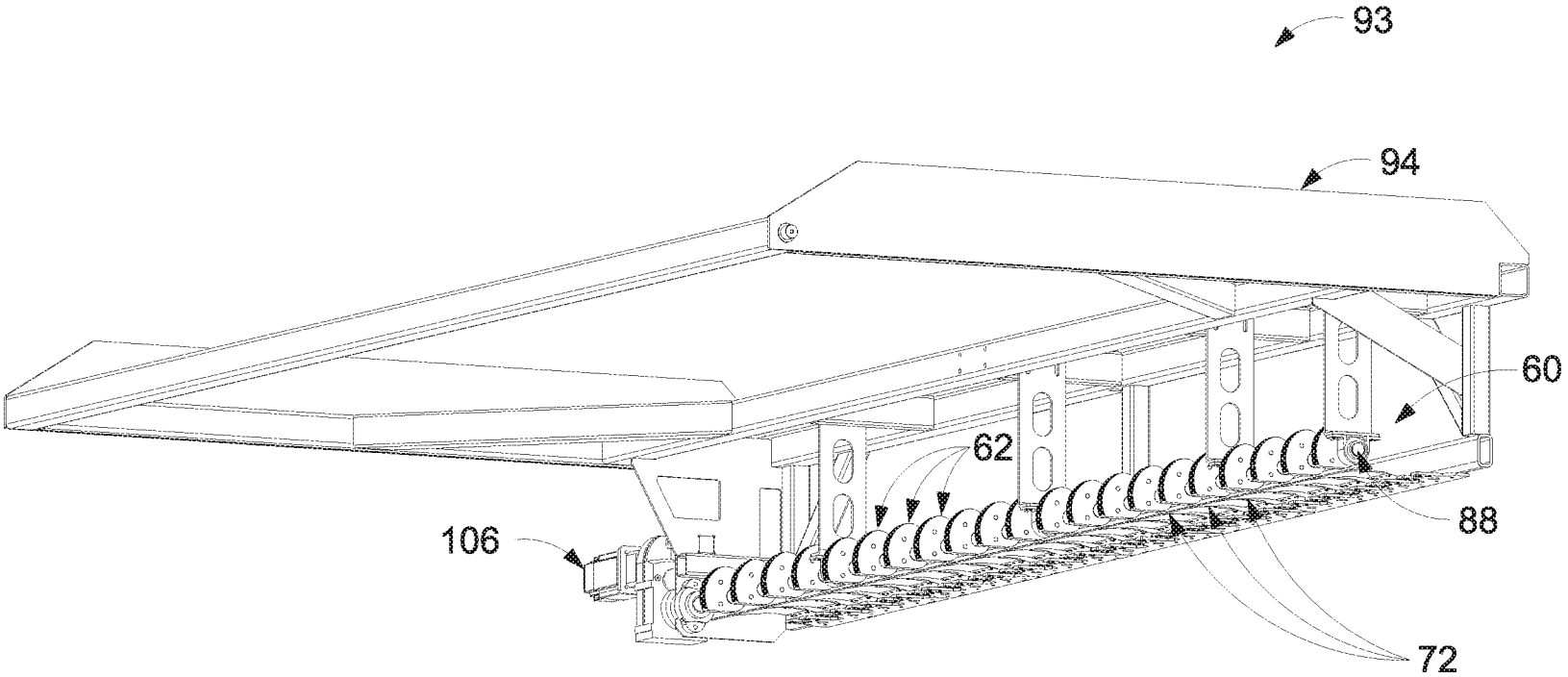
Figure 49:
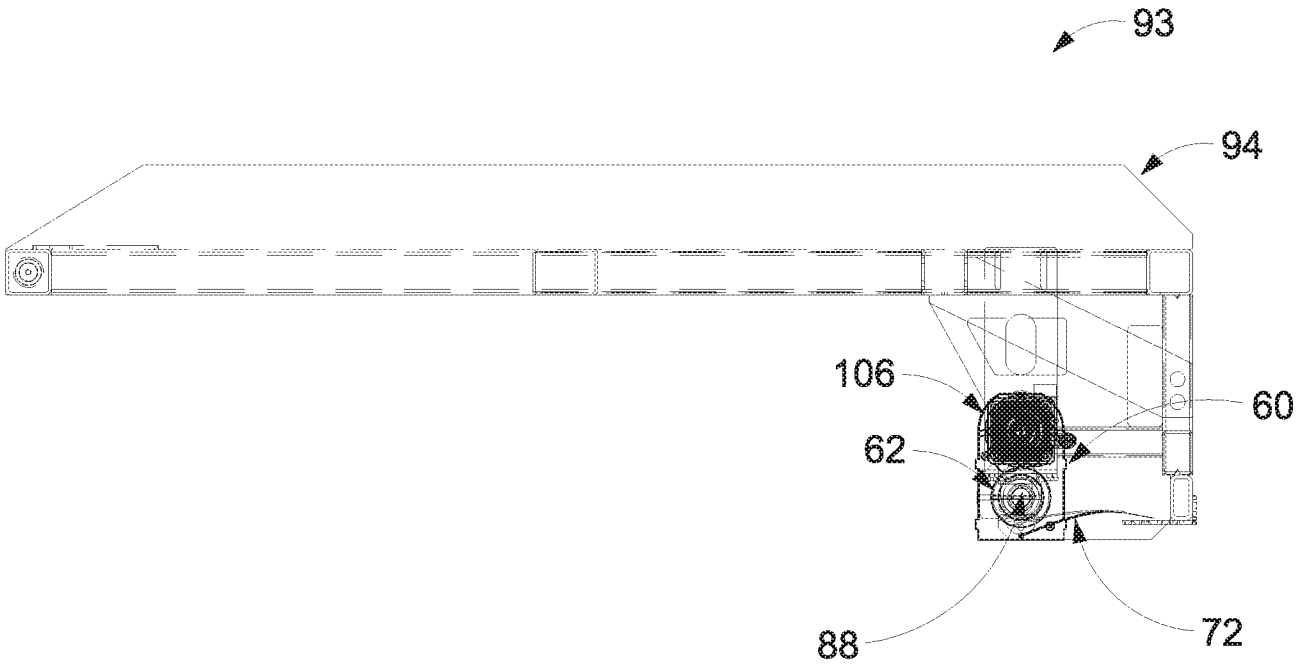

FIGS. 47, 48 and 49 depicts two perspective view and a side view of a simplified of the Upper Divert Section 93 with an Upper Clam Shell Frame 94, the Top Electric Cam Diverter 60, the Top Cam Drive Shaft 88, the Top Diverter Cams 62, and the Top Cam Motor 106.

Figure 50:
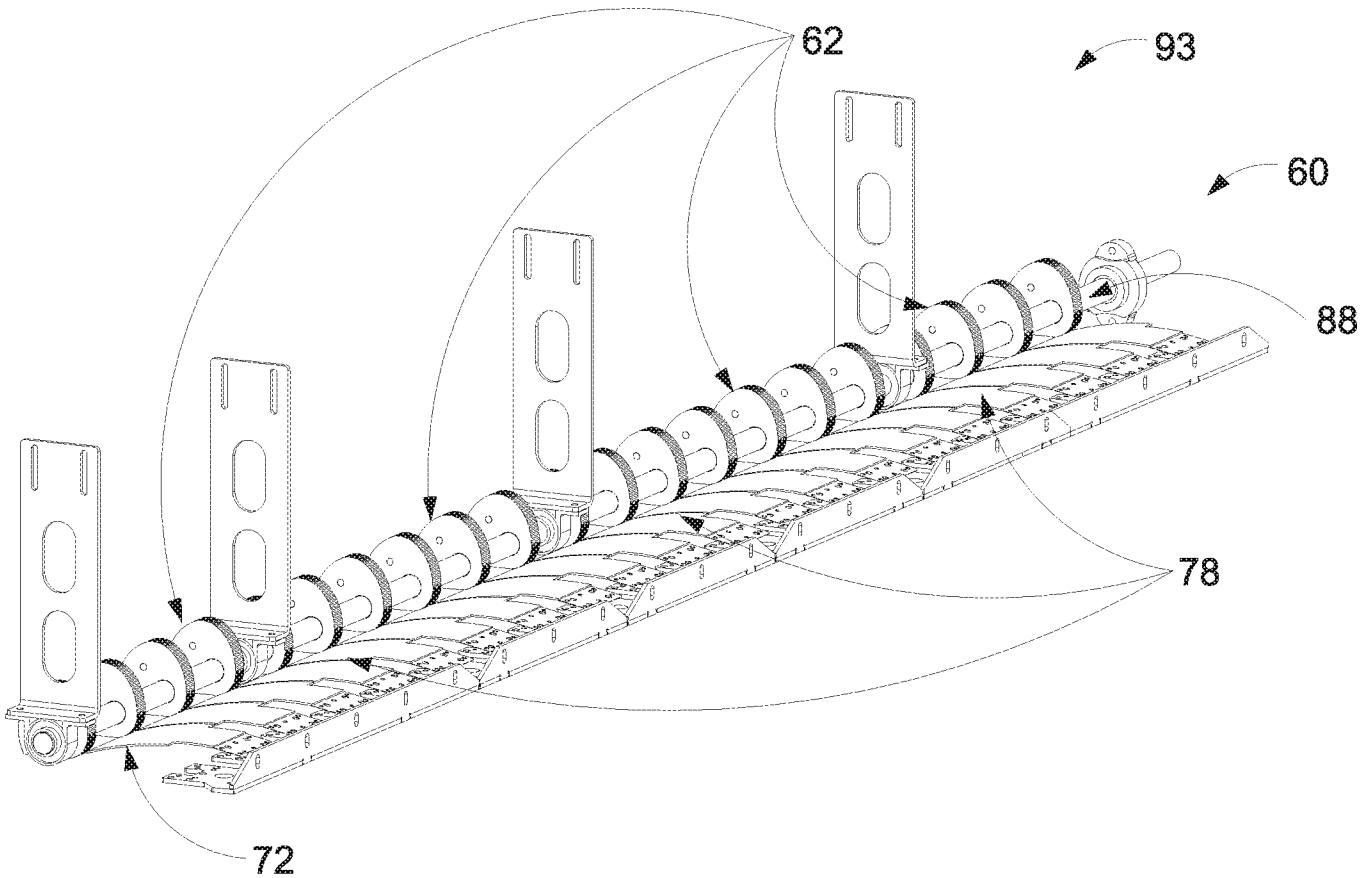
FIGS. 50 and 51 depicts two perspective view of a simplified of the Upper Divert Section 93.
Figure 51:
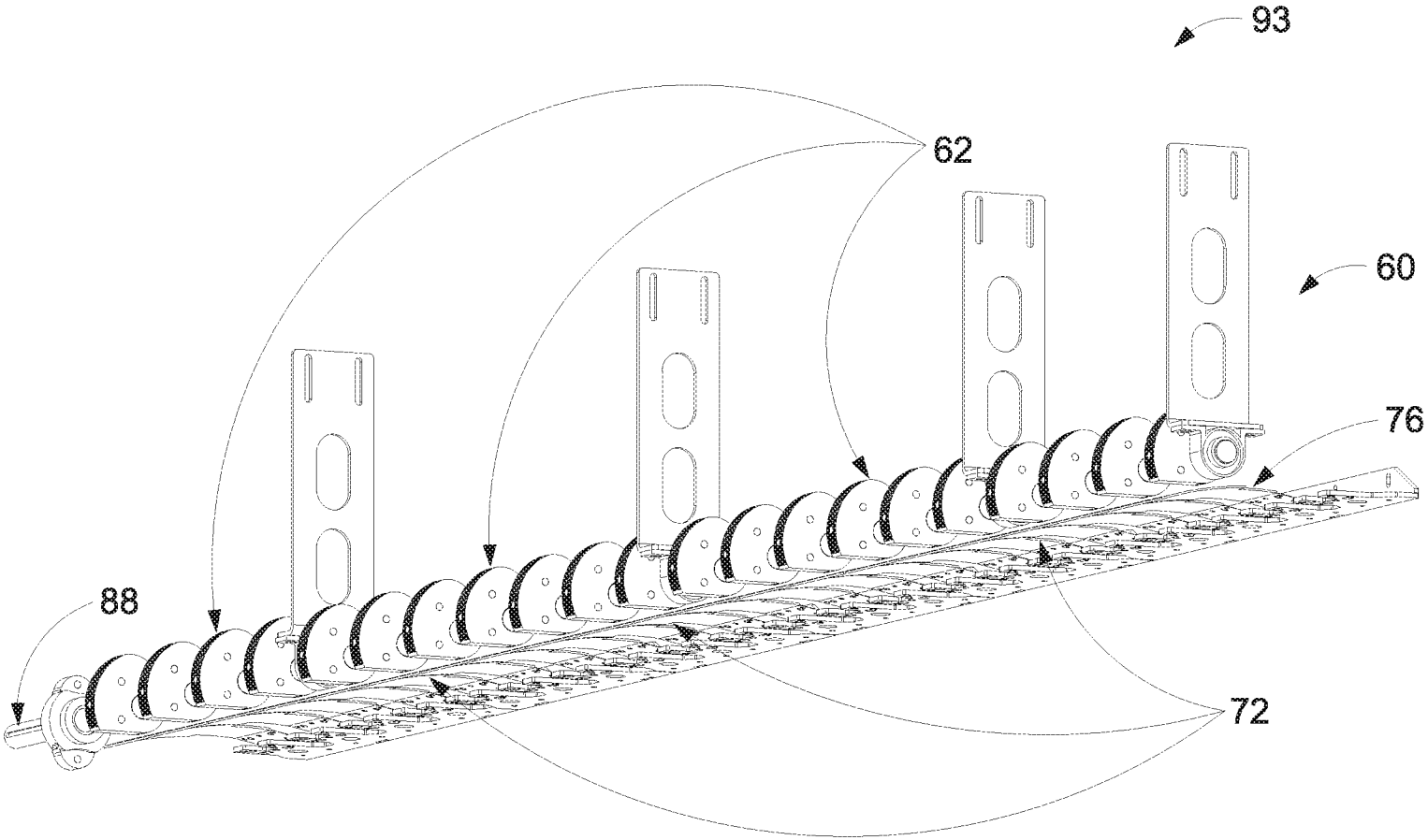

FIGS. 50 and 51 depicts two perspective view of a simplified of the Upper Divert Section 93, the Top Electric Cam Diverter 60, the Top Cam Drive Shaft 88, and the Top Diverter Cams 62.

Figure 52:
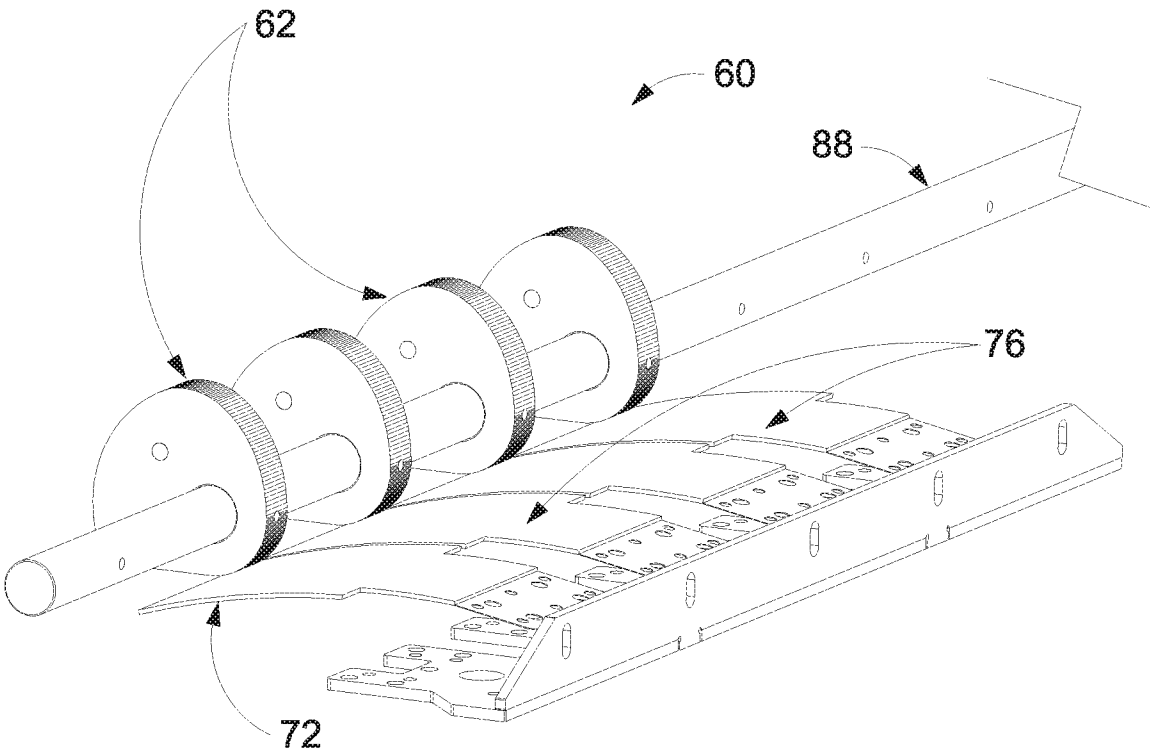
FIGS. 52, 53 and 54 depicts two perspective view and a side view of a simplified version of the Top Electric Cam Diverter 60, the Top Cam Drive Shaft 88, the Top Diverter Cams 62 and a partial of the Top Diverters 76
Figure 53:
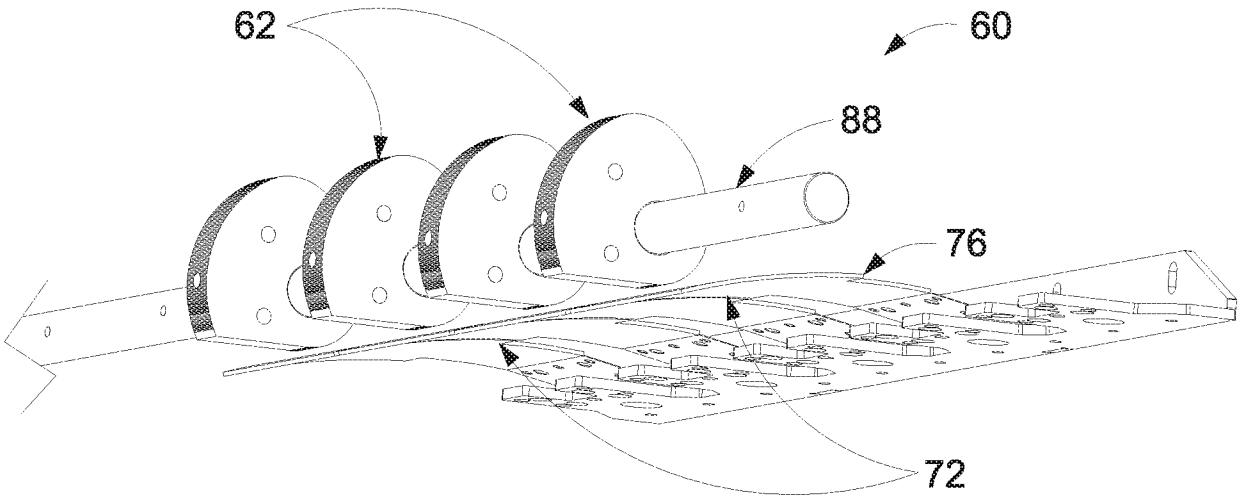
Figure 54:
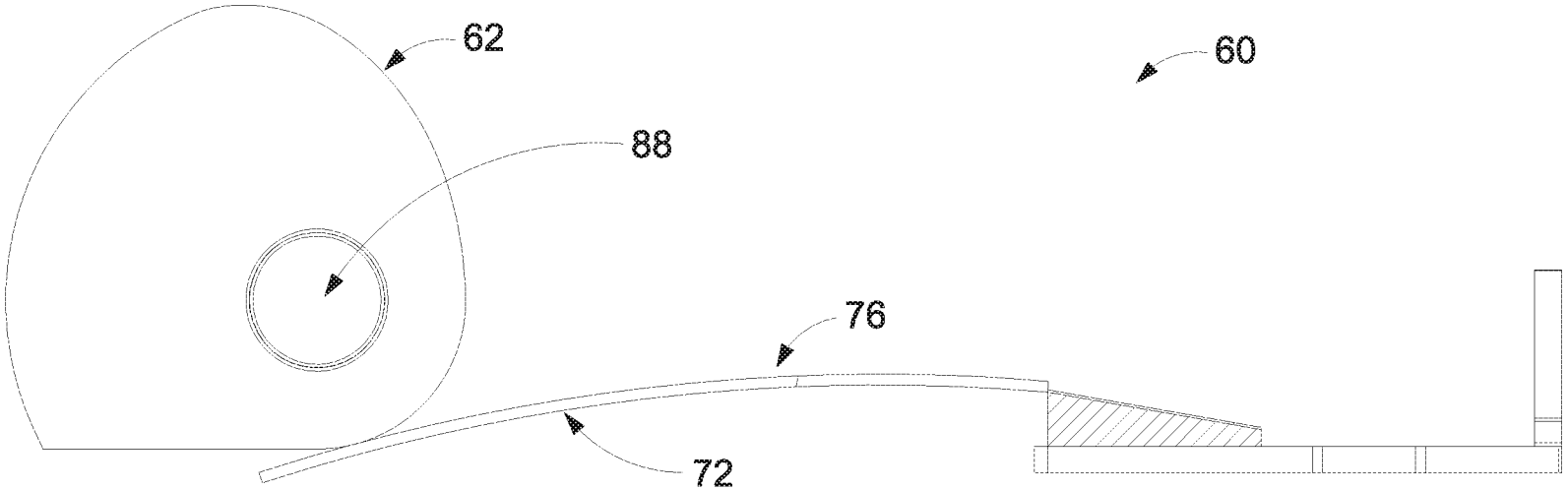

FIGS. 52, 53 and 54 depicts two perspective view and a side view of a simplified version of the Top Electric Cam Diverter 60, the Top Cam Drive Shaft 88, the Top Diverter Cams 62 and a partial of the Top Diverters 76.

Figure 55B:
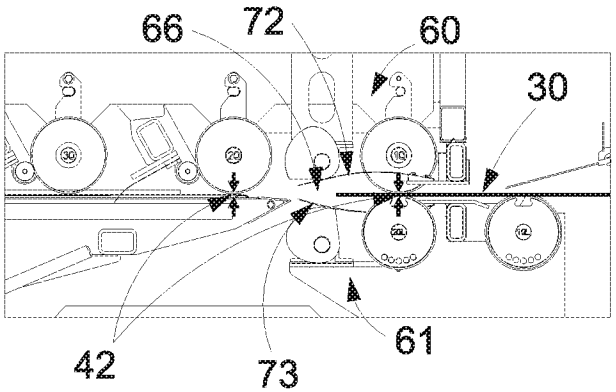
FIG. 55 depicts a perspective view Sheet Quality Control Diverting Section 8 in the operating position.
Figure 55A:
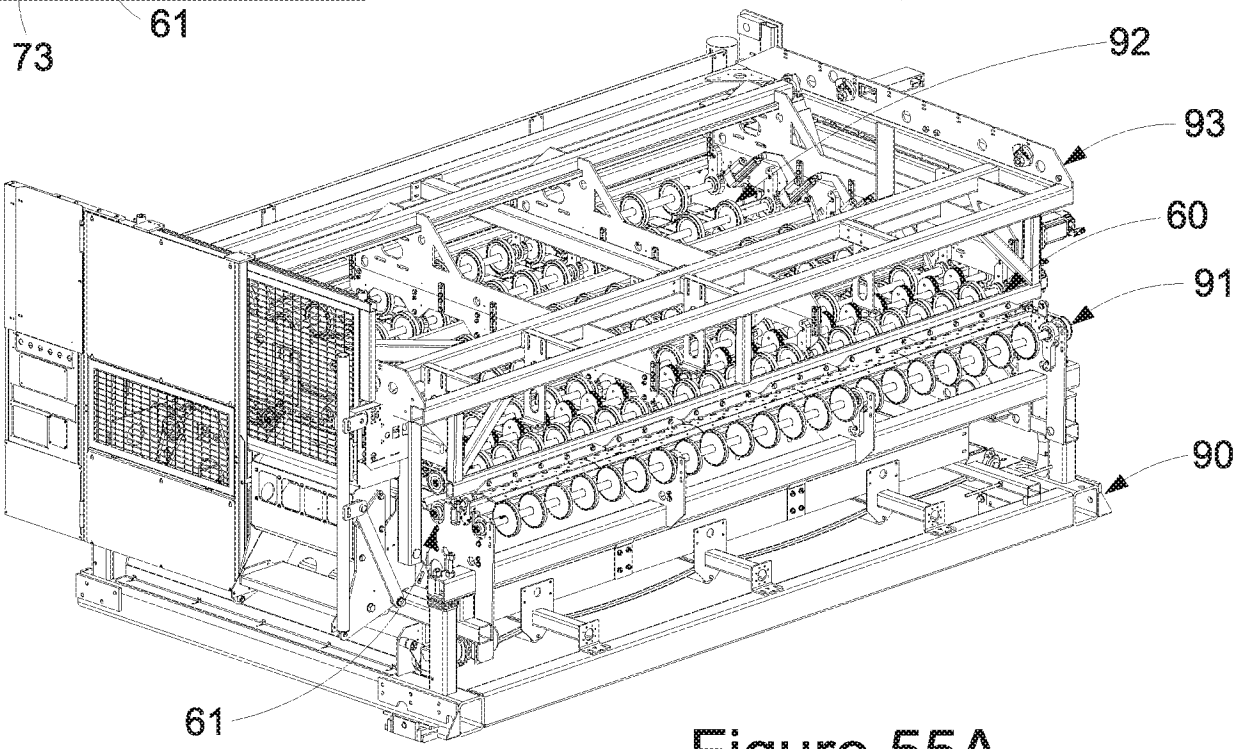

FIG. 55A depicts a perspective view Sheet Quality Control Diverting Section 8 in the operating position. FIG. 55B is a partial side view of the Normal Production Flow 49 showing the board nip. In this position, the nip can transport the materials and the diverting system is ready to divert a sheet. In order to achieve Diverting Repeatability, the amount of slip, known as board control, between the Corrugated Sheet Stock 30 and the transporting surfaces should be minimized. Having adjustable Board Nip 42 between the Lower Board Conveyor Section 91 and the Upper Board Conveyor Section 92 allows improved board control.

There is also the need to clean out and perform maintenance on the elements that are trapped between the Lower Board Conveyor Section 91 and the Upper Board Conveyor Section 92 when the machine is not running normal production. This can be accomplished by creating a Clam Shell 130 option.

Figure 56:
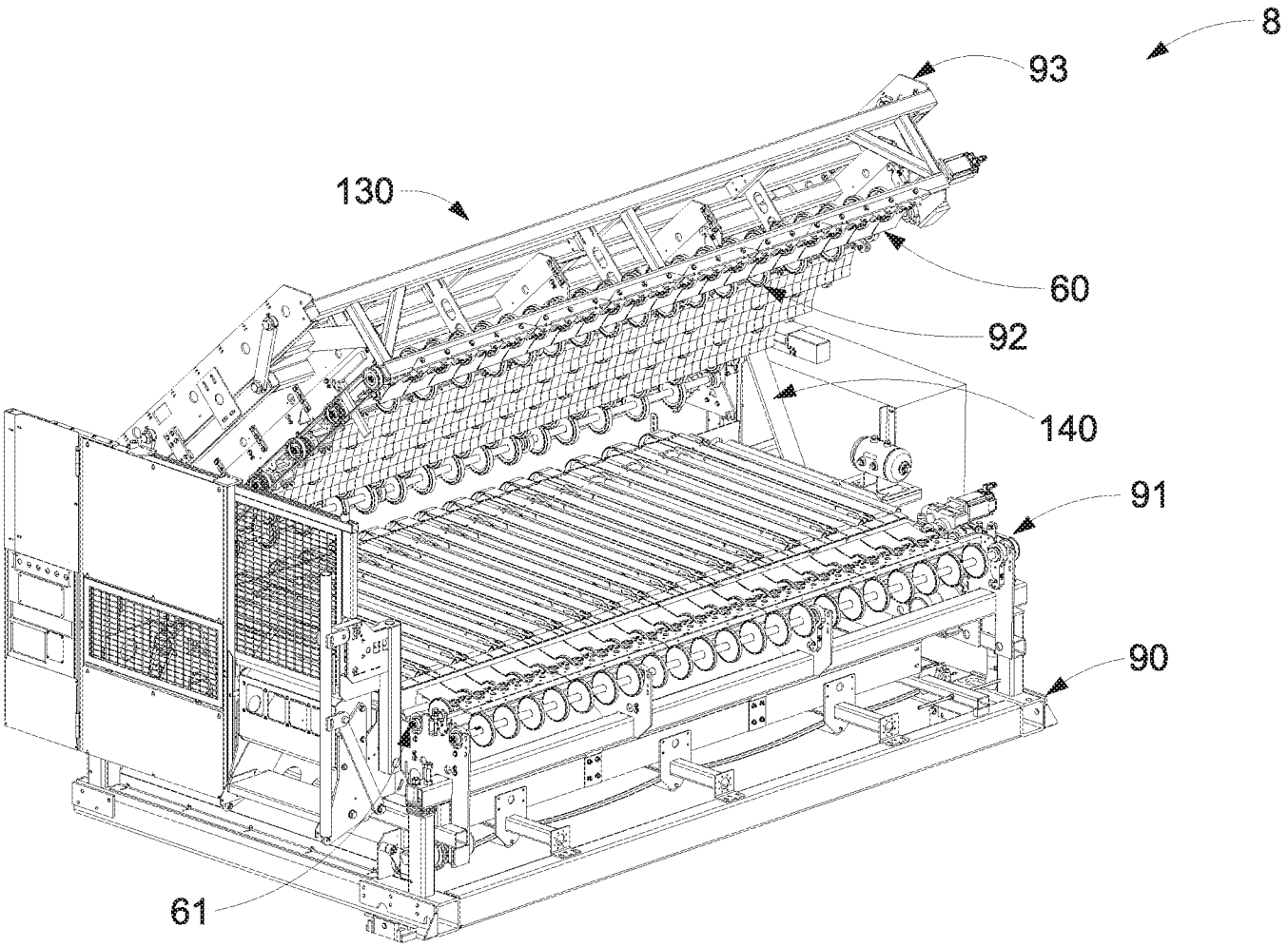
FIGS. 56 and 57 depicts two perspective view Sheet Quality Control Diverting Section 8 with the Clam Shell 130 option halfway open and fully open positions.
Figure 57:
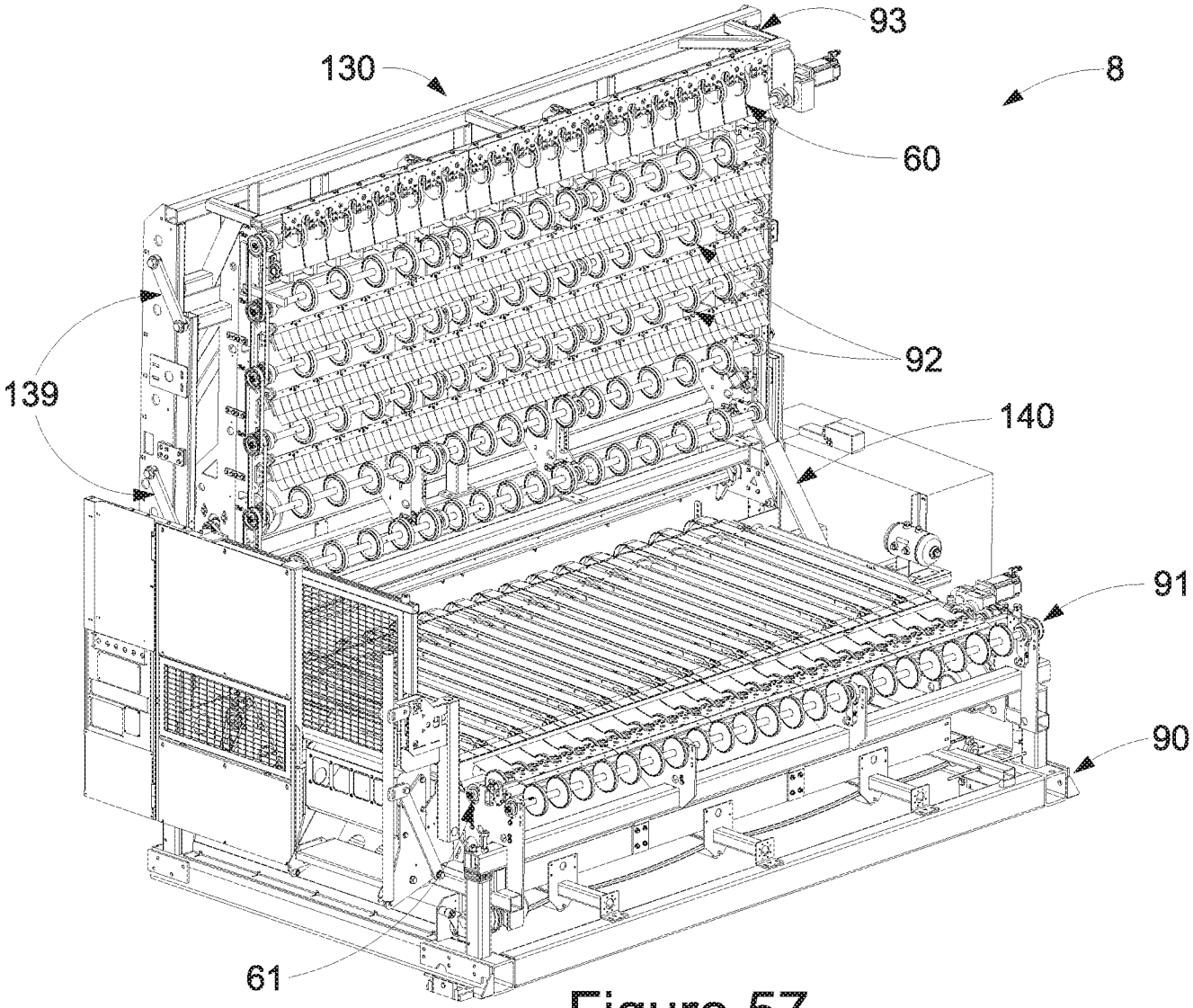

FIGS. 56 and 57 depicts two perspective view Sheet Quality Control Diverting Section 8 with the Clam Shell 130 option halfway open and fully open positions. The Sheet Quality Control Diverting Section 8 can adjust the Board Nip 42, that is the nip of the Upper Board Control Section 92 to the Lower Board Conveyor Section 91 as well as open in a clam shell motion using a Single Axis Actuation System 138. It can adjust the Board Nip 42 through its range without changing the size of the Diverting Funnel 66 created by the space between the Bottom Diverting Surface 73 and the Top Diverting Surface 72. Once the Clam Shell Action engages, both the Board Nip 42 and Top Diverting Surface 72 angle up with the Clam Shell 130 option.

Figure 58:
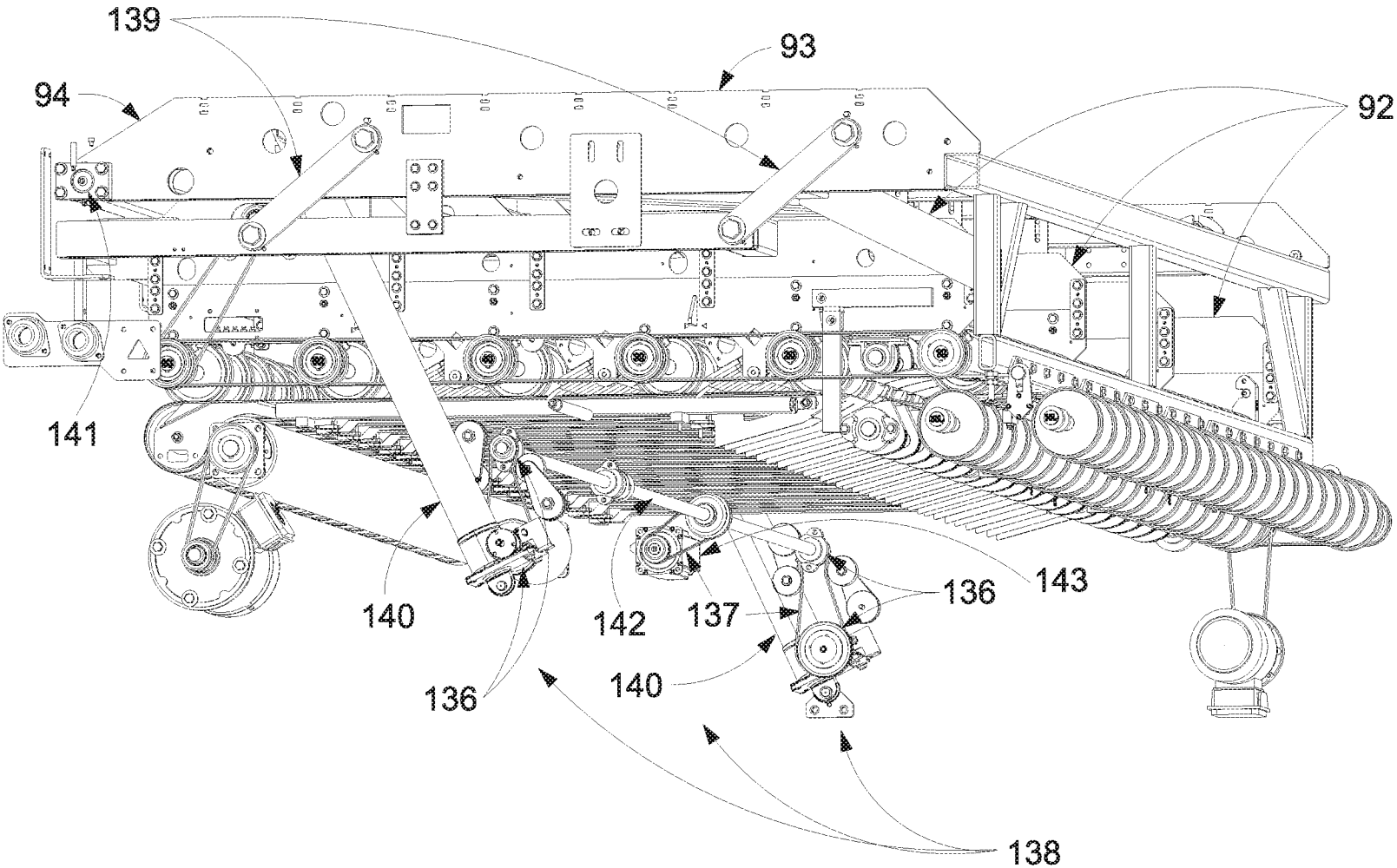
FIG. 58 shows the combination Nip Adjust Action and Clam Shell Action achieved with a Single Axis Actuation System 138.

FIG. 58 shows the combination Nip Adjust Action and Clam Shell Action achieved with a Single Axis Actuation System 138. The Upper Board Control Section 92 is suspended from the Upper Diverter Section 93 by Four Bar Linkages 139 with a pair on both sides of the machine. When the Upper Clam Shell Frame 94 is in its lower position and operatively resting on the Lower Board Conveyor Section 91, the Four Bar Linkages 139 allow the motion between the Upper Board Control Section 92 and the Lower Board Conveyor Section to stay parallel and adjustable with the motion of the Nip Clam Actuators 140. Nip Clam Actuators 140 are synchronized and driven by Nip Clam Actuators Timing Shaft 142 which is operatively controlled by Nip Clam Motor 143 and Nip Clam Timing Pulleys 136 and Nip Clam Timing Belts 137. Once the Upper Board Control Section 92 and Upper Diverter Section 93 make contact, then the they both pivot about the Clam Pivot 141 connected to the Upper Diverter Section 93.

One embodiment includes a static type diverter apparatus comprising: a diverter with a diverter surface; a diverter cam in contact with the diverter, the diverter cam having a diverter cam angle representing angle of rotation of the diverter cam, the diverter cam is configured to control position of the diverter as the diverter cam rotates such that rotation of the diverter cam causes the diverter surface to move from a position outside of (e.g., above) normal production flow to a diverting position within the normal production flow; a diverter cam shaft connected to the top diverter cam, rotation of the diverter cam shaft causes rotation of the diverter cam; and an electric motor connected to the diverter cam shaft and configured to rotate the diverter cam shaft.

In one example implementation, the diverter cam is configured to control the position of the diverter as it rotates by direct contact between an outer profile of the diverter cam and the diverter.

In one example implementation, initial rotation of the diverter cam to move the diverter surface from position above the normal production flow to the diverting position within the normal production flow does not cause the top diverter surface to interfere with the normal production flow.

In one example implementation, final rotation of the diverter cam once at the diverting position within the normal production flow allows holding the diverter's position.

One example implementation further comprises a control system which includes Virtual Sheet Tracking configured to coordinate motion of the diverter surface relative to a gap between items being diverted.

In one example implementation, the diverter is spring loaded against the diverter cam.

In one example implementation, initial rotation of the diverter cam to move the diverter surface from position above the normal production flow to the diverting position within the normal production flow does not cause the top diverter surface to interfere with the normal production flow; and final rotation of the diverter cam once at the diverting position within the normal production flow allows holding the diverter's position.

One example implementation further comprises a control system configured to perform virtual sheet tracking to coordinate motion of the diverter surface relative to a gap between items being diverted where said virtual sheet tracking has a memory structure for storing information for multiple sheets using upstream reference data to track the gaps between sheets.

In one example implementation, the virtual sheet tracking coordinates motion of the diverter surface relative to the gap between corrugated material in stream mode with a corrugated box production line.

One embodiment includes a static type diverter apparatus comprising: a top diverter with a top diverter surface; a top diverter cam in contact with the top diverter, the top diverter cam having a top diverter cam angle representing angle of rotation of the top diverter cam, the top diverter cam is configured to control position of the top diverter as the top diverter cam rotates such that rotation of the top diverter cam causes the top diverter surface to move from a position outside normal production flow to a diverting position within the normal production flow; a top diverter cam shaft connected to the top diverter cam, rotation of the top diverter cam shaft causes rotation of the top diverter cam; a top electric motor connected to the top diverter cam shaft and configured to rotate the top diverter cam shaft; a bottom diverter with a bottom diverter surface; a bottom diverter cam in contact with the bottom diverter, the bottom diverter cam having a bottom diverter cam angle representing angle of rotation of the bottom diverter cam, the bottom diverter cam is configured to control position of the bottom diverter as the bottom diverter cam rotates such that rotation of the bottom diverter cam causes the bottom diverter surface to move from a position outside normal production flow to a diverting position within the normal production flow; a bottom diverter cam shaft connected to the bottom diverter cam, rotation of the bottom diverter cam shaft causes rotation of the bottom diverter cam; and a bottom electric motor connected to the bottom diverter cam shaft and configured to rotate the bottom diverter cam shaft, the top diverter surface and the bottom diverter surface configured to create a funnel either allowing normal production flow or diverting items away from normal production flow.

In one example implementation, the top diverter cam is configured to control the position of the top diverter as it rotates by direct contact between an outer profile of the top diverter cam and the top diverter; and the bottom diverter cam is configured to control the position of the bottom diverter as it rotates by direct contact between an outer profile of the bottom diverter cam and the bottom diverter.

In one example implementation, initial rotation of the top diverter cam to move from outside normal production flow to the diverting position within the normal production flow does not cause the top diverter surface to interfere with the normal production flow; and initial rotation of the bottom diverter cam to move from outside normal production flow to the diverting position within the normal production flow does not cause the bottom diverter surface to interfere with the normal production flow.

In one example implementation, final rotation of the top diverter cam once at the diverting position within the normal production flow allows holding the top diverter's position; and final rotation of the bottom diverter cam once at the diverting position within the normal production flow allows holding the bottom diverter's position.

One example implementation further comprises a control system configured to perform Virtual Sheet Tracking to coordinate motion of the top diverter surface and the bottom diverter surface relative to a gap between items being diverted.

In one example implementation, the top diverter is spring loaded against the top diverter cam; and the bottom diverter is spring loaded against the bottom diverter cam.

In one example implementation, initial rotation of the top diverter cam to move from outside normal production flow to the diverting position within the normal production flow does not cause the top diverter surface to interfere with the normal production flow; final rotation of the top diverter cam angle once at the diverting position within the normal production flow allows holding the top diverter's position; initial rotation of the bottom diverter cam angle to move from outside normal production flow to the diverting position within the normal production flow does not cause the bottom diverter surface to interfere with the normal production flow; and final rotation of the bottom diverter cam angle once at the diverting position within the normal production flow allows holding the bottom diverter's position.

One example implementation further comprises a control system configured to perform virtual sheet tracking to coordinate the motion of the top diverter surface and the bottom diverter surface relative to a gap between items being diverted where the virtual sheet tracking includes a memory structure for storing information for multiple sheets using upstream reference data to track gaps between sheets.

In one example implementation, the Virtual Sheet Tracking coordinates motion of the top diverter surface and the bottom diverter surface relative to the gap between corrugated material in stream mode with a corrugated box production line.

One embodiment includes an apparatus comprising: a lower board conveyor; an upper board conveyor; an adjustable nip between the lower board conveyor and the upper board conveyor; an upper clam shell frame which move about a pivot relative to the lower board conveyor in a clam shell motion; a set of four bar linkages connecting the upper board conveyor to the upper clam shell frame; and an actuator providing position control from the lower board conveyor to the upper board conveyor, restrictions on the motion of the upper board conveyor such that after a finite amount of nip adjustment without motion of the upper clam shell frame the actuation system will affect the pivoting motion of the of the upper clam shell frame creating the clam shell motion.

One example implementation further comprises a diverting system connected to the upper clam shell frame, the diverting system comprising: a top diverter with a top diverter surface; a top diverter cam in contact with the top diverter, the top diverter cam having a top diverter cam angle representing angle of rotation of the top diverter cam, the top diverter cam is configured to control position of the top diverter as the top diverter cam rotates such that rotation of the top diverter cam causes the top diverter surface to move from a position outside normal production flow to a diverting position within the normal production flow; a top diverter cam shaft connected to the top diverter cam, rotation of the top diverter cam shaft causes rotation of the top diverter cam; and a top electric motor connected to the top diverter cam shaft and configured to rotate the top diverter cam shaft.

The foregoing detailed description has been presented for purposes of illustration and description. It is not intended to be exhaustive or to limit to the precise form disclosed. Many modifications and variations are possible in light of the above teaching. The described embodiments were chosen in order to best explain the principles of the proposed technology and its practical application, to thereby enable others skilled in the art to best utilize it in various embodiments and with various modifications as are suited to the particular use contemplated. It is intended that the scope be defined by the claims appended hereto.

What is claimed is:

1. A static type diverter apparatus comprising:

a diverter with a diverter surface, the diverter has a second surface that is opposite the diverter surface;

a diverter cam in contact with the diverter, the diverter cam having a diverter cam angle representing angle of rotation of the diverter cam, the diverter cam is configured to control position of the diverter as the diverter cam rotates by direct contact between an outer profile of the diverter cam and the second surface of the diverter such that rotation of the diverter cam causes the diverter surface to move from a position outside of normal production flow to a diverting position within the normal production flow to divert boxes from the normal production flow to an alternative path;

a diverter cam shaft connected to the diverter cam, rotation of the diverter cam shaft causes rotation of the diverter cam; and an electric motor connected to the diverter cam shaft and configured to rotate the diverter cam shaft.

2. The static type diverter apparatus of claim 1, wherein:

the diverter cam is configured to control the position of the diverter as it rotates by the outer profile of the diverter cam pushing the diverter to the diverting position.

3. The static type diverter apparatus of claim 1, further comprising:

a control system which includes Virtual Sheet Tracking configured to coordinate motion of the diverter surface relative to a gap between boxes being diverted.

4. The static type diverter apparatus of claim 1, wherein:

the diverter is spring loaded against the diverter cam.

5. The static type diverter apparatus of claim 4, wherein:

initial rotation of the diverter cam to move the diverter surface from the position outside of the normal production flow to the diverting position within the normal production flow does not cause the diverter surface to interfere with the normal production flow; and final rotation of the diverter cam allows holding the diverter's position.

6. The static type diverter apparatus of claim 5, further comprising:

a control system configured to perform virtual sheet tracking to coordinate motion of the diverter surface relative to a gap between items being diverted where said virtual sheet tracking has a memory structure for storing information for multiple boxes using upstream reference data to track the gaps between sheets.

7. The static type diverter apparatus of claim 6, wherein:

the virtual sheet tracking coordinates motion of the diverter surface relative to the gap between boxes in stream mode.

8. The static type diverter apparatus of claim 1, wherein:

the electric motor is configured to rotate the diverter cam shaft in two directions;

the diverter cam is configured to rotate in two directions, including rotating in a first direction and rotating in a second direction, in response to rotation of the diverter cam shaft;

the diverter cam is configured to cause the diverter surface to move from the position outside of normal production flow to the diverting position when rotating in the first direction; and the diverter cam is configured to cause the diverter surface to move from the diverting position to the position outside of normal production flow when rotating in the second direction.

9. The static type diverter apparatus of claim 1, further comprising:

multiple additional diverter cams in contact with the diverter, the multiple additional diverter cams are configured to control position of the diverter as the multiple additional diverter cams rotate by direct contact between the multiple additional diverter cams and the second surface of the diverter such that rotation of the multiple additional diverter cams causes the diverter surface to move from the position outside of normal production flow to the diverting position.

10. The static type diverter apparatus of claim 1, wherein:

the electric motor is configured to be accelerated and decelerated at its peak torque over a period longer than the time of moving the diverter surface.

11. The static type diverter apparatus of claim 1, further comprising:

a conveyor configured to support the boxes, the conveyor includes a lower conveyor nose, wherein the first diverter surface moving from the position outside of normal production flow to the diverting position within the normal production flow causes boxes to be diverted to the bottom side of the lower conveyor nose.

12. A static type diverter apparatus comprising:

a top diverter;

a top diverter cam in contact with the top diverter, the top diverter cam having a top diverter cam angle representing angle of rotation of the top diverter cam, the top diverter cam is configured to control position of the top diverter as the top diverter cam rotates such that rotation of the top diverter cam causes the top diverter cam to push the top diverter from a position outside normal production flow to a diverting position within the normal production flow;

a top diverter cam shaft connected to the top diverter cam, rotation of the top diverter cam shaft causes rotation of the top diverter cam;

a top electric motor connected to the top diverter cam shaft and configured to rotate the top diverter cam shaft;

a bottom diverter;

a bottom diverter cam in contact with the bottom diverter, the bottom diverter cam having a bottom diverter cam angle representing angle of rotation of the bottom diverter cam, the bottom diverter cam is configured to control position of the bottom diverter as the bottom diverter cam rotates such that rotation of the bottom diverter cam causes the bottom diverter cam to push the bottom diverter from a position outside normal production flow to a diverting position within the normal production flow;

a bottom diverter cam shaft connected to the bottom diverter cam, rotation of the bottom diverter cam shaft causes rotation of the bottom diverter cam; and a bottom electric motor connected to the bottom diverter cam shaft and configured to rotate the bottom diverter cam shaft, the top diverter and the bottom diverter configured to create a funnel either allowing normal production flow or diverting items away from normal production flow.

13. The static type diverter apparatus of claim 12, wherein:

the top diverter includes a top diverter surface and a top opposing surface that is opposite the top diverter surface;

the bottom diverter includes a bottom diverter surface and a bottom opposing surface that is opposite the bottom diverter surface;

the top diverter cam is configured to control the position of the top diverter as it rotates by direct contact between an outer profile of the top diverter cam and the top opposing surface of the top diverter; and the bottom diverter cam is configured to control the position of the bottom diverter as it rotates by direct contact between an outer profile of the bottom diverter cam and the bottom opposing surface of the bottom diverter.

14. The static type diverter apparatus of claim 12, further comprising:

a control system configured to perform Virtual Sheet Tracking to coordinate motion of the top diverter and the bottom diverter relative to a gap between items being diverted.

15. The static type diverter apparatus of claim 12, wherein:

the top diverter is spring loaded against the top diverter cam; and the bottom diverter is spring loaded against the bottom diverter cam.

16. An apparatus comprising:

a lower board conveyor;

an upper board conveyor;

an adjustable nip between the lower board conveyor and the upper board conveyor;

an upper clam shell frame which moves about a pivot relative to the lower board conveyor in a clam shell motion;

a set of four bar linkages connecting the upper board conveyor to the upper clam shell frame; and an actuator providing position control from the lower board conveyor to the upper board conveyor, restrictions on the motion of the upper board conveyor such that after a finite amount of nip adjustment without motion of the upper clam shell frame the actuation system will affect the pivoting motion of the of the upper clam shell frame creating the clam shell motion.

17. The claim apparatus of claim 16, further comprising a diverting system connected to the upper clam shell frame, the diverting system comprising:

a top diverter with a top diverter surface;

a top diverter cam in contact with the top diverter, the top diverter cam having a top diverter cam angle representing angle of rotation of the top diverter cam, the top diverter cam is configured to control position of the top diverter as the top diverter cam rotates such that rotation of the top diverter cam causes the top diverter surface to move from a position outside normal production flow to a diverting position within the normal production flow;

a top diverter cam shaft connected to the top diverter cam, rotation of the top diverter cam shaft causes rotation of the top diverter cam; and a top electric motor connected to the top diverter cam shaft and configured to rotate the top diverter cam shaft.

18. The static type diverter apparatus of claim 12, wherein:

the top electric motor is configured to rotate the top diverter cam shaft in two directions;

the top diverter cam is configured to rotate in two directions, including rotating in a first direction and rotating in a second direction, in response to rotation of the top diverter cam shaft;

the top diverter cam is configured to cause the top diverter to move from the position outside of normal production flow to the diverting position when rotating in the first direction; and the top diverter cam is configured to cause the top diverter to move from the diverting position to the position outside of normal production flow when rotating in the second direction.

19. The static type diverter apparatus of claim 12, further comprising:

multiple additional diverter cams in contact with the top diverter, the multiple additional diverter cams are configured to control position of the top diverter as the multiple additional diverter cams rotate by direct contact between the multiple additional diverter cams and the top diverter such that rotation of the multiple additional diverter cams causes the top diverter to move from the position outside of normal production flow to the diverting position.

20. The static type diverter apparatus of claim 12, wherein:

the top electric motor is configured to be accelerated and decelerated at its peak torque over a period longer than the time of moving the diverter surface.

* * * * *